US009153917B2

(12) United States Patent
Purdy

(10) Patent No.: US 9,153,917 B2
(45) **Date of Patent: *Oct. 6, 2015**

(54) COAXIAL CABLE CONNECTOR

(71) Applicant: PPC Broadband, Inc., East Syracuse, NY (US)

(72) Inventor: Eric Purdy, Constantia, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 8 days.

This patent is subject to a terminal disclaimer.

(21) Appl. No.: 13/860,708

(22) Filed: Apr. 11, 2013

(65) Prior Publication Data

US 2013/0224993 A1 Aug. 29, 2013

Related U.S. Application Data

(63) Continuation of application No. 13/213,954, filed on Aug. 19, 2011, now Pat. No. 8,465,322, and a continuation-in-part of application No. 13/072,605, filed on Mar. 25, 2011, now Pat. No. 8,342,879.

(51) Int. Cl.

| | |
|---|---|
| ***H01R 24/38*** | (2011.01) |
| ***H01R 9/05*** | (2006.01) |
| ***H01R 43/26*** | (2006.01) |
| *H01R 4/50* | (2006.01) |
| *H01R 13/52* | (2006.01) |

(52) U.S. Cl.

CPC ..... *H01R 24/38* (2013.01); *H01R 9/0524* (2013.01); *H01R 43/26* (2013.01); *H01R 4/5016* (2013.01); *H01R 13/5205* (2013.01); *Y10T 29/49174* (2015.01); *Y10T 29/49181* (2015.01)

(58) Field of Classification Search

CPC ..... H01R 2103/00; H01R 9/0521
USPC ..... 439/578–585
See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |

(Continued)

FOREIGN PATENT DOCUMENTS

| | | | |
|---|---|---|---|
| CA | 2096710 | A1 | 11/1994 |
| CN | 201149936 | Y | 11/2008 |

(Continued)

OTHER PUBLICATIONS

Digicon AVL Connector. ARRIS Group Inc. [online]. 3 pages. [retrieved on Apr. 22, 2010]. Retrieved from the Internet<URL: http://www.arrisi.com/special/digiconAVL.asp>.

(Continued)

*Primary Examiner* — Gary Paumen
(74) *Attorney, Agent, or Firm* — Barclay Damon LLP

(57) ABSTRACT

A connector coaxial cable connector comprising a connector body having an outer ramped surface, a post, engageable with the connector body, a coupling member, axially rotatable with respect to the post, and a compression portion structurally integral with the connector body, the compression portion having a ramped inner surface, wherein the inner ramped surface is configured to cooperate with the outer ramped surface during compression of the compression portion onto a portion of the connector body. Furthermore, an associated method is also provided.

14 Claims, 35 Drawing Sheets

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,194,292 | A | 7/1965 | Borowsky |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,109,126 | A | 8/1978 | Halbeck |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |

(56) References Cited

U.S. PATENT DOCUMENTS

| | | | |
|---|---|---|---|
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo |
| 4,515,427 | A | 5/1985 | Smit |
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,597,621 | A | 7/1986 | Burns |
| 4,598,959 | A | 7/1986 | Selvin |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,673,236 | A | 6/1987 | Musolff et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,690,482 | A | 9/1987 | Chamberland et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,720,155 | A | 1/1988 | Schildkraut et al. |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,738,628 | A | 4/1988 | Rees |
| 4,746,305 | A | 5/1988 | Nomura |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |
| 4,761,146 | A | 8/1988 | Sohoel |
| 4,772,222 | A | 9/1988 | Laudig et al. |
| 4,789,355 | A | 12/1988 | Lee |
| 4,797,120 | A | 1/1989 | Ulery |
| 4,806,116 | A | 2/1989 | Ackerman |
| 4,807,891 | A | 2/1989 | Neher |
| 4,808,128 | A | 2/1989 | Werth |
| 4,813,886 | A | 3/1989 | Roos et al. |
| 4,820,185 | A | 4/1989 | Moulin |
| 4,834,675 | A | 5/1989 | Samchisen |
| 4,835,342 | A | 5/1989 | Guginsky |
| 4,836,801 | A | 6/1989 | Ramirez |
| 4,838,813 | A | 6/1989 | Pauza et al. |
| 4,854,893 | A | 8/1989 | Morris |
| 4,857,014 | A | 8/1989 | Alf et al. |
| 4,867,706 | A | 9/1989 | Tang |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,915,651 | A | 4/1990 | Bout |
| 4,921,447 | A | 5/1990 | Capp et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,934,960 | A | 6/1990 | Capp et al. |
| 4,938,718 | A | 7/1990 | Guendel |
| 4,941,846 | A | 7/1990 | Guimond et al. |
| 4,952,174 | A | 8/1990 | Sucht et al. |
| 4,957,456 | A | 9/1990 | Olson et al. |
| 4,971,727 | A | 11/1990 | Takahashi et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 4,992,061 | A | 2/1991 | Brush, Jr. et al. |
| 5,002,503 | A | 3/1991 | Campbell et al. |
| 5,007,861 | A | 4/1991 | Stirling |
| 5,011,422 | A | 4/1991 | Yeh |
| 5,011,432 | A | 4/1991 | Sucht et al. |
| 5,021,010 | A | 6/1991 | Wright |
| 5,024,606 | A | 6/1991 | Ming-Hwa |
| 5,030,126 | A | 7/1991 | Hanlon |
| 5,037,328 | A | 8/1991 | Karlovich |
| 5,046,964 | A | 9/1991 | Welsh et al. |
| 5,052,947 | A | 10/1991 | Brodie et al. |
| 5,055,060 | A | 10/1991 | Down et al. |
| 5,059,747 | A | 10/1991 | Bawa et al. |
| 5,062,804 | A | 11/1991 | Jamet et al. |
| 5,066,248 | A | 11/1991 | Gaver, Jr. et al. |
| 5,073,129 | A | 12/1991 | Szegda |
| 5,080,600 | A | 1/1992 | Baker et al. |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,137,470 | A | 8/1992 | Doles |
| 5,137,471 | A | 8/1992 | Verespej et al. |
| 5,141,448 | A | 8/1992 | Mattingly et al. |
| 5,141,451 | A | 8/1992 | Down |
| 5,149,274 | A | 9/1992 | Gallusser et al. |
| 5,154,636 | A | 10/1992 | Vaccaro et al. |
| 5,161,993 | A | 11/1992 | Leibfried, Jr. |
| 5,166,477 | A | 11/1992 | Perin, Jr. et al. |
| 5,169,323 | A | 12/1992 | Kawai et al. |
| 5,181,161 | A | 1/1993 | Hirose et al. |
| 5,183,417 | A | 2/1993 | Bools |
| 5,186,501 | A | 2/1993 | Mano |
| 5,186,655 | A | 2/1993 | Glenday et al. |
| 5,195,905 | A | 3/1993 | Pesci |
| 5,195,906 | A | 3/1993 | Szegda |
| 5,205,547 | A | 4/1993 | Mattingly |
| 5,205,761 | A | 4/1993 | Nilsson |
| 5,207,602 | A | 5/1993 | McMills et al. |
| 5,215,477 | A | 6/1993 | Weber et al. |
| 5,217,391 | A | 6/1993 | Fisher, Jr. |
| 5,217,393 | A | 6/1993 | Del Negro et al. |
| 5,221,216 | A | 6/1993 | Gabany et al. |
| 5,227,093 | A | 7/1993 | Cole et al. |
| 5,227,587 | A | 7/1993 | Paterek |
| 5,247,424 | A | 9/1993 | Harris et al. |
| 5,269,701 | A | 12/1993 | Leibfried, Jr. |
| 5,283,853 | A | 2/1994 | Szegda |
| 5,284,449 | A | 2/1994 | Vaccaro |
| 5,294,864 | A | 3/1994 | Do |
| 5,295,864 | A | 3/1994 | Birch et al. |

(56) References Cited

U.S. PATENT DOCUMENTS

| | | | |
|---|---|---|---|
| 5,316,494 | A | 5/1994 | Flanagan et al. |
| 5,318,459 | A | 6/1994 | Shields |
| 5,334,032 | A | 8/1994 | Myers et al. |
| 5,334,051 | A | 8/1994 | Devine et al. |
| 5,338,225 | A | 8/1994 | Jacobsen et al. |
| 5,342,218 | A | 8/1994 | McMills et al. |
| 5,354,217 | A | 10/1994 | Gabel et al. |
| 5,359,735 | A | 11/1994 | Stockwell |
| 5,362,250 | A | 11/1994 | McMills et al. |
| 5,371,819 | A | 12/1994 | Szegda |
| 5,371,821 | A | 12/1994 | Szegda |
| 5,371,827 | A | 12/1994 | Szegda |
| 5,380,211 | A | 1/1995 | Kawaguchi et al. |
| 5,389,005 | A | 2/1995 | Kodama |
| 5,393,244 | A | 2/1995 | Szegda |
| 5,397,252 | A | 3/1995 | Wang |
| 5,413,504 | A | 5/1995 | Kloecker et al. |
| 5,431,583 | A | 7/1995 | Szegda |
| 5,435,745 | A | 7/1995 | Booth |
| 5,439,386 | A | 8/1995 | Ellis et al. |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,464,661 | A | 11/1995 | Lein et al. |
| 5,466,173 | A | 11/1995 | Down |
| 5,470,257 | A | 11/1995 | Szegda |
| 5,474,478 | A | 12/1995 | Ballog |
| 5,490,033 | A | 2/1996 | Cronin |
| 5,490,801 | A | 2/1996 | Fisher, Jr. et al. |
| 5,494,454 | A | 2/1996 | Johnsen |
| 5,499,934 | A | 3/1996 | Jacobsen et al. |
| 5,501,616 | A | 3/1996 | Holliday |
| 5,516,303 | A | 5/1996 | Yohn et al. |
| 5,525,076 | A | 6/1996 | Down |
| 5,542,861 | A | 8/1996 | Anhalt et al. |
| 5,548,088 | A | 8/1996 | Gray et al. |
| 5,550,521 | A | 8/1996 | Bernaud et al. |
| 5,564,938 | A | 10/1996 | Shenkal et al. |
| 5,571,028 | A | 11/1996 | Szegda |
| 5,586,910 | A | 12/1996 | Del Negro et al. |
| 5,595,499 | A | 1/1997 | Zander et al. |
| 5,598,132 | A | 1/1997 | Stabile |
| 5,607,325 | A | 3/1997 | Toma |
| 5,620,339 | A | 4/1997 | Gray et al. |
| 5,632,637 | A | 5/1997 | Diener |
| 5,632,651 | A | 5/1997 | Szegda |
| 5,644,104 | A | 7/1997 | Porter et al. |
| 5,651,698 | A | 7/1997 | Locati et al. |
| 5,651,699 | A | 7/1997 | Holliday |
| 5,653,605 | A | 8/1997 | Woehl et al. |
| 5,667,405 | A | 9/1997 | Holliday |
| 5,681,172 | A | 10/1997 | Moldenhauer |
| 5,683,263 | A | 11/1997 | Hsu |
| 5,696,196 | A | 12/1997 | DiLeo |
| 5,702,263 | A | 12/1997 | Baumann et al. |
| 5,722,856 | A | 3/1998 | Fuchs et al. |
| 5,735,704 | A | 4/1998 | Anthony |
| 5,746,617 | A | 5/1998 | Porter, Jr. et al. |
| 5,746,619 | A | 5/1998 | Harting et al. |
| 5,769,652 | A | 6/1998 | Wider |
| 5,770,216 | A | 6/1998 | Mitchnick et al. |
| 5,775,927 | A | 7/1998 | Wider |
| 5,863,220 | A | 1/1999 | Holliday |
| 5,877,452 | A | 3/1999 | McConnell |
| 5,879,191 | A | 3/1999 | Burris |
| 5,882,226 | A | 3/1999 | Bell et al. |
| 5,921,793 | A | 7/1999 | Phillips |
| 5,938,465 | A | 8/1999 | Fox, Sr. |
| 5,944,548 | A | 8/1999 | Saito |
| 5,949,029 | A | 9/1999 | Crotzer et al. |
| 5,957,716 | A | 9/1999 | Buckley et al. |
| 5,967,852 | A | 10/1999 | Follingstad et al. |
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,042,422 | A | 3/2000 | Youtsey |
| 6,048,229 | A | 4/2000 | Lazaro, Jr. |
| 6,053,769 | A | 4/2000 | Kubota et al. |
| 6,053,777 | A | 4/2000 | Boyle |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,117,539 | A | 9/2000 | Crotzer et al. |
| 6,123,567 | A | 9/2000 | McCarthy |
| 6,146,197 | A | 11/2000 | Holliday et al. |
| 6,152,753 | A | 11/2000 | Johnson et al. |
| 6,153,830 | A | 11/2000 | Montena |
| 6,180,221 | B1 | 1/2001 | Crotzer et al. |
| 6,210,216 | B1 | 4/2001 | Tso-Chin et al. |
| 6,210,222 | B1 | 4/2001 | Langham et al. |
| 6,217,383 | B1 | 4/2001 | Holland et al. |
| 6,239,359 | B1 | 5/2001 | Lilienthal, II et al. |
| 6,241,553 | B1 | 6/2001 | Hsia |
| 6,261,126 | B1 | 7/2001 | Stirling |
| 6,267,612 | B1 | 7/2001 | Arcykiewicz et al. |
| 6,271,464 | B1 | 8/2001 | Cunningham |
| 6,331,123 | B1 | 12/2001 | Rodrigues |
| 6,332,815 | B1 | 12/2001 | Bruce |
| 6,358,077 | B1 | 3/2002 | Young |
| 6,375,866 | B1 | 4/2002 | Paneccasio, Jr. et al. |
| D458,904 | S | 6/2002 | Montena |
| 6,406,330 | B2 | 6/2002 | Bruce |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,416,847 | B1 | 7/2002 | Lein et al. |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,465,550 | B1 | 10/2002 | Kleyer et al. |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,634,906 | B1 | 10/2003 | Yeh |
| 6,676,446 | B2 | 1/2004 | Montena |
| 6,683,253 | B1 | 1/2004 | Lee |
| 6,692,285 | B2 | 2/2004 | Islam |
| 6,692,286 | B1 | 2/2004 | De Cet |
| 6,712,631 | B1 | 3/2004 | Youtsey |
| 6,716,041 | B2 | 4/2004 | Ferderer et al. |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,767,248 | B1 | 7/2004 | Hung |
| 6,769,926 | B1 | 8/2004 | Montena |
| 6,780,052 | B2 | 8/2004 | Montena et al. |
| 6,780,068 | B2 | 8/2004 | Bartholoma et al. |
| 6,786,767 | B1 | 9/2004 | Fuks et al. |
| 6,790,081 | B2 | 9/2004 | Burris et al. |
| 6,805,584 | B1 | 10/2004 | Chen |
| 6,817,896 | B2 | 11/2004 | Derenthal |
| 6,848,939 | B2 | 2/2005 | Stirling |

(56) References Cited

U.S. PATENT DOCUMENTS 6,848,940 B2 2/2005 Montena
6,884,113 B1 4/2005 Montena
6,884,115 B2 4/2005 Malloy
6,887,103 B2 5/2005 Montena et al.
6,929,508 B1 8/2005 Holland
6,939,169 B2 9/2005 Islam et al.
6,971,912 B2 12/2005 Montena et al.
6,994,588 B2 2/2006 Montena
7,026,382 B2 4/2006 Akiba et al.
7,029,326 B2 4/2006 Montena
7,070,447 B1 7/2006 Montena
7,086,897 B2 8/2006 Montena
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,179,121 B1 2/2007 Burris et al.
7,229,303 B2 6/2007 Vermoesen et al.
7,252,546 B1 8/2007 Holland
7,255,598 B2 8/2007 Montena et al.
7,299,550 B2 11/2007 Montena
7,364,462 B2 4/2008 Holland
7,375,533 B2 5/2008 Gale
7,393,245 B2 7/2008 Palinkas et al.
7,404,737 B1 7/2008 Youtsey
7,452,239 B2 11/2008 Montena
7,455,550 B1 11/2008 Sykes
7,462,068 B2 12/2008 Amidon
7,476,127 B1 1/2009 Wei
7,479,035 B2 1/2009 Bence et al.
7,488,210 B1 2/2009 Burris et al.
7,494,355 B2 2/2009 Hughes et al.
7,497,729 B1 3/2009 Wei
7,507,116 B2 3/2009 Laerke et al.
7,507,117 B2 3/2009 Amidon
7,544,094 B1 6/2009 Paglia et al.
7,566,236 B2 7/2009 Malloy et al.
7,607,942 B1 10/2009 Van Swearingen
7,674,132 B1 3/2010 Chen
7,682,177 B2 3/2010 Berthet
7,727,011 B2 6/2010 Montena et al.
7,753,705 B2 7/2010 Montena
7,753,727 B1 7/2010 Islam et al.
7,794,275 B2 9/2010 Rodrigues
7,806,714 B2 10/2010 Williams et al.
7,806,725 B1 10/2010 Chen
7,811,133 B2 10/2010 Gray
7,824,216 B2 11/2010 Purdy
7,828,595 B2 11/2010 Mathews
7,830,154 B2 11/2010 Gale
7,833,053 B2 11/2010 Mathews
7,845,976 B2 12/2010 Mathews
7,845,978 B1 12/2010 Chen
7,850,487 B1 12/2010 Wei
7,857,661 B1 12/2010 Islam
7,887,354 B2 2/2011 Holliday
7,892,004 B2 2/2011 Hertzler et al.
7,892,005 B2 2/2011 Haube
7,892,024 B1 2/2011 Chen
7,927,135 B1 4/2011 Wlos
7,950,958 B2 5/2011 Mathews
7,955,126 B2 6/2011 Bence et al.
7,972,158 B2 7/2011 Wild et al.
7,997,930 B2 8/2011 Ehret et al.
8,016,613 B2 9/2011 Paglia et al.
8,029,315 B2 10/2011 Purdy et al.
8,062,044 B2 11/2011 Montena et al.
8,062,063 B2 11/2011 Malloy et al.
8,070,504 B2 12/2011 Amidon et al.
8,075,337 B2 12/2011 Malloy et al.
8,075,338 B1 12/2011 Montena
8,079,860 B1 12/2011 Zraik
8,113,875 B2 2/2012 Malloy et al.
8,113,879 B1 2/2012 Zraik
8,152,551 B2 4/2012 Zraik
8,157,588 B1 4/2012 Rodrigues et al.
8,157,589 B2 4/2012 Krenceski et al.
8,167,635 B1 5/2012 Mathews
8,167,636 B1 5/2012 Montena
8,167,646 B1 5/2012 Mathews
8,172,612 B2 5/2012 Bence et al.
8,192,237 B2 6/2012 Purdy et al.
8,342,879 B2 1/2013 Amidon et al.
8,444,445 B2 5/2013 Amidon et al.
8,591,244 B2 * 11/2013 Thomas et al. ..... 439/321
8,591,253 B1 * 11/2013 Chawgo et al. ..... 439/578
2002/0013088 A1 1/2002 Rodrigues et al.
2002/0038720 A1 4/2002 Kai et al.
2003/0214370 A1 11/2003 Allison et al.
2003/0224657 A1 12/2003 Malloy
2004/0018312 A1 1/2004 Halladay
2004/0077215 A1 4/2004 Palinkas et al.
2004/0102089 A1 5/2004 Chee
2004/0209516 A1 10/2004 Burris et al.
2004/0219833 A1 11/2004 Burris et al.
2004/0229504 A1 11/2004 Liu
2005/0042919 A1 2/2005 Montena
2005/0109994 A1 5/2005 Matheson et al.
2005/0208827 A1 9/2005 Burris et al.
2005/0233636 A1 10/2005 Rodrigues et al.
2006/0099853 A1 5/2006 Sattele et al.
2006/0110977 A1 5/2006 Mathews
2006/0154519 A1 7/2006 Montena
2007/0026734 A1 2/2007 Bence et al.
2007/0049113 A1 3/2007 Rodrigues et al.
2007/0077360 A1 4/2007 Kashiwagi et al.
2007/0123101 A1 5/2007 Palinkas
2007/0155232 A1 7/2007 Burris et al.
2007/0175027 A1 8/2007 Khemakhem et al.
2007/0243759 A1 10/2007 Rodrigues et al.
2007/0243762 A1 10/2007 Burke et al.
2008/0102696 A1 5/2008 Montena
2008/0289470 A1 11/2008 Aston
2009/0029590 A1 1/2009 Sykes et al.
2009/0098770 A1 4/2009 Bence et al.
2010/0055978 A1 3/2010 Montena
2010/0081321 A1 4/2010 Malloy et al.
2010/0081322 A1 4/2010 Malloy et al.
2010/0105246 A1 4/2010 Burris et al.
2010/0233901 A1 9/2010 Wild et al.
2010/0233902 A1 9/2010 Youtsey
2010/0239871 A1 9/2010 Scheffer et al.
2010/0255720 A1 10/2010 Radzik et al.
2010/0255721 A1 10/2010 Purdy et al.
2010/0279548 A1 11/2010 Montena et al.
2010/0297871 A1 11/2010 Haube
2010/0297875 A1 11/2010 Purdy et al.
2011/0021072 A1 1/2011 Purdy
2011/0027039 A1 2/2011 Blair
2011/0053413 A1 3/2011 Mathews
2011/0117774 A1 5/2011 Malloy et al.
2011/0143567 A1 6/2011 Purdy et al.
2011/0230089 A1 9/2011 Amidon et al.
2011/0230091 A1 9/2011 Krenceski et al.
2012/0021642 A1 1/2012 Zraik
2012/0094532 A1 4/2012 Montena
2012/0122329 A1 5/2012 Montena
2012/0145454 A1 6/2012 Montena
2012/0171894 A1 7/2012 Malloy et al.
2012/0196476 A1 8/2012 Haberek et al.
2012/0202378 A1 8/2012 Krenceski et al.
2012/0214342 A1 8/2012 Mathews
2012/0222302 A1 9/2012 Purdy et al.

(56) References Cited

U.S. PATENT DOCUMENTS

| | | | |
|---|---|---|---|
| 2012/0244733 | A1 | 9/2012 | Amidon et al. |
| 2012/0244748 | A1 | 9/2012 | Purdy |

FOREIGN PATENT DOCUMENTS

| | | | |
|---|---|---|---|
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| DE | 4439852 | A1 | 5/1996 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1548898 | | 6/2005 |
| EP | 1701410 | A2 | 9/2006 |
| FR | 2232846 | A1 | 1/1975 |
| FR | 2234680 | A2 | 1/1975 |
| FR | 231918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 4503793 | B2 | 1/2002 |
| JP | 2002075556 | A | 3/2002 |
| JP | 3280369 | B2 | 5/2002 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |
| WO | 2011128665 | | 10/2011 |
| WO | 2011128666 | | 10/2011 |
| WO | 2012061379 | A2 | 5/2012 |

OTHER PUBLICATIONS

Notice of Allowance (Mail Date Feb. 19, 2013) for U.S. Appl. No. 13/213,954 filed Aug. 19, 2011.

* cited by examiner

COAXIAL CABLE CONNECTOR

CROSS-REFERENCE TO RELATED APPLICATIONS

This application is a continuation of U.S. application Ser. No. 13/213,954 filed Aug. 19, 2011, and entitled "COAXIAL CABLE CONNECTOR" which is a continuation-in-part to U.S. application Ser. No. 13/072,605, filed Mar. 25, 2011, now U.S. Pat. No. 8,342,879 issued Jan. 1, 2013, and entitled "COAXIAL CABLE CONNECTOR."

FIELD OF TECHNOLOGY

The following relates to connectors used in coaxial cable communication applications, and more specifically to coaxial connectors having features for improving the efficiency of structures and processes for attaching the connectors to coaxial cables.

BACKGROUND

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference. Connectors for coaxial cables are typically connected onto complementary interface ports to electrically integrate coaxial cables to various electronic devices and cable communication equipment. Connection is often made through rotatable operation of an internally coupling member of the connector about a corresponding externally threaded interface port. Fully tightening the threaded connection of the coaxial cable connector to the interface port helps to ensure a ground connection between the connector and the corresponding interface port. However, often connectors are not properly tightened or otherwise installed to the interface port and proper electrical mating of the connector with the interface port does not occur. Moreover, when attached to an interface port, common connectors are often still susceptible to the unwanted introduction of environmental contaminants into the connector. In addition, common connectors often utilize cumbersome and/or costly components and installation processes associated with attaching the connectors to coaxial cables.

Hence a need exists for an improved connector having structural features that help prevent the entry of unwanted environmental contaminants into the coaxial cable connector, and that improve cost and effectiveness with relation to how the connector attaches to a coaxial cable.

SUMMARY

A first aspect relates generally to a coaxial cable connector comprising a connector body; a post, engageable with the connector body; a coupling member, axially rotatable with respect to the connector body, the coupling member having a first end and opposing second end; an outer sleeve engageable with the coupling member, the sleeve configured to rotate the coupling member; and a compression portion structurally integral with the connector body, wherein the compression portion is configured to break apart from the body when axially compressed.

A second aspect relates generally to a coaxial cable connector comprising; a connector body; a post engageable with connector body; a coupling member, axially rotatable with respect to the connector body, the coupling member having a first end and opposing second end portion; a sealing element attached to the coupling member, wherein the sealing element prevents ingress of environmental elements proximate the first end of the coupling member; and an outer sleeve engageable with the coupling member, the sleeve configured to rotate the coupling member.

A third aspect relates generally to a coaxial cable connector comprising: a connector body; a post engageable with connector body; a coupling member, axially rotatable with respect to the connector body, the coupling member having a first end and opposing second end; a sealing element attached to the coupling member, wherein the sealing element prevents ingress of environmental elements proximate the first end of the coupling member; and a compression portion structurally integral with the connector body, wherein the compression portion is configured to break apart from the body when axially compressed.

A fourth aspect relates generally to a method of fastening a coaxial cable to a communication port, the method comprising: providing a coaxial cable connector including:

a connector body; a post operably attached to the connector body; a coupling member axially rotatable with respect to the connector body; an outer sleeve engageable with the coupling member; and a compression portion structurally integral with the connector body; axially compressing the compression portion to form an environmental seal around the coaxial cable, wherein when axially compressed, the compression portion breaks away from the body and securely connects to the coaxial cable; and fastening the coupling member to an interface port by operating the outer sleeve.

A fifth aspect relates generally to a coaxial cable connector comprising a connector body having an outer ramped surface, a post, engageable with the connector body, a coupling member, axially rotatable with respect to the post, and a compression portion structurally integral with the connector body, the compression portion having a ramped inner surface, wherein the inner ramped surface is configured to cooperate with the outer ramped surface during compression of the compression portion onto a portion of the connector body.

A sixth aspect relates generally to a coaxial cable connector comprising a connector body having a first end and a second end, the connector body including an outer ramped surface proximate the second end, a post engageable with the connector body, a coupling member, axially rotatable with respect to the post, a compression portion sharing a frangible connection with the connector body, the frangible connection being defined by the outer ramped surface of the connector body and an internal annular groove.

A seventh aspect relates generally to a coaxial cable connector comprising a connector body having a first end and a second end, the connector body including an outer ramped surface proximate the second end, a post engageable with the connector body, a coupling member, axially rotatable with respect to the post, a compression portion sharing a frangible connection with the connector body, and a stress concentrator positioned proximate the frangible connection.

An eight aspect relates generally to a method of fastening a coaxial cable to a coaxial cable, the method comprising providing a coaxial cable connector including a connector body having an outer ramped surface, a post, engageable with the connector body, a coupling member, axially rotatable with respect to the post, and a compression portion structurally integral with the connector body, the compression portion having a ramped inner surface, and axially compressing the compression portion to securably attached the connector to the coaxial cable and form an environmental seal around the coaxial cable, wherein the inner ramped surface is configured to cooperate with the outer ramped surface during the axial compression of the compression portion onto a portion of the connector body The foregoing and other features of construction and operation of the invention will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein.

DETAILED DESCRIPTION

Figure 1A:
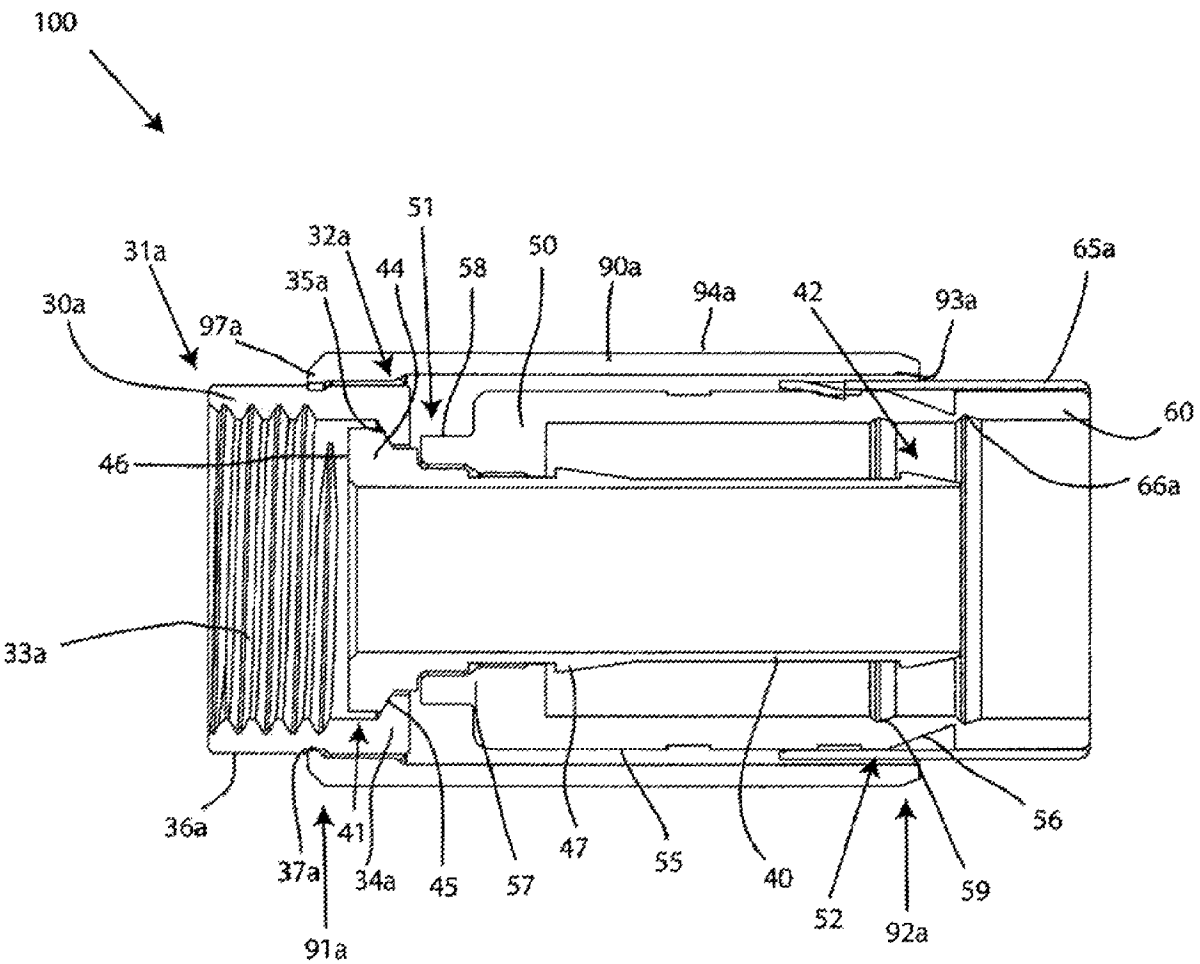
FIG. 1A depicts a cross-section view of a first embodiment of a coaxial cable connector including an embodiment of an outer sleeve, an embodiment of a compression portion, and an embodiment of a radial restriction member.

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Referring to the drawings, FIGS. 1A-29 depict embodiments of a coaxial cable connector 100-128. The coaxial cable connector 100-128 may be operably affixed, or otherwise functionally attached, to a coaxial cable 10 having a protective outer jacket 12, a conductive grounding shield 14, an interior dielectric 16 and a center conductor 18 (the cable 10 being shown in FIG. 1C). The coaxial cable 10 may be prepared as embodied in FIG. 1C by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection, such as cuprous braided material, aluminum foils, thin metallic elements, or other like structures. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation, such as plastic foam material, paper materials, rubber-like polymers, or other functional insulating materials. It should be noted that the various materials of which all the various components of the coaxial cable 10 are comprised should have some degree of elasticity allowing the cable 10 to flex or bend in accordance with traditional broadband communication standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIGS. 1A-29, a connector, such as connector 100-128 may also interact with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 operable electrical interface with a connector 100-128. However, the receptacle of the port 20 should be formed of a conductive material, such as a metal, like brass, copper, or aluminum. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Figure 28:
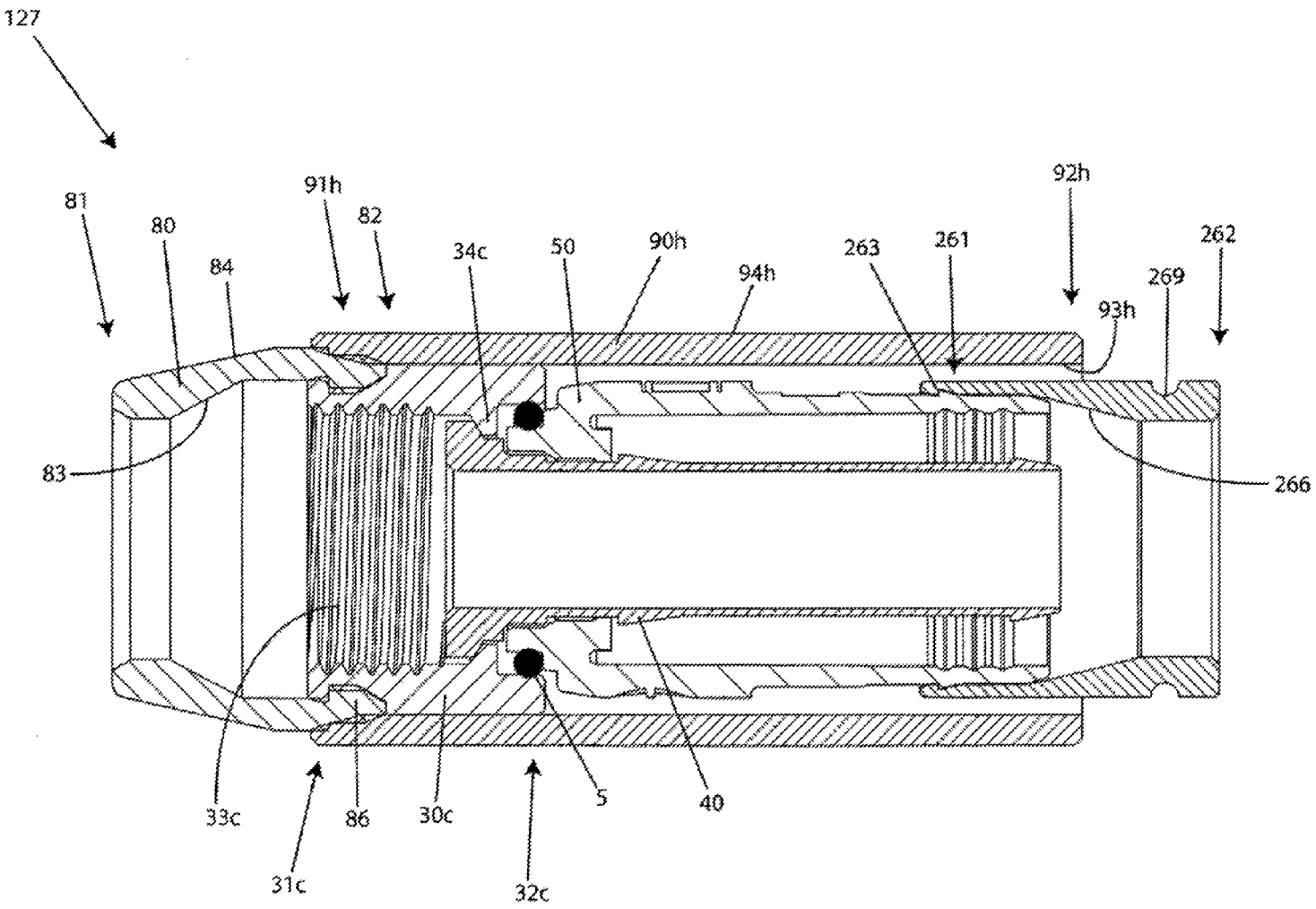
FIG. 28 depicts a cross-section view of a twenty-eighth embodiment of a coaxial cable connector including an embodiment of a sealing member, an embodiment of an outer sleeve, an embodiment of a compression portion configured to move axially external to an embodiment of a connector body.

Referring now to FIGS. 1A-25, embodiments of a coaxial cable connector 100-123 may further comprise a coupling member 30, a post 40, a connector body 50, an outer sleeve 90, a compression portion 60, a radial restriction member 65, and a connector body seal member 5 (as shown in FIG. 28), such as, for example, a body O-ring configured to fit around a portion of the connector body 50. Embodiments of coupling member 30 may be coupling member 30*a*, 30*b*, or 30*c* described in further detail infra. Embodiments of sleeve 90 may be sleeve 90*a*, 90*b*, 90*c*, 90*d*, 90*e*, 90*f*, 90*g*, or 90*h*, described in further detail infra. Similarly, embodiments of radial restriction member 65 may be 65*a*, 65*b*, or 65*c*, described in further detail infra. Connector 100-123 may come in a preassembled configuration or may require additional operable attachment of the sleeve 90 to connector 100-123 during installation.

Referring now to FIG. 1A, embodiments of connector 100 may include a coupling member 30*a*, a post 40, a connector body 50, an outer sleeve 90*a*, a compression portion 60, and a radial restriction member 65*a*.

Embodiments of connector 100 may include a coupling member 30*a*. The coupling member 30*a* of embodiments of a coaxial cable connector 100 has a first forward end 31*a* and opposing second rearward end 32*a*. The coupling member 30*a* may comprise internal threading 33*a* extending axially from the edge of first forward end 31*a* a distance sufficient to provide operably effective threadable contact with the external threads 23 of a standard coaxial cable interface port 20 (as shown, by way of example, in FIG. 1C). The coupling member 30*a* includes an internal lip 34*a*, such as an annular protrusion, located proximate the second rearward end 32*a* of the coupling member. The internal lip 34*a* includes a surface 35*a* facing the first forward end 31*a* of the coupling member 30*a*. The forward facing surface 35*a* of the lip 34*a* may be a tapered surface or side facing the first forward end 31*a* of the coupling member 30*a*. However, the internal lip 34*a* of coupling member 30*a* may define the second end 32*a* of the coupling member 30*a*, eliminating excess material from the coupling member 30*a*. Located somewhere on the outer surface 36*a* of the coupling member 30*a* may be a retaining structure 37*a*. The retaining structure 37*a* of the coupling member 30*a* may be an annular groove or recess that extends completely or partially around the outer surface 36*a* of the coupling member 30*a* to retain, accommodate, receive, or mate with an engagement member 97 of the sleeve 90. Alternatively, the retaining structure 37*a* may be an annular protrusion that extends completely or partially around the outer surface 36*a* of the coupling member 30*a* to retain or mate with the engagement member 97 of the outer sleeve 90. The retaining structure 37*a* may be placed at various axial positions from the first end 31*a* to the 32*a*, depending on the configuration of the sleeve 90 and other design requirements of connector 100.

Moreover, embodiments of coupling member 30*a* may include an outer surface feature(s) 38*a* proximate or otherwise near the second end 32*a* to improve mechanical interference or friction between the coupling member 30*a* and the sleeve 90. For instance, the outer surface feature 38*a* may extend completely or partially around the outer surface 36*a* proximate the second 32*a* of the coupling member 30*a* to increase a retention force between an inner surface 93 of the sleeve 90 and the outer surface 36*a* of the coupling member 30*a*. The outer surface feature 38*a* may include a knurled surface, a slotted surface, a plurality of bumps, ridges, grooves, or any surface feature that may facilitate contact between the sleeve 90 and the coupling member 30*a*. In one embodiment, the coupling member 30*a* may be referred to as a press-fit coupling member.

The structural configuration of the coupling member 30*a* may vary according differing connector design parameters to accommodate different functionality of a coaxial cable connector 100. For instance, the first forward end 31*a* of the coupling member 30*a* may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 31*a* of the coupling member 30*a*, when mated with an interface port 20. Those in the art should appreciate that the coupling member 30*a* need not be threaded. Moreover, the coupling member 30*a* may comprise a coupler commonly used in connecting RCA-type, or BNC-type connectors, or other common coaxial cable connectors having standard coupler interfaces. The coupling member 30*a* may be formed of conductive materials, such as copper, brass, aluminum, or other metals or metal alloys, facilitating grounding through the coupling member 30*a*. Further embodiments of the coupling member 30*a* may be formed of polymeric materials and may be non-conductive. Accordingly, the coupling member 30*a* may be configured to extend an electromagnetic buffer by electrically contacting conductive surfaces of an interface port 20 when a connector 100 is advanced onto the port 20. In addition, the coupling member 30*a* may be formed of both conductive and non-conductive materials. For example the external surface of the coupling member 30*a* may be formed of a polymer, while the remainder of the coupling member 30*a* may be comprised of a metal or other conductive material. The coupling member 30*a* may be formed of metals or polymers or other materials that would facilitate a rigidly formed coupling member body. Manufacture of the coupling member 30*a* may include casting, extruding, cutting, knurling, turning, tapping, drilling, injection molding, blow molding, combinations thereof, or other fabrication methods that may provide efficient production of the component. The forward facing surface 35*a* of the coupling member 30*a* faces a flange 44 the post 40 when operably assembled in a connector 100, so as to allow the coupling member 30*a* to rotate with respect to the other component elements, such as the post 40 and the connector body 50, of the connector 100.

Embodiments of connector 100 may include a post 40. The post 40 comprises a first forward end 41 and an opposing second rearward end 42. Furthermore, the post 40 may comprise a flange 44, such as an externally extending annular protrusion, located at the first end 41 of the post 40. The flange 44 includes a rearward facing surface 45 that faces the forward facing surface 35*a*, 35*b*, 35*c* of the coupling member 30*a*, 30*b*, 30*c* when operably assembled in a coaxial cable connector, so as to allow the coupling member 30 to rotate with respect to the other component elements, such as the post 40 and the connector body 50, of the connector 100-128. The rearward facing surface 45 of flange 44 may be a tapered surface facing the second rearward end 42 of the post 40. Further still, an embodiment of the post 40 may include a surface feature 47 such as a lip or protrusion that may engage a portion of a connector body 50 to secure axial movement of the post 40 relative to the connector body 50. However, the post need not include such a surface feature 47, and the coaxial cable connector 100-128 may rely on press-fitting and friction-fitting forces and/or other component structures having features and geometries to help retain the post 40 in secure location both axially and rotationally relative to the connector body 50. The location proximate or near where the connector body is secured relative to the post 40 may include surface features 43, such as ridges, grooves, protrusions, or knurling, which may enhance the secure attachment and locating of the post 40 with respect to the connector body 50. Moreover, various components having larger or smaller diameters can be readily press-fit or otherwise secured into connection with each other. Additionally, the post 40 may include a mating edge 46, which may be configured to make physical and electrical contact with a corresponding mating edge 26 of an interface port 20 (as shown in exemplary fashion in FIG. 1C). The post 40 should be formed such that portions of a prepared coaxial cable 10 including the dielectric 16 and center conductor 18 (examples shown in FIG. 1C) may pass axially into the second end 42 and/or through a portion of the tube-like body of the post 40. Moreover, the post 40 should be dimensioned, or otherwise sized, such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 should be conductive and may be formed of metals or may be formed of other conductive materials that would facilitate a rigidly formed post body. In addition, the post may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, combinations thereof, or other fabrication methods that may provide efficient production of the component.

Embodiments of a coaxial cable connector, such as connector 100, may include a connector body 50. The connector body 50 may comprise a first end 51 and opposing second end 52. Moreover, the connector body may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 100. The internal surface of the post mounting portion 57 may include an engagement feature, such as an annular detent or ridge having a different diameter than the rest of the post mounting portion 57. However other features such as grooves, ridges, protrusions, slots, holes, keyways, bumps, nubs, dimples, crests, rims, or other like structural features may be included. In addition, the connector body 50 may include an outer annular recess 58 located proximate or near the first end 51 of the connector body 50. Furthermore, the connector body 50 may include a semi-rigid, yet compliant outer surface 55, wherein the outer surface 55 may be configured to form an annular seal when the second end 52 is deformably compressed against a received coaxial cable 10 by operation of a compression portion 60. The connector body 50 may include an outer ramped surface 56 and an internal annular notch 59 or groove proximate the second end 52 to structurally facilitate the deformation of the connector body 50, as described in further detail infra.

Moreover, the connector body 50 may include an external annular detent located proximate or close to the second end 52 of the connector body 50. Further still, the connector body 50 may include internal surface features, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With continued reference to FIG. 1A, embodiments of connector 100 may include a sleeve 90*a*. The sleeve 90*a* may be engageable with the coupling member 30*a*. The sleeve 90*a* may include a first end 91*a*, a second 91*a*, an inner surface 93*a*, and an outer surface 94*a*. The sleeve 90*a* may be a generally annular member having a generally axial opening therethrough. The sleeve 90*a* may be radially disposed over the coupling member 30*a*, or a portion thereof, the connector body 50, or a portion thereof the compression portion 60, or a portion thereof, and radial restriction member 65, or a portion thereof, while operably assembled and/or in a compressed position. Proximate or otherwise near the first end 91*a*, the sleeve 90*a* may include an engagement member 97*a* configured to mate or engage with the retaining structure 37*a* of the coupling member 30*a*. The engagement member 97*a* may be an annular lip or protrusion that may enter or reside within the retaining structure 37*a* of the coupling member 30*a*. For example, in embodiments where the retaining structure 37*a* is an annular groove, the engagement member 97*a* may be a protrusion or lip that may snap into the groove located on the coupling member 30*a* to retain the sleeve 90*a* in a single axial position. In other words, the cooperating surfaces of the groove-like retaining structure 37*a* and the lip or protruding engagement member 97*a* may prevent axial movement of the sleeve 90*a* once the connector 100 is in an assembled configuration. Alternatively, the engagement member 97*a* may be an annular groove or recess that may receive or engage with the retaining structure 37*a* of the coupling member 30*a*. For example, in embodiments where the retaining structure 37*a* of the coupling member 30*a* is an annular protrusion, the engagement member 97*a* may be a groove or recess that may allow the annular protruding retaining structure 37*a* of the coupling member 30*a* to snap into to retain the sleeve 90*a* in a single axial position. In other words, the cooperating surfaces of the protruding retaining structure 37*a* and the groove-like engagement member 97*a* may prevent axial movement of the sleeve 90*a* once the connector 100 is in an assembled configuration. Those having skill in the art should understand that various surface features effectuating cooperating surfaces between the coupling member 30 and the sleeve 90 may be implemented to retain the sleeve 90*a* with respect to the rest of the connector 100 in an axial direction. Furthermore, the engagement member 97*a* of the sleeve 90*a* may be segmented such that one or more gaps may separate portions of the engagement member 97*a*, while still providing sufficient structural engagement with the retaining structure 37*a*.

Figure 1B:
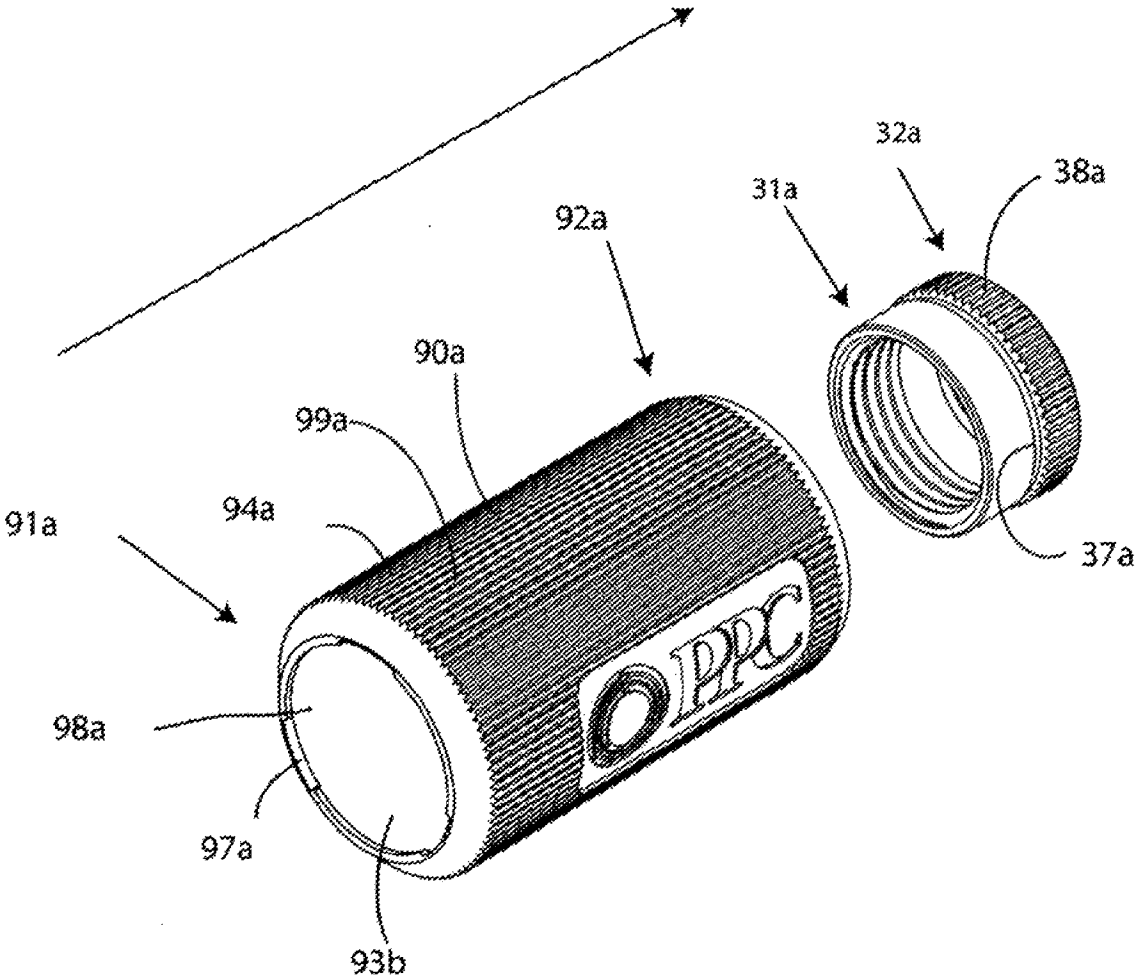
FIG. 1B depicts a perspective view of the first embodiment of the coaxial cable connector prior to an embodiment of the sleeve is operably attached to an embodiment of a coupling member.

An embodiment of an assembled configuration of connector 100 with respect to the sleeve 90*a* may involve sliding the sleeve 90*a* over the coupling member 30*a* in an axial direction starting from the first end 31*a* and continuing toward the second end 32*a* of the coupling member 30*a* until sufficient mating and/or engagement occurs between the engagement member 97*a* of the sleeve 90*a* and the retaining structure 37*a* of the coupling member 30*a*, as shown in FIG. 1B. Once in the assembled configuration, rotation of the sleeve 90*a* may in turn cause the coupling member 30*a* to simultaneously rotate in the same direction as the sleeve 90*a* due to mechanical interference between the inner surface 93*a* of the sleeve 90*a* and the outer surface 36*a* of the coupling member 30*a*. In some embodiments, the interference between the sleeve 90*a* and the coupling member 30*a* relies simply on a friction fit or interference fit between the components. Other embodiments include a coupling member 30*a* with an outer surface feature(s) 38*a*, as described supra, to improve the mechanical interference between the components. Further embodiments include a sleeve 90*a* with internal surface features 98*a* positioned on the inner surface 93*a* to improve the contact between the components. Even further embodiments of connector 100 may include a sleeve 90*a* and a coupling member 30*a* both having surface features 98*a*, 38*a*, respectively. Embodiments of the inner surface features 98*a* of the sleeve 90*a* may include a knurled surface, a slotted surface, a plurality of bumps, ridges, rib, grooves, or any surface feature that may facilitate contact between the sleeve 90*a* and the coupling member 30. In many embodiments, the inner surface features 98*a* of the sleeve 90*a* and the outer surface features 38*a* of the coupling member 30*a* may structurally correspond with each other. For example, the inner geometry of the sleeve 90*a* may reflect and/or structurally correspond with the outer geometric shape of the coupling member 30*a*. Due to the engagement between the sleeve 90*a* and the coupling member 30*a*, a user may simply grip and rotate/twist the sleeve 90*a* to thread the coupling element 30*a* onto an interface port, such as interface port 20. Further still, embodiments of the sleeve 90*a* may include outer surface features 99*a*, such as annular serrations or slots, configured to enhance gripping of the sleeve 90*a* while connecting the connector 100 onto an interface port. The sleeve 90*a* may be formed of materials such as plastics, polymers, bendable metals or composite materials that facilitate a rigid body. Further, the sleeve 90*a* may be formed of conductive or non-conductive materials or a combination thereof. Manufacture of the sleeve 90*a* may include casting, extruding, cutting, turning, drilling, knurling, injection molding, spraying, blow molding, component overmolding, combinations thereof, or other fabrication methods that may provide efficient production of the component.

Figure 1C:
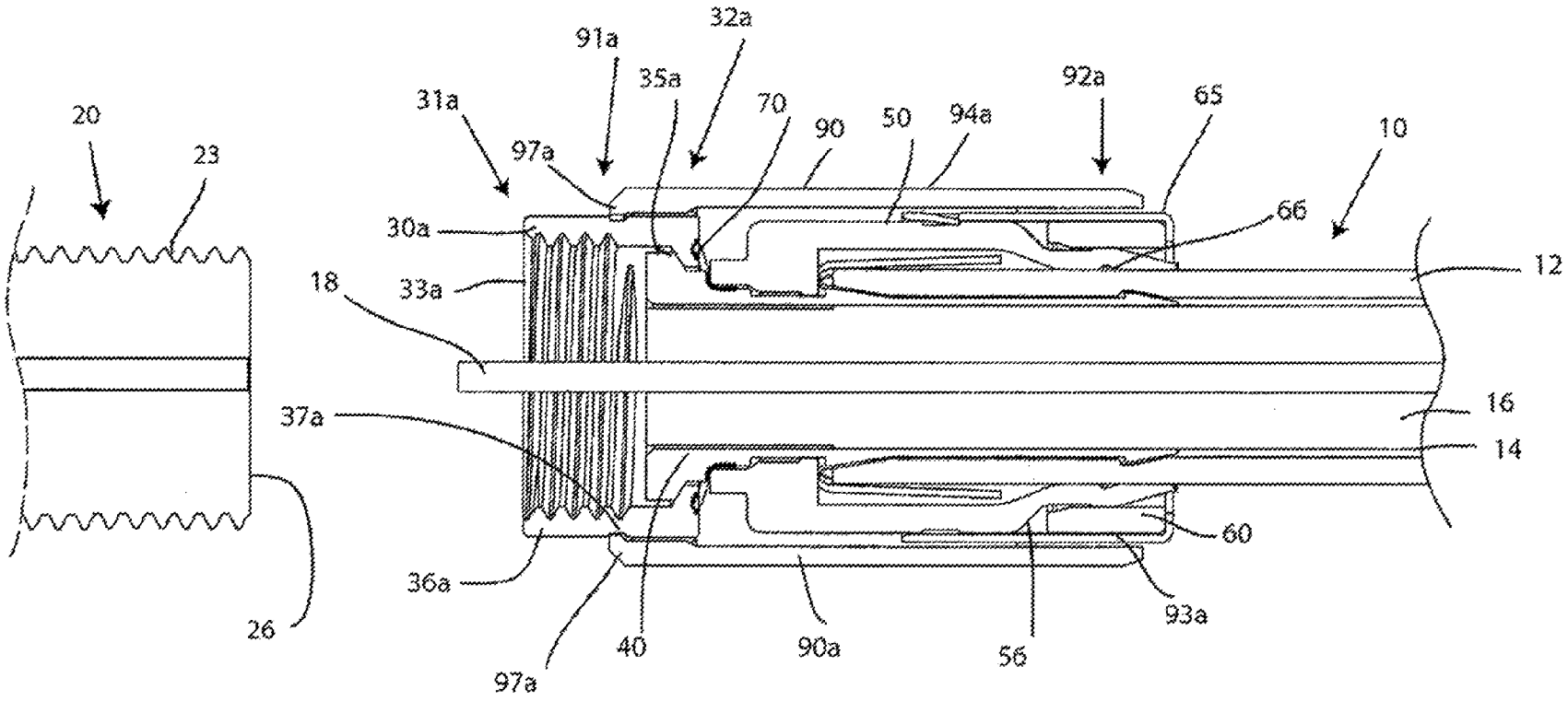
FIG. 1C depicts a cross-section view of the first embodiment of the coaxial cable connector after secure attachment to an embodiment of a coaxial cable.

Embodiments of connector 100 may include a compression portion 60. Compression portion 60 may be operably attached to the connector body 50. For instance, the compression portion 60 may be structurally integral with the connector body 50, wherein the compression portion 60 separates or shears from the connector body 50 upon an axial force which in turn radially compresses the second end 52 of the connector body 50 onto the coaxial cable 10, as shown in FIG. 1C. The structural connection between the connector body 50 and the compression portion 60 may be thin or otherwise breakable when compressive, axial force is applied (e.g. by an axial compression tool). For example, the compression portion 60 may have a frangible connection with the connector body 50. Moreover, the structural connection or configuration between the connector body 50 and the compression portion 60 may be defined by an internal annular notch 66 or groove of the compression portion 60 and an outer ramped surface 56 of the connector body 50. The annular notch 59 of the connector body 50 may further facilitate the deformation of the second end 52 of the connector body 1350. The compression portion 60 may be formed of the same material as connector body 50 because they may be structurally integral with each other. For example, the compression portion 60 may be comprised of materials such as plastics, polymers, bendable metals or composite materials that facilitate a rigid body. Further, the compression portion 60 may be formed of conductive or non-conductive materials or a combination thereof. Manufacture of the compression member 60 may include casting, extruding, cutting, turning, drilling, knurling, injection molding, spraying, blow molding, component overmolding, combinations thereof, or other fabrication methods that may provide efficient production of the component.

Furthermore, embodiments of connector 100 may include a radial restriction member 65*a*. The radial restriction member 65*a* may be a bushing or similar annular tubular member disposed proximate the rearward second end 52 of the connector body 50. For instance, the radial restriction member 65*a* may surround the compression portion 60 and a portion of the connector body 50 proximate the rearward second end 52. The radial restriction member 65*a* may be a generally annular, hollow cylindrically-shaped sleeve-like member comprised of stainless steel or other substantially rigid materials which may structurally assist the crack and seal process of compression portion 60. For instance, when the compression portion 60 is axially compressed in a direction towards the coupling member 30, the radial restriction member 65*a* may axially displace along with the compression portion 60 and may prevent the compression portion 60 from splintering or otherwise displacing in a direction other than substantially axial towards the coupling member 30.

Embodiments of the compression portion 60 may create an environmental seal around the coaxial cable 10 when in the fully compressed position. Specifically, when the compression portion 60 (and the radial restriction member 65*a*) is axially slid or compressed towards the coupling member 30, the structural connection between the compression portion 60 and the connector body 50 is severed, sheared, ruptured, etc., and the compression portion 60 comes into contact with the outer ramped surface 56 of the connector body 50. The severing of the structural connection between the connector body 50 and the compression portion 60 essentially turns the internal notch 66*a* into a cooperative ramped surface with the outer ramped surface 56 of the connector body 50. Due to the cooperative ramped surfaces, the axial compression (displacement) of the compression portion 60 evenly compresses the second end 52 of the connector body 50 onto the outer jacket 12 of the coaxial cable 10 and deforms the outer ramped surface 56, as shown in FIG. 1C. Accordingly, the compression portion 60 and potentially the radial restriction member 65*a* may be referred to as a crack and seal compression means with a radial restriction member 65*a*. Those skilled in the requisite art should appreciate that the seal may be created by the compression portion 60 without the radial restriction member 65*a*. However, the radial restriction member 65*a* significantly enhances the structural integrity and functional operability of the compression portion, for example, when it is compressed and sealed against an attached coaxial cable 10.

Figure 2:
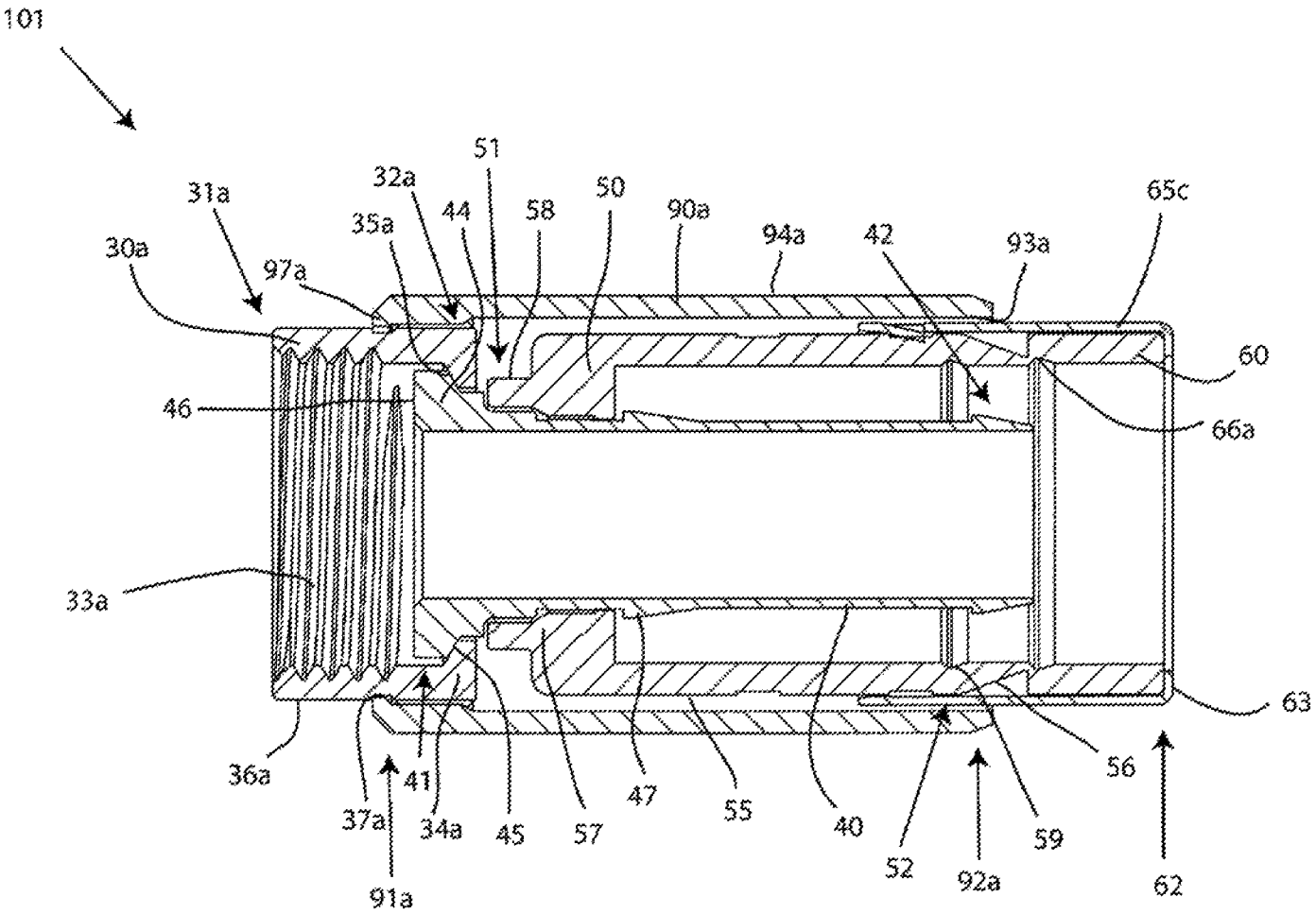
FIG. 2 depicts a cross-section view of a second embodiment of a coaxial cable connector including an embodiment of an outer sleeve, an embodiment of a compression portion, and an embodiment of a radial restriction member.

With reference to FIG. 2, embodiments of connector 101 may include a coupling member 30*a*, a post 40, a connector body 50, an outer sleeve 90*a*, a compression portion 60, and a radial restriction member 65*c*. Radial restriction member 65*c* may share the same or substantially the same function as radial restriction member 65*a*. However, radial restriction member 65*c* may be a cap member, or similar generally annular, tubular member having an engagement surface for operable engagement with a compression tool. For instance, embodiments of the radial restriction member 65*c* may include an internal annular lip 63 or inwardly extending flange proximate a rearward end 62 of the radial restriction member 65*c*. The radial restriction member 65*c* may surround or partially surround the compression portion 60 and a portion of the connector body 50 proximate the rearward second end 52, wherein the internal annular lip 63 of the radial restriction member 65*c* may be configured to contact the compression portion 6*a* prior to or upon axial compression of the connector. The radial restriction member 65*c* may be comprised of stainless steel or other substantially rigid materials which may structurally assist the crack and seal process of compression portion 60. For instance, when the compression portion 60 is axially compressed in a direction towards the coupling member 30, the radial restriction member 65*c* may axially displace along with the compression portion 60 and may prevent the compression portion 60 from splintering or otherwise displacing in a direction other than substantially axial towards the coupling member 30. Additionally, the internal lip 63 proximate the rearward end 62 of the radial restriction member 65*c* may provide an engagement surface for operable engagement with a compression tool, or other device/means that provides the necessary compression to compress seal connector 1302.

Figure 3:
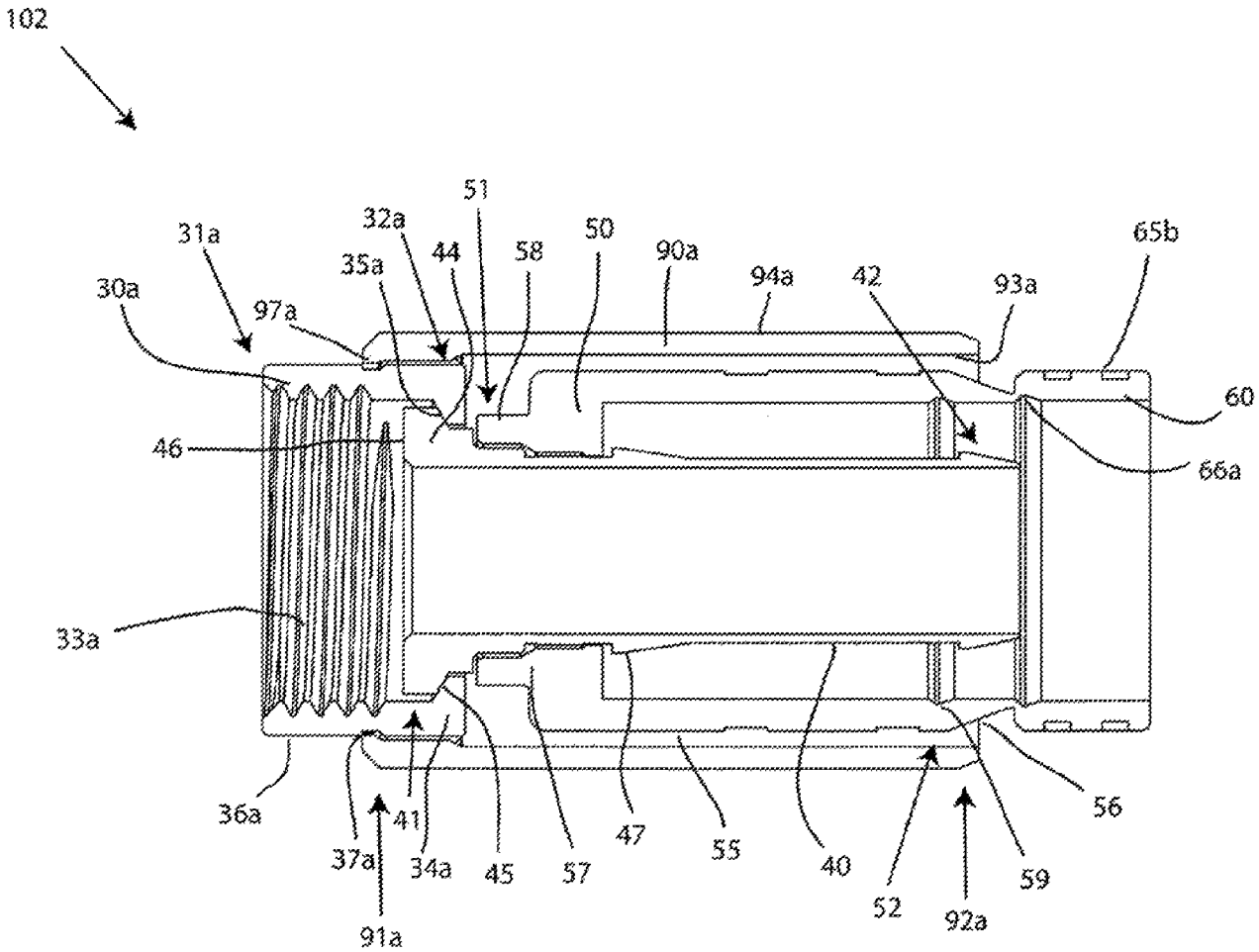
FIG. 3 depicts a cross-section view of a third embodiment of a coaxial cable connector including an embodiment of an outer sleeve, an embodiment of a compression portion, and an embodiment of a radial restriction member.

Referring now to FIG. 3, embodiments of connector 102 may include a coupling member 30*a*, a post 40, a connector body 50, an outer sleeve 90*a*, a compression portion 60, and a radial restriction member 65*b*. Radial restriction member 65*b* may share the same or substantially the same function as radial restriction member 65*a*. However, radial restriction member 65*b* may be one or more straps or bands that extend annularly around or partially around the compression portion 60. The radial restriction member 65*b* may be structurally attached to the compression portion 60 in a variety of methods, such as press-fit, adhesion, cohesion, fastened, etc. For instance, the radial restriction member 65*b* may reside within annular notches or grooves in the compression portion 60. The notches or grooves may have various depths to allow the radial restriction member 65 to be flush with the outer surface of the compression portion 60, to protrude from the outer surface of the compression portion 60, or to reside completely beneath the outer surface of the compression portion 60. Moreover, the radial restriction member 65 may be comprised of stainless steel or other substantially rigid materials which may structurally assist the crack and seal process of compression portion 60. For instance, when the compression portion 60 is axially compressed in a direction towards the coupling member 30*a*, the radial restriction member 65*b* may also prevent the compression portion 60 from splintering or otherwise displacing in a direction other than substantially axial towards the coupling member 30*a*.

Figure 4A:
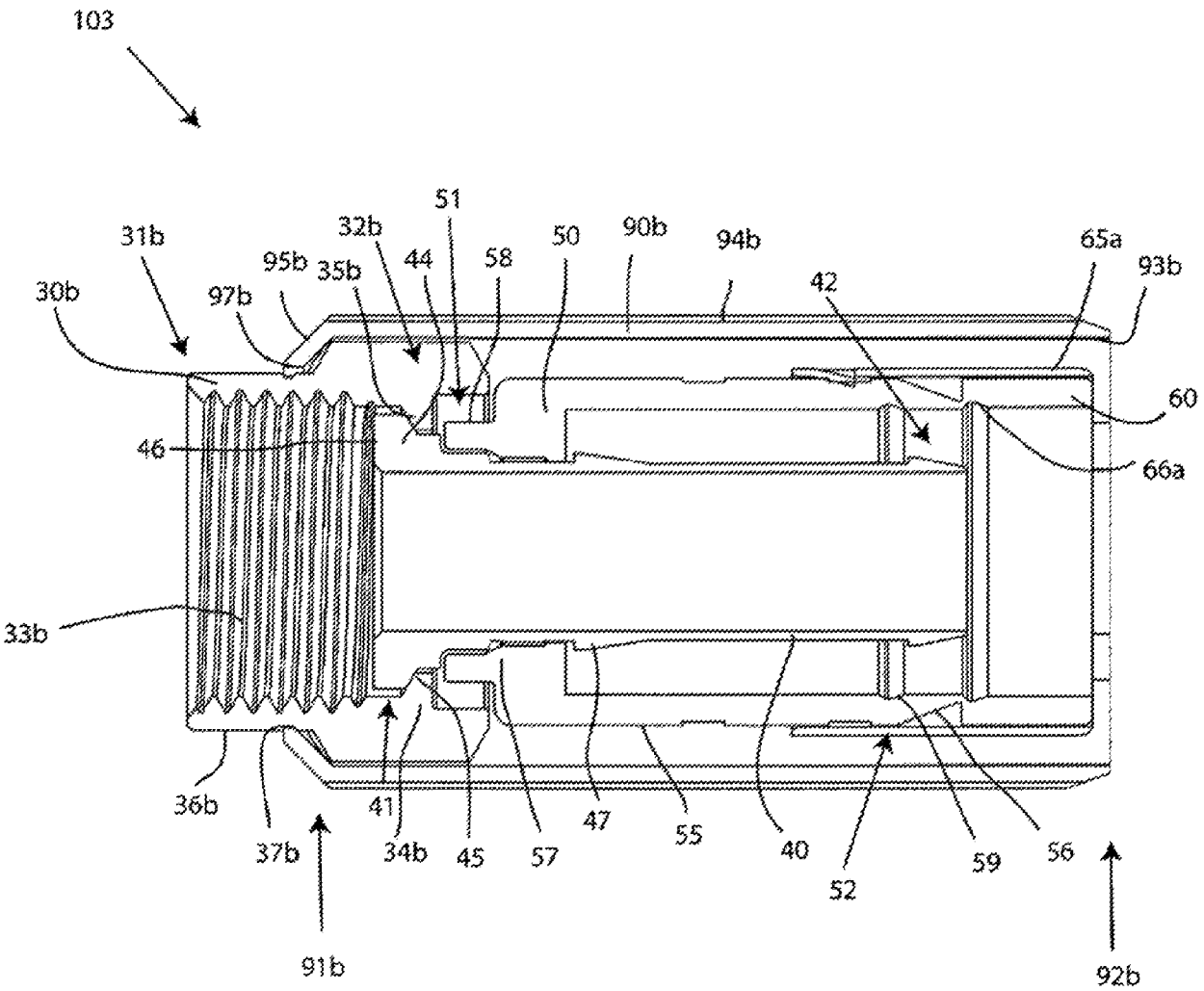
FIG. 4A depicts a cross-section view of a fourth embodiment of a coaxial cable connector including an embodiment of an outer sleeve, an embodiment of a compression portion, and an embodiment of a radial restriction member.

With reference to FIG. 4A, embodiments of connector 103 may include a coupling member 30*b*, a post 40, a connector body 50, an outer sleeve 90*b*, a compression portion 60, and a radial restriction member 65*a*.

Embodiments of a connector 103 may include a coupling member 30*b*. Coupling member 30*b* may share the same or substantially the same structural and functional aspects of coupling member 30*a*. Accordingly, coupling member 30*b* has a first forward end 31*b*, an opposing second rearward end 32*b*, internal threading 33*b*, an internal lip 34*b* including a surface 35*b* facing the first forward end 31*b* of the coupling member 30*b*. However, the second rearward end 32*b*, of the coupling member 30*b* may extend a significant axial distance to reside radially extent, or otherwise partially surround, a portion of the connector body 50, although the extended portion of the coupling member 30*b* need not contact the connector body 50. Additionally, coupling member 30*b* may include a retaining structure 37*b* on an outer surface 36*b* of the coupling member 30*b*. The retaining structure 37*b* may share the same or substantially same structural and functional aspects of the retaining structure 37*a* described in association with, for example, connector 100. Manufacture of the coupling member 30*b* may include casting, extruding, cutting, knurling, turning, tapping, drilling, injection molding, blow molding, combinations thereof, or other fabrication methods that may provide efficient production of the component. The forward facing surface 35*b* of the coupling member 30*b* faces a flange 44 the post 40 when operably assembled in a coaxial cable connector, so as to allow the coupling member 30*b* to rotate with respect to the other component elements, such as the post 40 and the connector body 50.

Figure 4B:
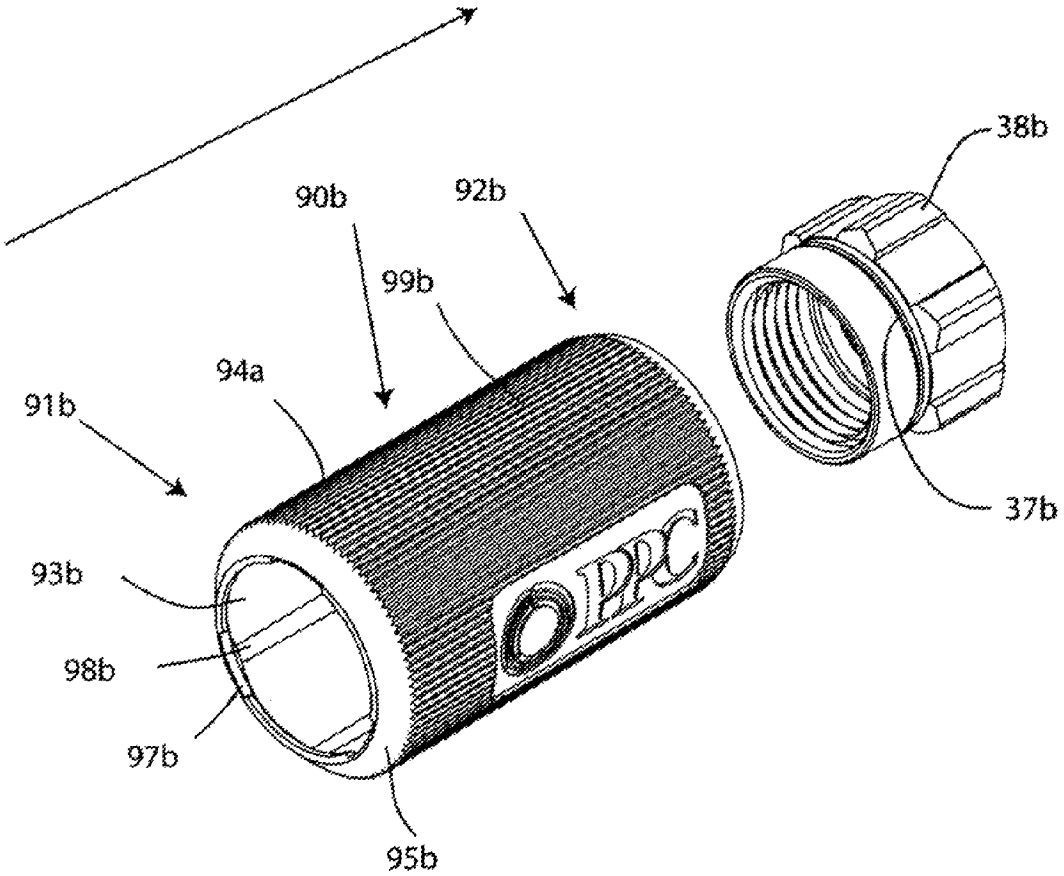
FIG. 4B depicts a perspective view of the fourth embodiment of the coaxial cable connector prior to an embodiment of a sleeve is operably attached to an embodiment of a coupling member.

Embodiments of connector 103 may include an outer sleeve 90*b*. Sleeve 90*b* may share the same structural and functional aspects of sleeve 90*a* described in association with, for example, connector 100. Accordingly, sleeve 90*b* may include an engagement member 97*b* that is configured to mate or engage with a retaining structure 37*b* of the coupling member 30*b*. For example, the sleeve 90*b* may include a first end 91*b*, a second end 92*b*, an inner surface 93*b*, and an outer surface 94*b*, and may be a generally annular member having a generally axial opening therethrough. However, the sleeve 90*b* may be radially disposed over the coupling member 30*b*, or a portion thereof, the connector body 50, or a portion thereof, the compression portion 60, or a portion thereof, and the radial restriction member 65, while operably assembled and/or in a compressed position. Additionally, the sleeve 90*b* may include an annular ramped surface 95*b* or chamfer proximate or otherwise near the first end 91*b* to accommodate an increased diameter or general size of the coupling member 30*b* proximate a second, rearward end 32*b* of the coupling member 30*b*. Embodiments of the ramped surface 95*b* may be structurally integral with the engagement member 97*b* and the body of the sleeve 90*b*. Furthermore, embodiments of an assembled configuration of connector 103 with respect to the sleeve 90*b* may involve sliding the sleeve 90*b* over the coupling member 30*b* in an axial direction starting from the first end 31*b* and continuing toward the second end 32*b* of the coupling member 30*b* until sufficient mating and/or engagement occurs between the engagement member 97*b* of the sleeve 90*b* and the retaining structure 37*b* of the coupling member 30*b*, as shown in FIG. 4B. Sleeve 90*b* may also include outer surface feature(s) 99*b*, such as annular serrations or slots, configured to enhance gripping of the sleeve 90 while connecting the coaxial cable connector onto an interface port.

Figure 5:
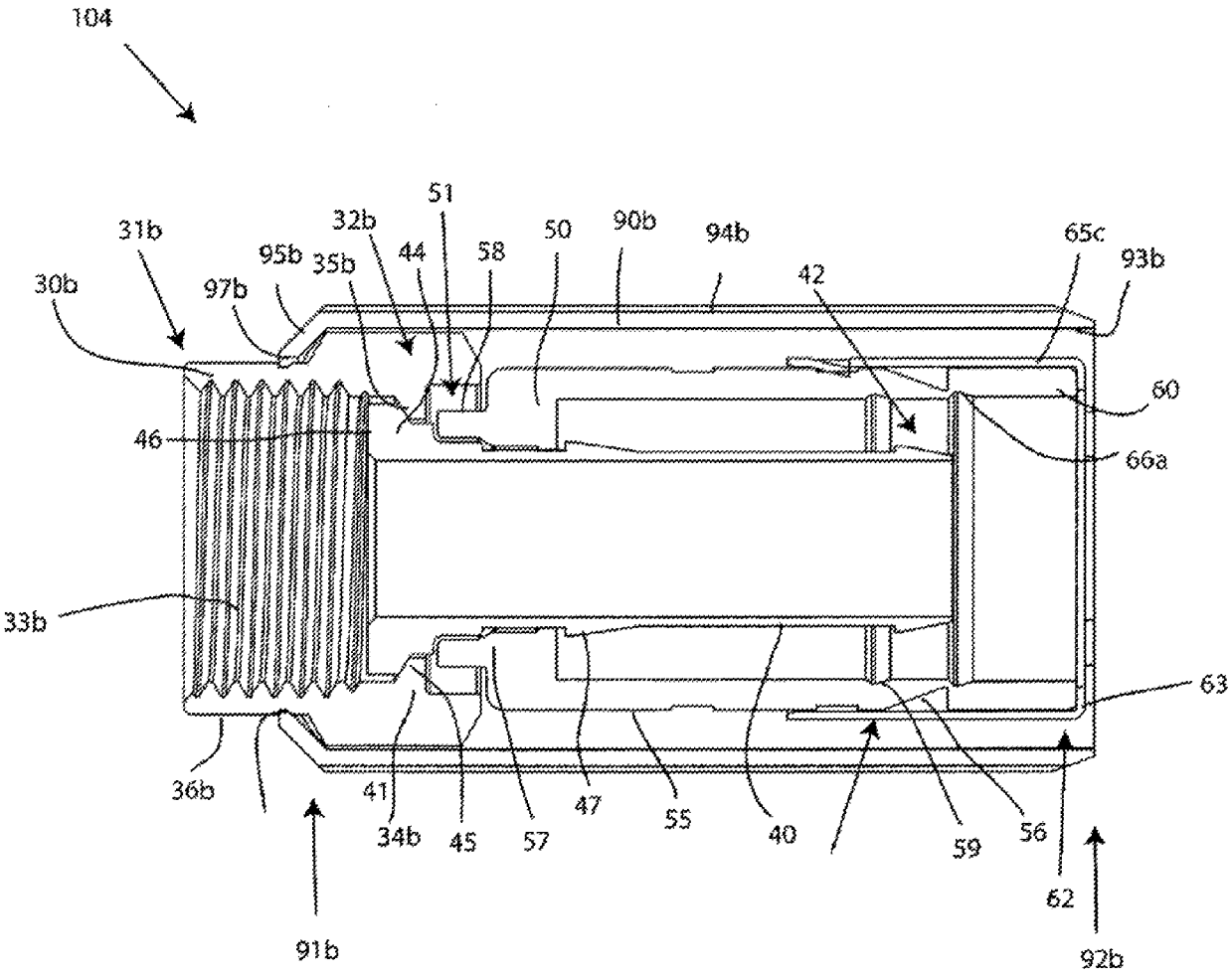
FIG. 5 depicts a cross-section view of a fifth embodiment of a coaxial cable connector including an embodiment of an outer sleeve, an embodiment of a compression portion, and an embodiment of a radial restriction member.

FIG. 5 depicts an embodiment of connector 104. Embodiments of connector 104 may include a coupling member 30*b*, a post 40, a connector body 50, an outer sleeve 90*b*, a compression portion 60, and a radial restriction member 65*c*.

Figure 6:
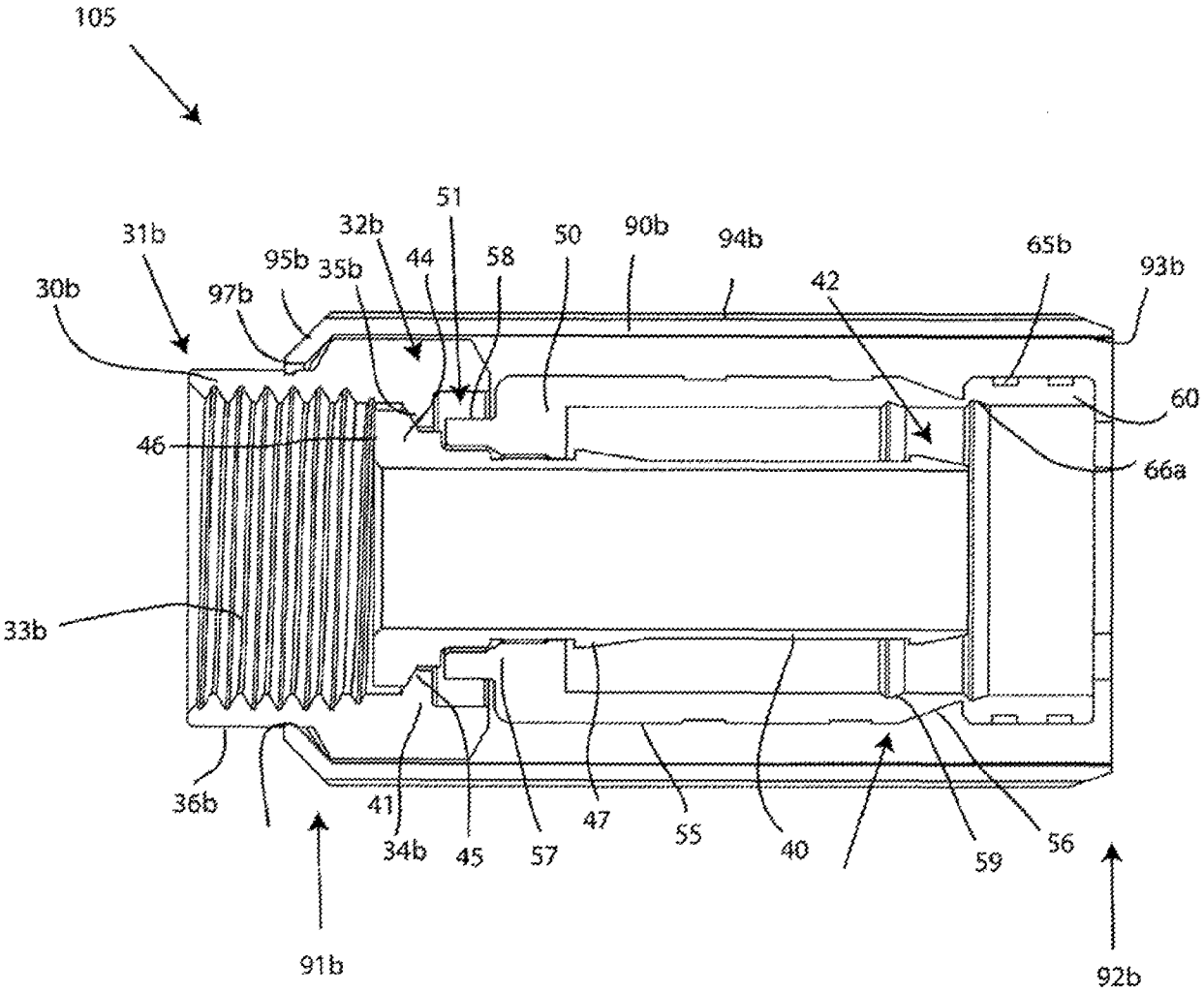
FIG. 6 depicts a cross-section view of a sixth embodiment of a coaxial cable connector including an embodiment of an outer sleeve, an embodiment of a compression portion, and an embodiment of a radial restriction member.

FIG. 6 depicts an embodiment of connector 105. Embodiments of connector 105 may include a coupling member 30*b*, a post 40, a connector body 50, an outer sleeve 90*b*, a compression portion 60, and a radial restriction member 65*b*

Figure 7:
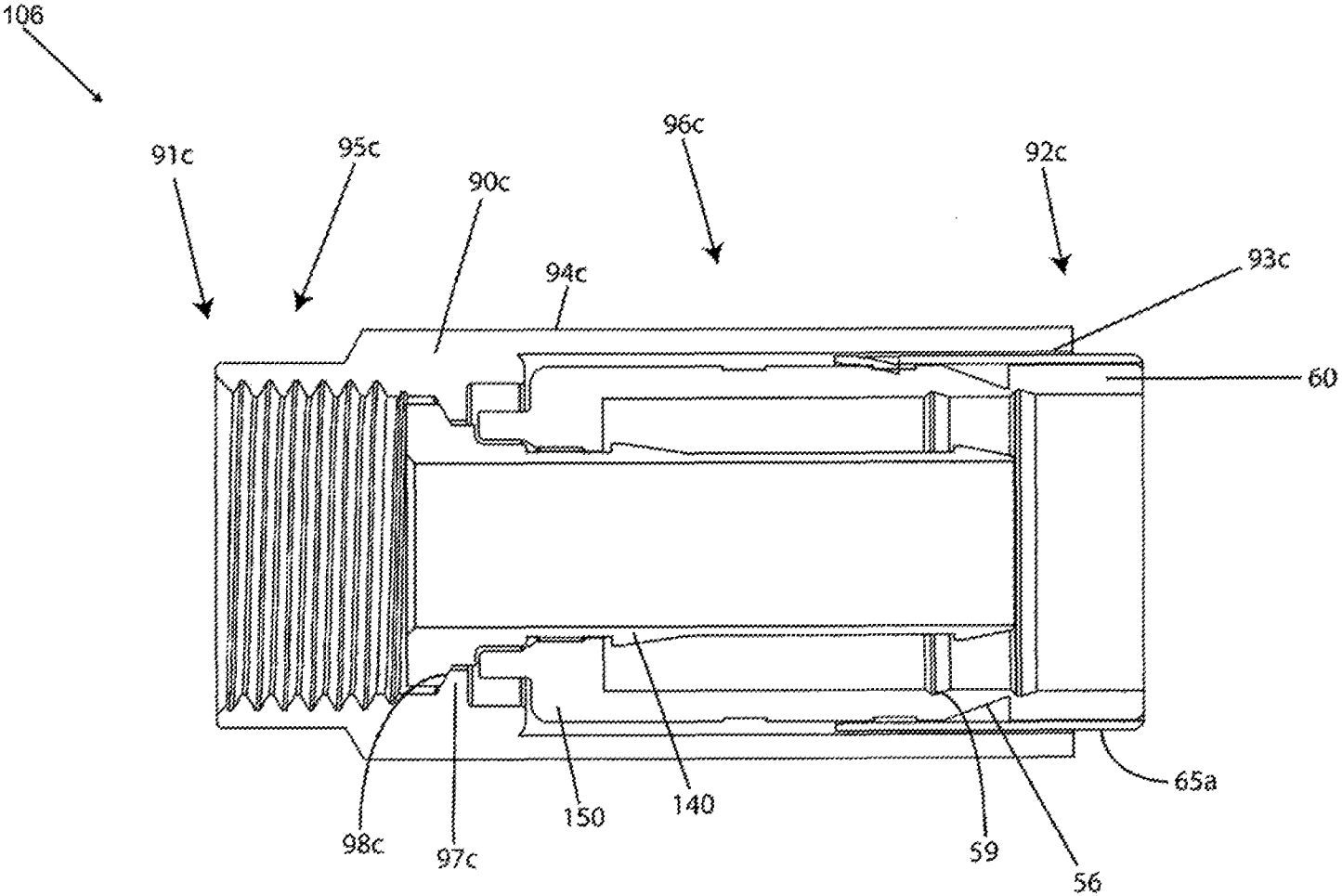
FIG. 7 depicts a cross-section view of an seventh embodiment of a coaxial cable connector including an embodiment of an outer integral sleeve, an embodiment of a compression portion, and an embodiment of a radial restriction member.

Referring now to FIG. 7, embodiments of connector 106 may include an integral sleeve 90*c*, a post 40, a connector body 50, a compression portion 60, and a radial restriction member 65*a*.

Embodiments of connector 106 may include an integral sleeve 90*c*. An integral sleeve 90*c* may be a generally annular member having a generally axial opening therethrough. The integral sleeve 90*c* may include a first end 91*c*, a second end 1392*c*, an outer surface 93*c*, and an outer surface 94*c*. Furthermore, the integral sleeve 90*c* may include a coupling portion 95*c* proximate the first end 91*c* and a body portion 96*c* structurally integral with the coupling portion 95*c*. The coupling portion 95*c* may include internal threads for operable engagement with an interface port, such as interface port 20. For instance, the internal threads of the coupling portion 95*c* of the integral sleeve 90*c* may correspond to threads on the outer surface of an interface port. The coupling portion 95*c* may also include an internal lip 97*c*, such as an annular protrusion. The internal lip 97*c* includes a surface 98*c* facing the first forward end 91*c* of the integral sleeve 90*c*. The forward facing surface 98*c* of the lip 97*c* may be a tapered surface that corresponds to a tapered surface 45 of the post 40. The forward facing surface 98*c* of the coupling portion 95*c* faces the flange 44 of the post 40 when operably assembled in a connector 106, so as to allow the integral sleeve 90*c* to rotate with respect to the other component elements, such as the post 40 and the connector body 50. The structural configuration of the coupling portion 95*c* of integral sleeve 90*c* may vary according to differing connector design parameters to accommodate different functionality of a coaxial cable connector. For instance, the first forward end 91*c* of the integral sleeve 90*c* may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 91*c* of the integral sleeve 90*c*, when mated with an interface port 20. Those in the art should appreciate that the coupling portion 95*c* need not be threaded.

Moreover, the integral sleeve 90*c* includes a body portion 96*c* that may be structurally integral with the coupling portion 95*c* to form an outer sleeve that may surround the post 40, the connector body 50, the compression portion 60, or a portion thereof, and the radial restriction member 65, or a portion thereof when in an assembled and/or compressed position. Because the body portion 96*c* may be structurally integral with the coupling portion 95*c*, rotation or twisting of the body portion 96*c* can cause rotation or twisting of the coupling portion 95*c* to operably mate a coaxial cable connector, such as connector 106, onto an interface port. Thus, the integral sleeve 90*c* includes a larger surface area to grip and twist the integral sleeve 90*c* to thread the coupling portion 95*c* fully onto the interface port, such as interface port 20. Embodiments of the body portion 96*c* of the integral sleeve 90*c* may include outer surface features, such as annular serrations or slots, configured to enhance gripping of the integral sleeve 90*c* while connecting the coaxial cable connector onto an interface port. The body portion 96*c* of the sleeve 90*c* may be formed of materials such as plastics, polymers, bendable metals or composite materials that facilitate a rigid body, while the coupling portion 95*c* may be formed of conductive materials, such as copper, brass, aluminum, or other metals or metal alloys, facilitating grounding through the connector. In other words, the integral sleeve 90*c* may be formed of both conductive and non-conductive materials. For example, the external surface of the coupling portion 95*c* of the integral sleeve 90*c* may be formed of a polymer, while the remainder of the coupling portion 95*c* may be comprised of a metal or other conductive material. Alternatively, the coupling portion 95*c* and the body portion 96*c* of the integral sleeve 90*c* may be formed of conductive materials such as metals or metal alloys, or may both be formed of polymers or other materials that would facilitate a rigidly formed component. Manufacture of the integral sleeve 90*c* may include casting, extruding, cutting, knurling, turning, tapping, drilling, injection molding, blow molding, combinations thereof, or other fabrication methods that may provide efficient production of the component.

Figure 8:
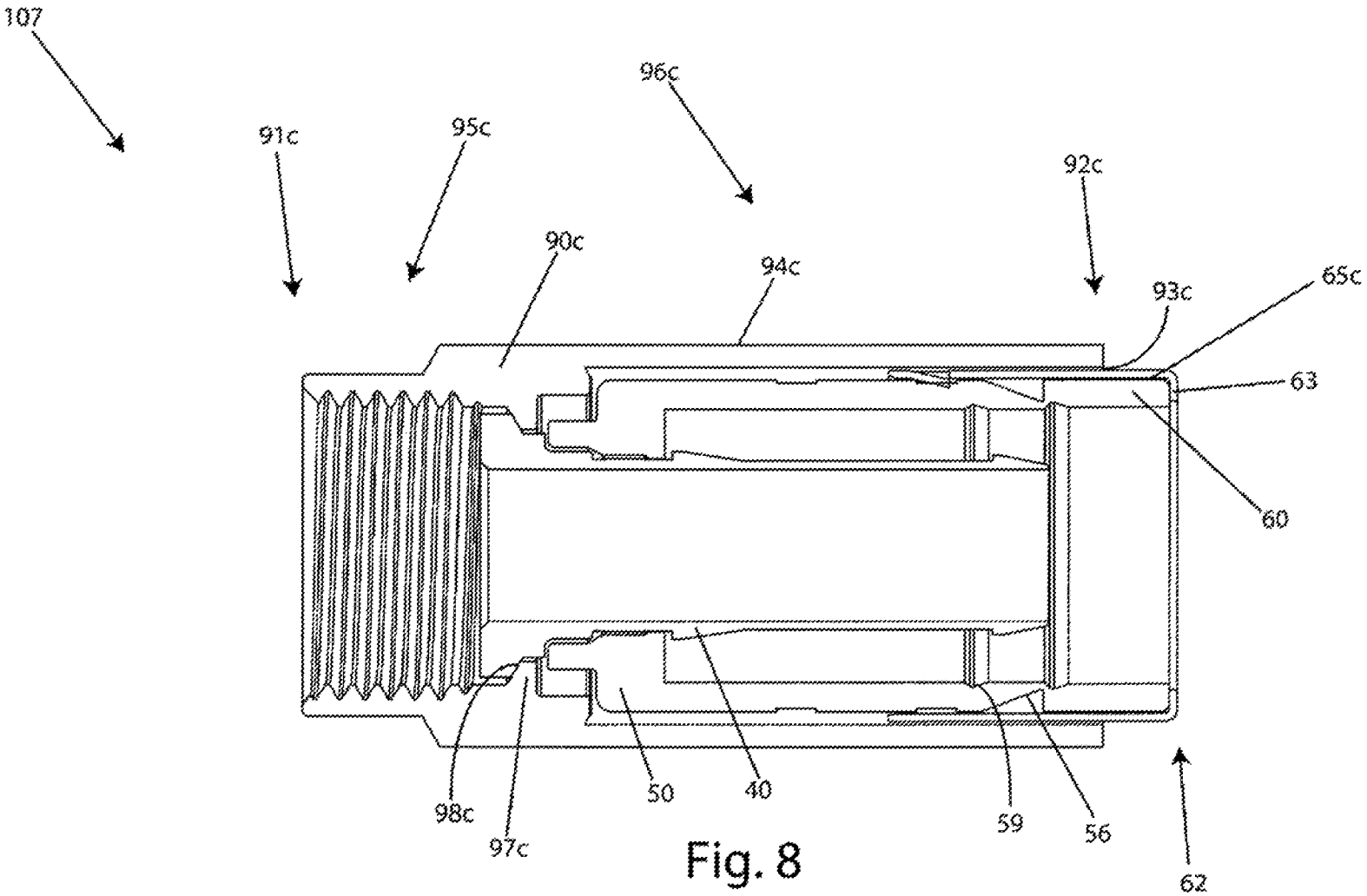
FIG. 8 depicts a cross-section view of an eighth embodiment of a coaxial cable connector including an embodiment of an outer integral sleeve, an embodiment of a compression portion, and an embodiment of a radial restriction member.

FIG. 8 depicts an embodiment of connector 107. Embodiments of connector 107 may include an integral sleeve 90*c*, a post 40, a connector body 50, a compression portion 60, and a radial restriction member 65*c*.

Figure 9:
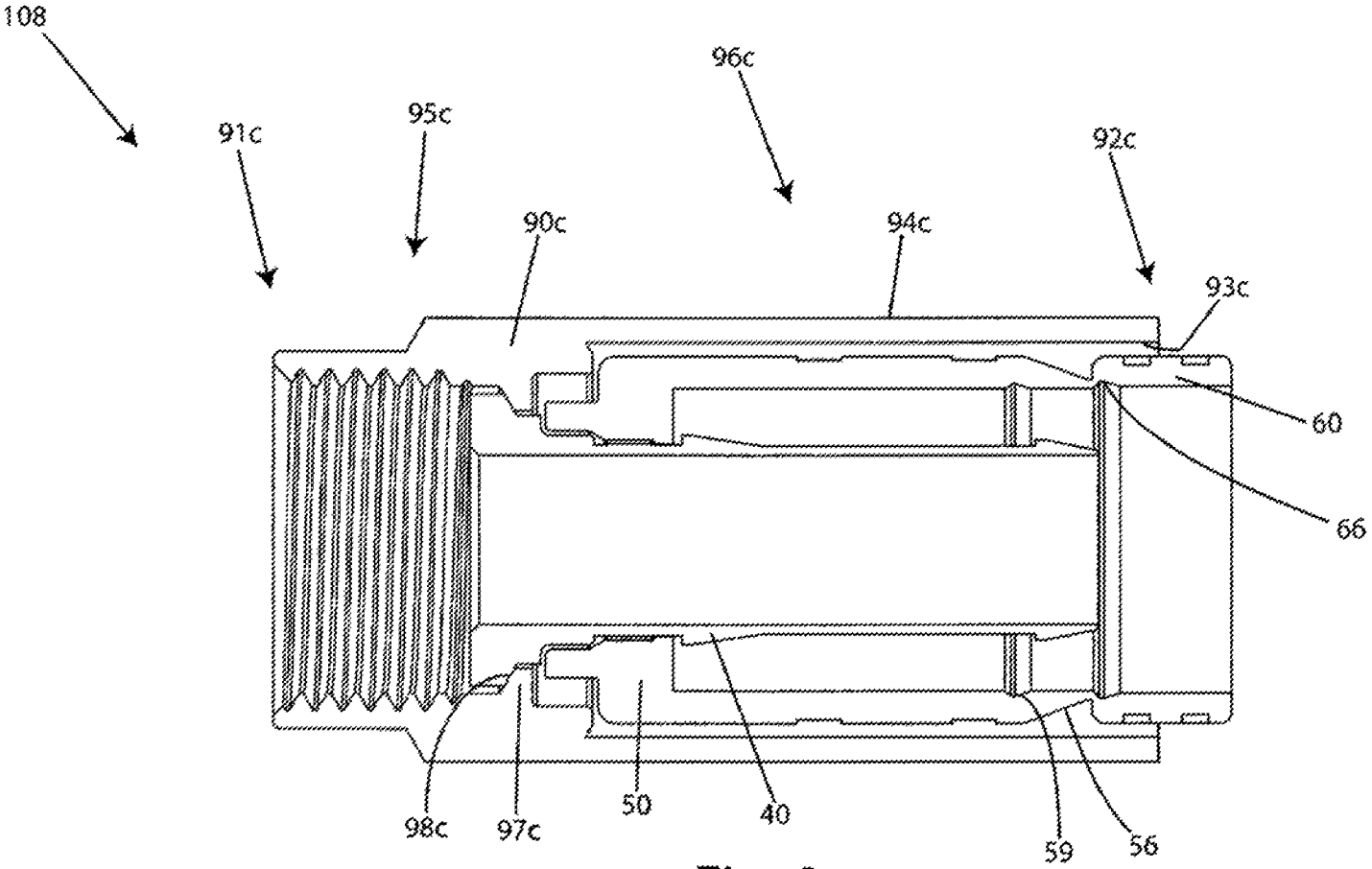
FIG. 9 depicts a cross-section view of a ninth embodiment of a coaxial cable connector including an embodiment of an outer integral sleeve, an embodiment of a compression portion, and an embodiment of a radial restriction member.

FIG. 9 depicts an embodiment of connector 108. Embodiments of connector 108 may include an integral sleeve 90*c*, a post 40, a connector body 50, a compression portion 60, and a radial restriction member 65*b*.

Figure 10:
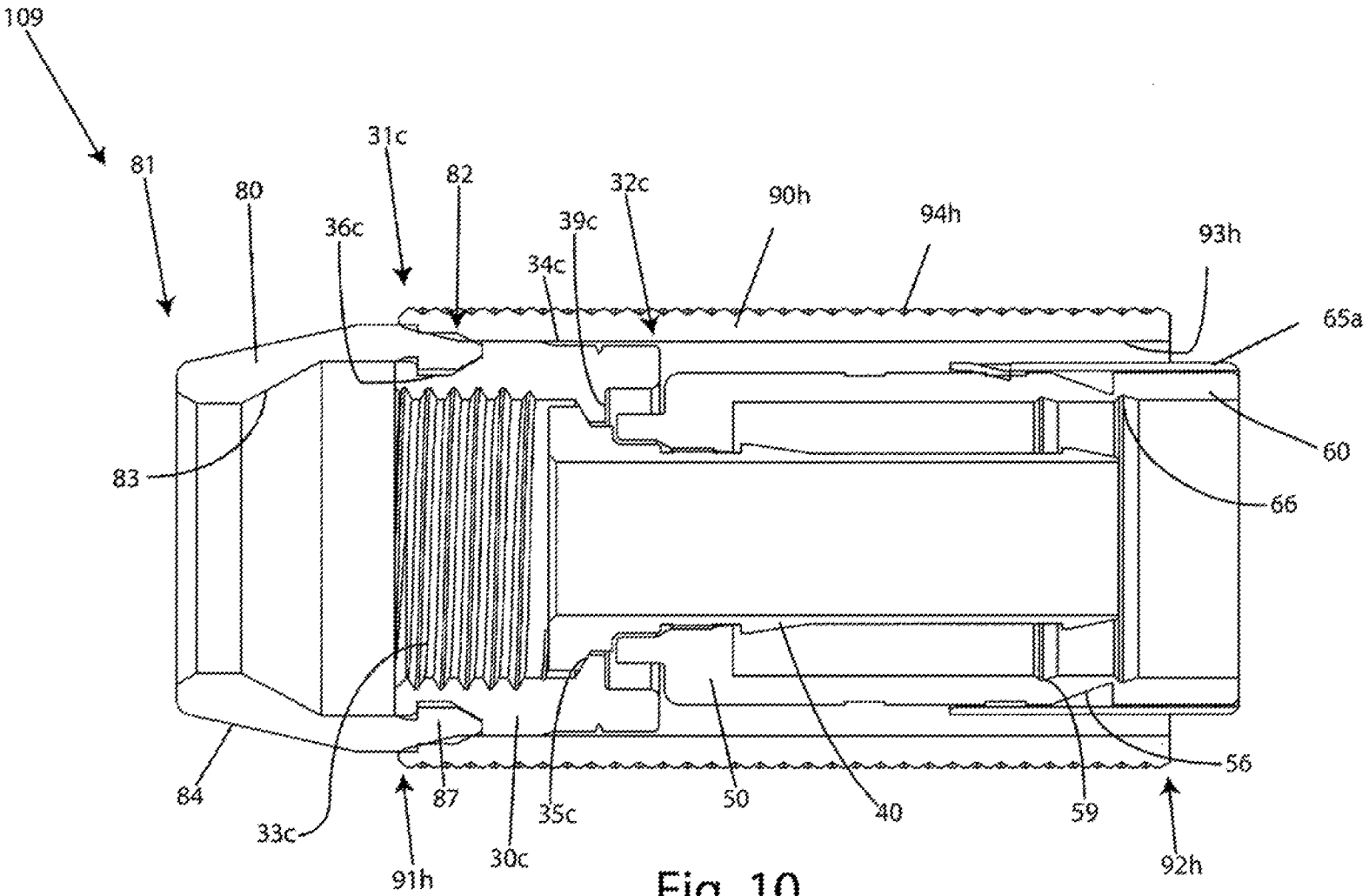
FIG. 10 depicts a cross-section view of a tenth embodiment of a coaxial cable connector including an embodiment of a sealing member, an embodiment of an outer sleeve, an embodiment of a compression portion, and an embodiment of a radial restriction member.

With reference now to FIG. 10, embodiments of connector 109 may include a coupling member 30*c*, a post 40, a connector body 50, a sleeve 90*h*, a sealing member 80, a compression portion 60, and a radial restriction member 65*a*.

Embodiments of connector 109 may include a coupling member 30*c*. Coupling member 30*c* may share some of the structural and functional aspects of embodiments of coupling member 30*a*, 30*b*, such as being mated, threaded or otherwise, to a corresponding interface port 20. Coupling member 30*c* may include a first end 31*c*, a second end 32*c*, an inner surface 33*c*, at least a portion of which is threaded, a connector-grasping portion 39*c*, and an outer surface 34*c*, including a seal-grasping surface portion 36*c*. The seal-grasping surface portion 36*c* may be a flat, smooth surface or a flat, roughened surface suitable to frictionally and/or adhesively engage an interior sealing surface 83 of the sealing member 80. Embodiments of the seal-grasping surface portion 36*c* may also contain a ridge that together with the seal grasping surface portion 36*c* forms a groove or shoulder that is suitably sized and shaped to correspondingly engage an internal shoulder 87 of the sealing member 80 adjacent the interior sealing surface 83 in a locking-type interference fit between the coupling member 30*c* and the sealing member 80.

Moreover, the coupling member 30*c* may further include a coupling member-turning surface portion on an outer surface 84 of the sealing member 80. The coupling member-turning surface portion may have at least two flat surface regions that allow engagement with the surfaces of a tool such as a wrench. In one embodiment, the coupling member-turning surface is hexagonal. Alternatively, the coupling member-turning surface may be a knurled surface to facilitate hand-turning of the nut component. Furthermore, upon engagement of the sealing member 80 with the coupling member 30*c*, a rear sealing surface of the sealing member 80 abuts a side/edge surface of the coupling member 30*c* to form a sealing relationship in that region. In one embodiment, the connector-grasping portion 36*c* of the coupling member 30*c* is an internally-projecting shoulder that engages a flange 44 of the post 40 in such a manner that the coupling member 30*c* can be freely rotated as it is held in place as part of the connector.

With continued reference to FIG. 10, connector 109 may include a sealing member 80. The sealing member may include a first end 81, a second end 82, an inner surface 83, and an outer surface 84. The sealing member 80 may have a generally tubular body that is elastically deformable by nature of its material characteristics and design. In most embodiments, the seal member 80 is a one-piece element made of a compression molded, elastomer material having suitable chemical resistance and material stability (i.e., elasticity) over a temperature range between about −40° C. to +40° C. For example, the sealing member 80 may be made of silicone rubber. Alternatively, the material may be propylene, a typical O-ring material. Other materials known in the art may also be suitable. Furthermore, the first end 81 of sealing member 80 may be a free end for ultimate engagement with a port, while the second end 82 may be for ultimate connection to the coupling member 30*c*. The sealing member 80 may have a forward sealing surface, a rear sealing portion including an interior sealing surface 83 that integrally engages the coupling member 30*c*, and an integral joint-section intermediate the first and second end 81, 82 of the tubular body of the sealing member 80. The forward sealing surface 85 at the first end 81 of the sealing member 80 may include annular facets to assist in forming a seal with the port, such as interface port 20. Alternatively, forward sealing surface 85 may be a continuous rounded annular surface that forms effective seals through the elastic deformation of the inner surface 83 and end of the sealing member 80 compressed against the port. The integral joint-section includes a portion of the length of the sealing member 80 which is relatively thinner in radial cross-section to encourage an outward expansion or bowing of the seal upon its axial compression. In an exemplary embodiment, the coupling member grasping surface includes an interior sealing surface which forms an annular surface on the inside of the tubular body, and an internal shoulder 87 of the tubular body adjacent the second end 82. Accordingly, compressive axial force may be applied against one or both ends of the seal depending upon the length of the port intended to be sealed. The force will act to axially compress the seal whereupon it will expand radially in the vicinity of the integral joint-section. In one embodiment, the integral joint-section is located axially asymmetrically intermediate the first end 81 and the second end 82 of the tubular body, and adjacent an anterior end of the interior sealing surface 83. Embodiments of the sealing member 80 may have an interior diameter at the integral joint-section equal to about 0.44 inches in an uncompressed state; the tubular body of the sealing member 80 may have a length from the first end 81 to the second end 82 of about 0.36 inches in an uncompressed state. However, it is contemplated that the joint-section can be designed to be inserted anywhere between she sealing surface and the first end 81. The sealing member 80 may prevent the ingress of corrosive elements when the seal is used for its intended function.

Referring still to FIG. 10, embodiments of connector 109 may include an outer sleeve 90*h*. The outer sleeve 90*h* may be engageable with coupling member 30*c*. Sleeve 90 *h* may share the same or substantially the same structural and functional aspects of sleeve 90*a*, described supra, and sleeve 90*d*, 90*f*, described infra. Accordingly, the sleeve 90*h* may include a first end 91*h*, a second end 92*h*, an inner surface 93*h*, and an outer surface 94*h*. However, the sleeve 90*h* need not include an engagement member, such as an embodiment of engagement member 97*a*. The mechanical interference to effectuate simultaneous rotation/twisting of the sleeve 90*h* and the coupling member 30*c* between coupling member 30*c* and sleeve 90*h* may rely on a press-fit or interference fit between the components. Alternatively, the sleeve 90*h* may and coupling member 30*c* may include corresponding internal (sleeve 90*h*) and external (coupling member 30*c*) surface features to facilitate mechanical interference between the components. Internal and external surface features of sleeve 90*h* and coupling member 30*c* may share the structural and functional aspects as surface features 98*a* and 38*a*, as described in association with, for example, connector 100.

Figure 11:
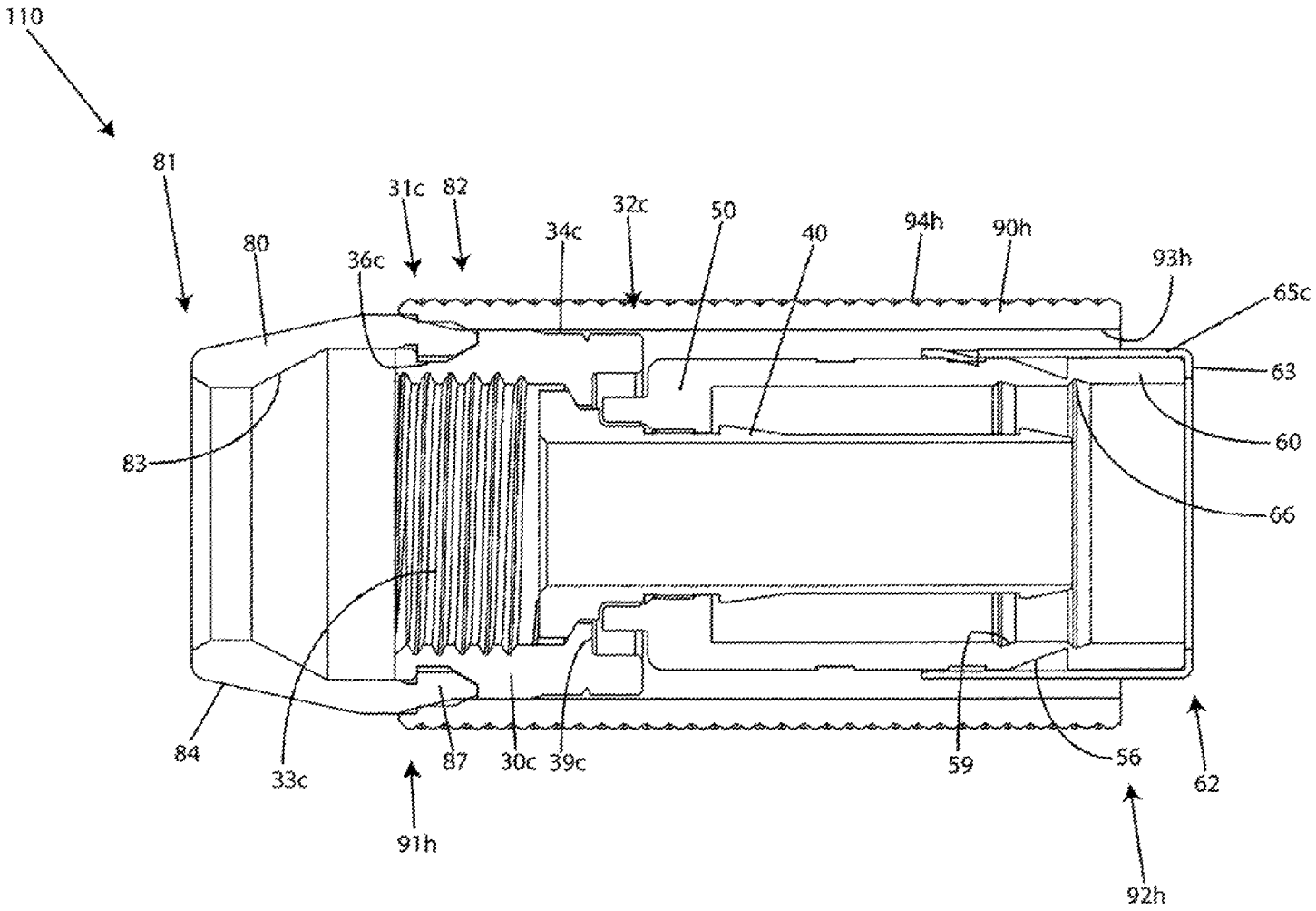
FIG. 11 depicts a cross-section view of an eleventh embodiment of a coaxial cable connector including an embodiment of a sealing member, an embodiment of an outer sleeve, an embodiment of a compression portion, and an embodiment of a radial restriction member.

FIG. 11 depicts an embodiment of connector 110. Embodiments of connector 110 may include a coupling member 30*c*, a post 40, a connector body 50, a sleeve 90*h*, a sealing member 80, a compression portion 60, and a radial restriction member 65*c*.

Figure 12:
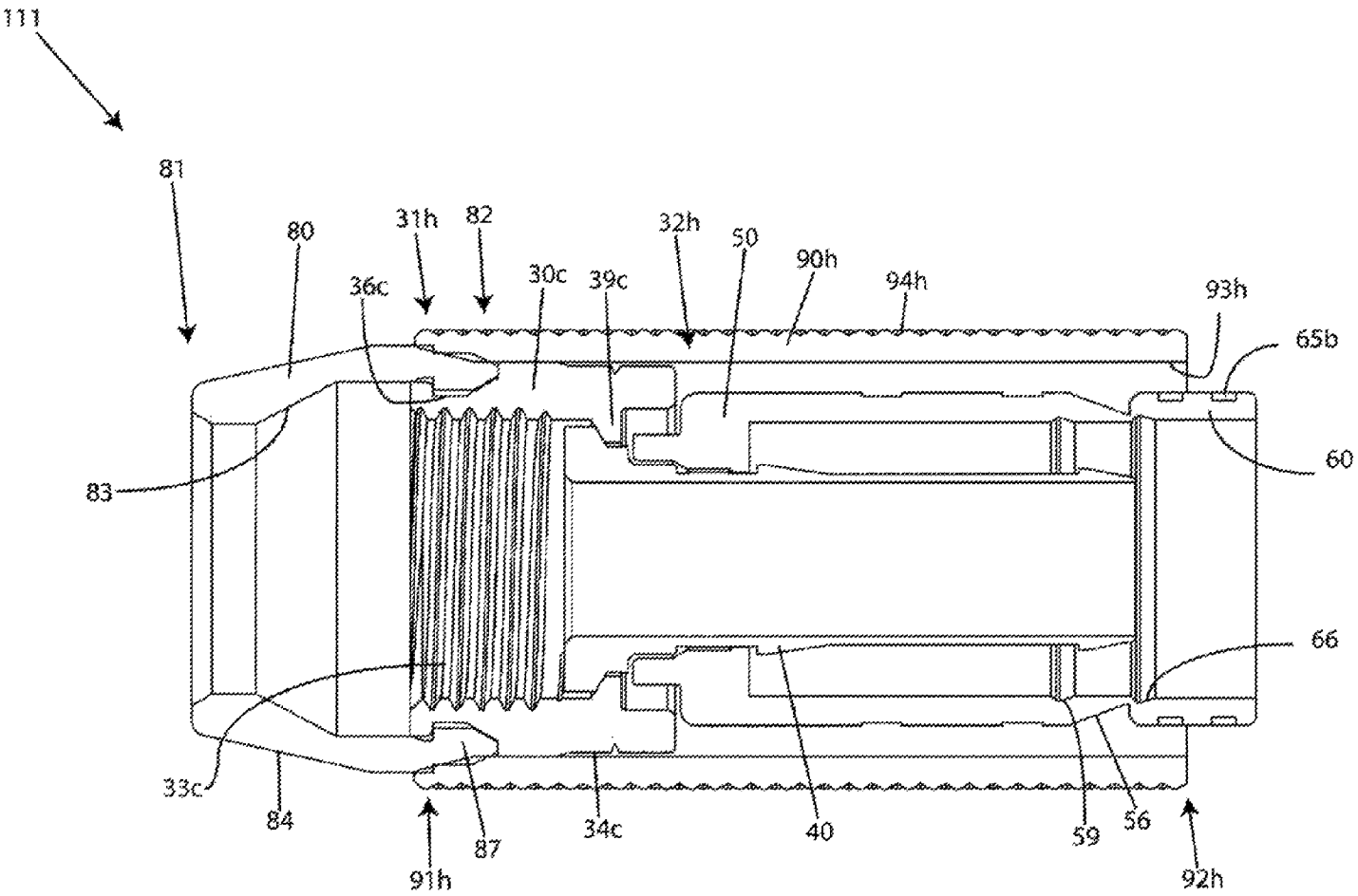
FIG. 12 depicts a cross-section view of a twelfth embodiment of a coaxial cable connector including an embodiment of an outer sleeve, an embodiment of a sealing member, an embodiment of a compression portion, and an embodiment of a radial restriction member.

FIG. 12 depicts an embodiment of connector 111. Embodiments of connector 111 may include a coupling member 30*c*, a post 40, a connector body 50, a sleeve 90*h*, a sealing member 80, a compression portion 60, and a radial restriction member 65*b*.

Figure 13:
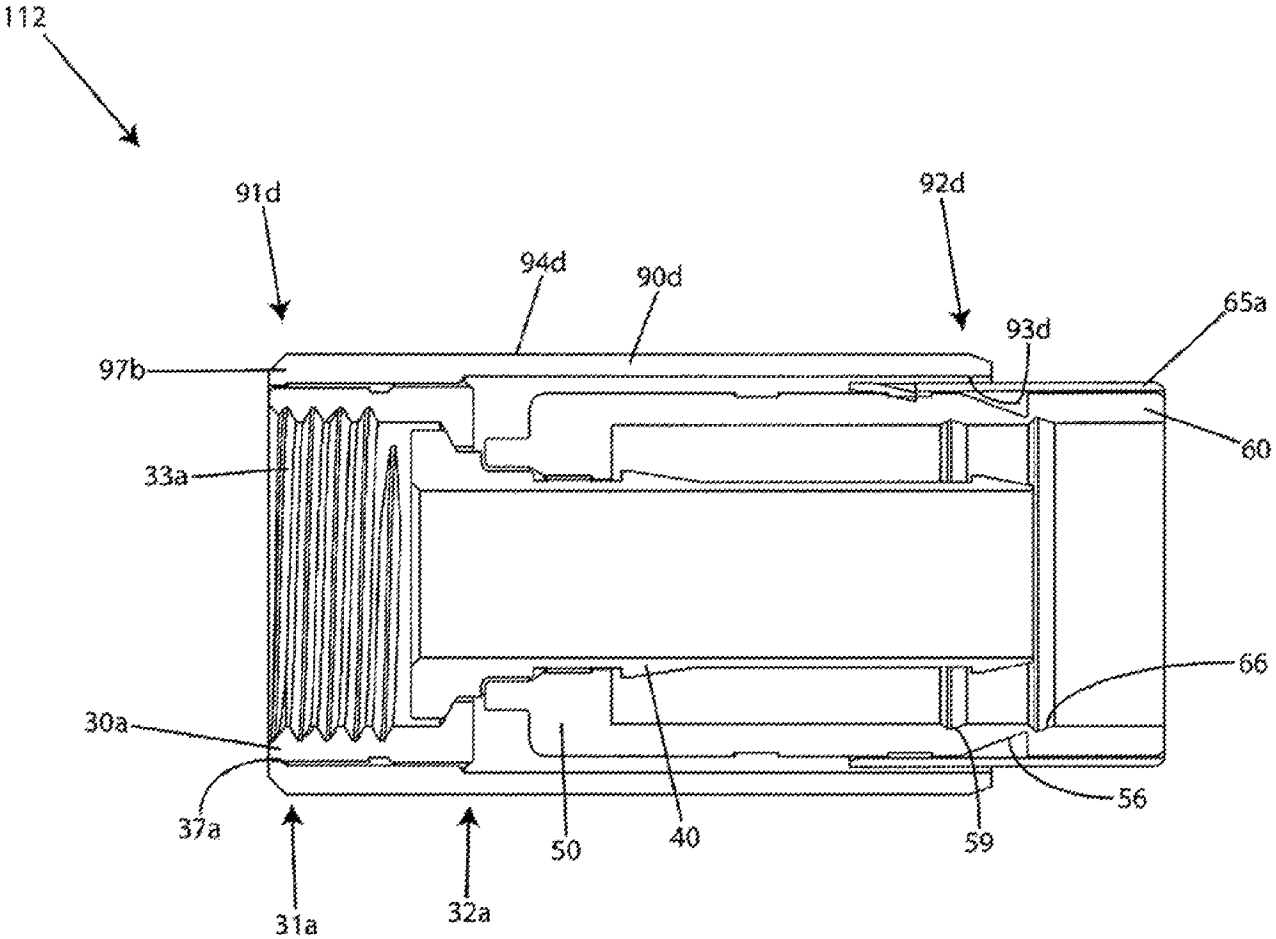
FIG. 13 depicts a cross-section view of a thirteenth embodiment of a coaxial cable connector including an embodiment of an outer sleeve, an embodiment of a compression portion, and an embodiment of a radial restriction member.

With continued reference to the drawings, FIG. 13 depicts an embodiment of connector 112. Embodiments of connector 112 may include a coupling member 30*a*, a post 40, a connector body 50, a sleeve 90*d*, a compression portion 60, and a radial restriction member 65*a*.

Embodiments of connector 112 may include a sleeve 90*d*. Sleeve 90*d* may be engageable with the coupling member 30*a*. Sleeve 90*d* may share the same or substantially the same structural and functional aspects of sleeve 90*a*. Accordingly, sleeve 90*d* may include an engagement member 97*d* that is configured to mate or engage with a retaining structure 37*a* of the coupling member 30*a*. Additionally, the sleeve 90*d* may include a first end 91*d*, a second end 92*d*, an inner surface 93*d*, and an outer surface 94*d*, and may be a generally annular member having a generally axial opening therethrough. Additionally, sleeve 90*d* may surround the coupling member 30*a*, the post 40, the connector body 50, or a portion thereof, the compression portion 60, and a radial restriction member 65, or a portion thereof when in an assembled and/or compressed position. However, the sleeve 90*d* may extend towards the first end 31*a* of coupling member 30*a*. In one embodiment, the first end 91*d* of the sleeve 90*d* may be flush or substantially flush with an edge of the coupling member 30*a* proximate or otherwise near the first end 31*a* of the coupling member 30*a*. Moreover, the engagement member 97*d* may be located proximate or otherwise near the edge of the first end 91*d* of the sleeve 90*d*. The engagement member 97*d* may be configured to mate or engage a retaining structure 37*a* of the coupling member 30*a* that is correspondingly located proximate or otherwise near the first end 31*a* of the coupling member 30*a*.

Figure 14:
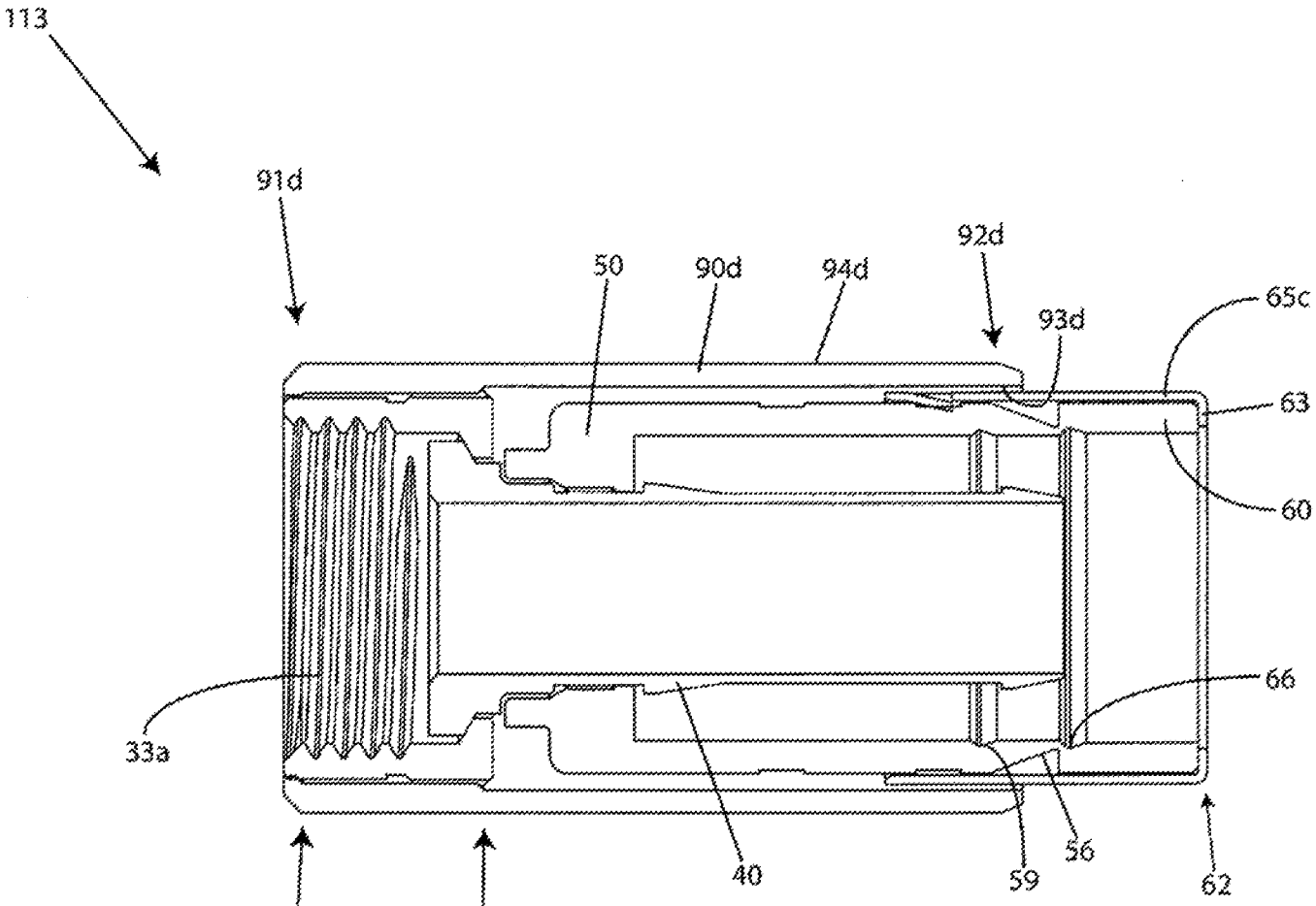
FIG. 14 depicts a cross-section view of a fourteenth embodiment of a coaxial cable connector including an embodiment of an outer sleeve, an embodiment of a compression portion, and an embodiment of a radial restriction member.

FIG. 14 depicts an embodiment of connector 113. Embodiments of connector 113 may include a coupling member 30*a*, a post 40, a connector body 50, an outer sleeve 90*d*, a compression portion 60, and a radial restriction member 65*c*.

Figure 15:
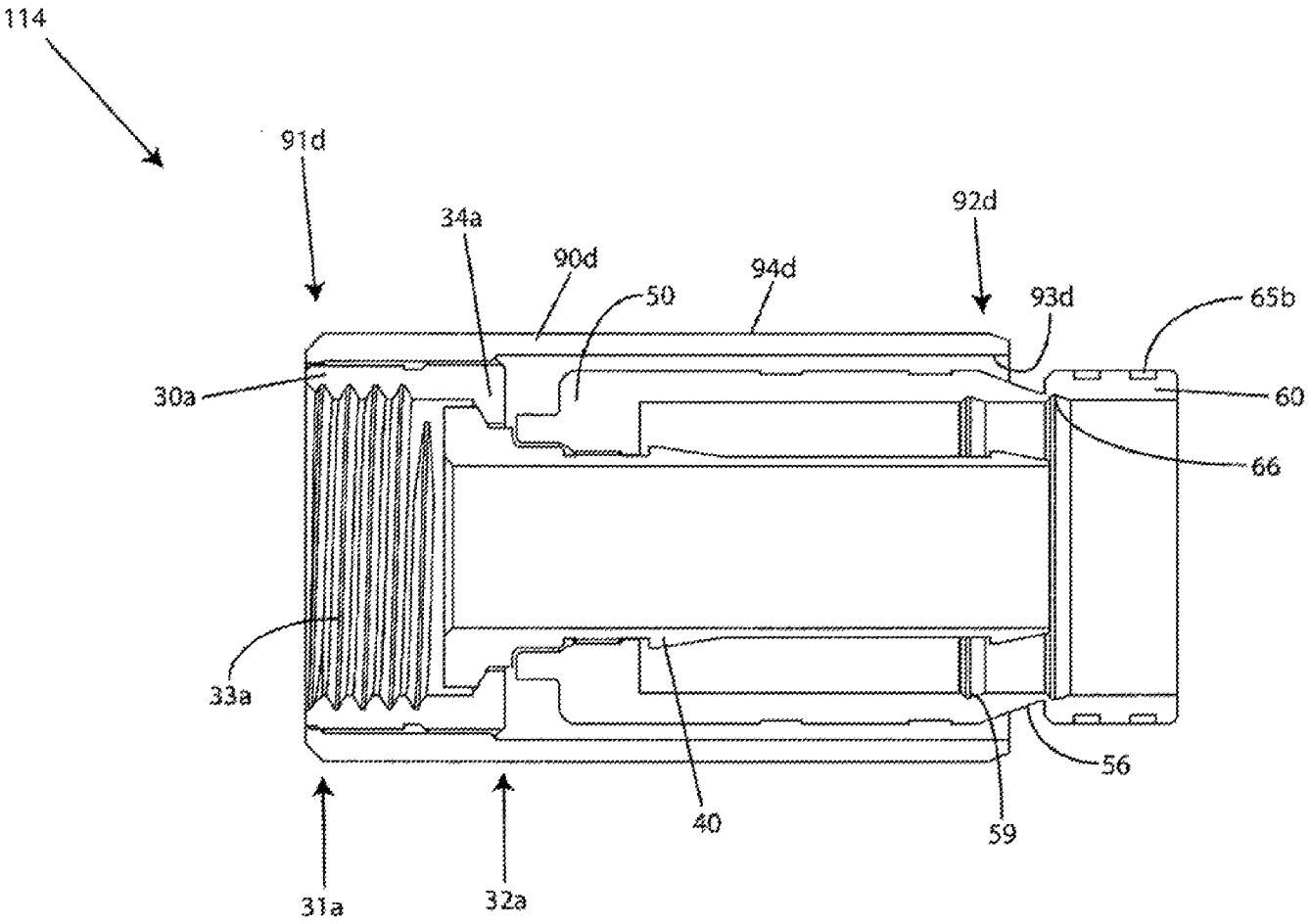
FIG. 15 depicts a cross-section view of a fifteenth embodiment of a coaxial cable connector including an embodiment of an outer sleeve, an embodiment of a compression portion, and an embodiment of a radial restriction member.

FIG. 15 depicts an embodiment of connector 114. Embodiments of connector 114 may include a coupling member 30*a*, a post 40, a connector body 50, an outer sleeve 90*d*, a compression portion 60, and a radial restriction member 65*b*.

Figure 16:
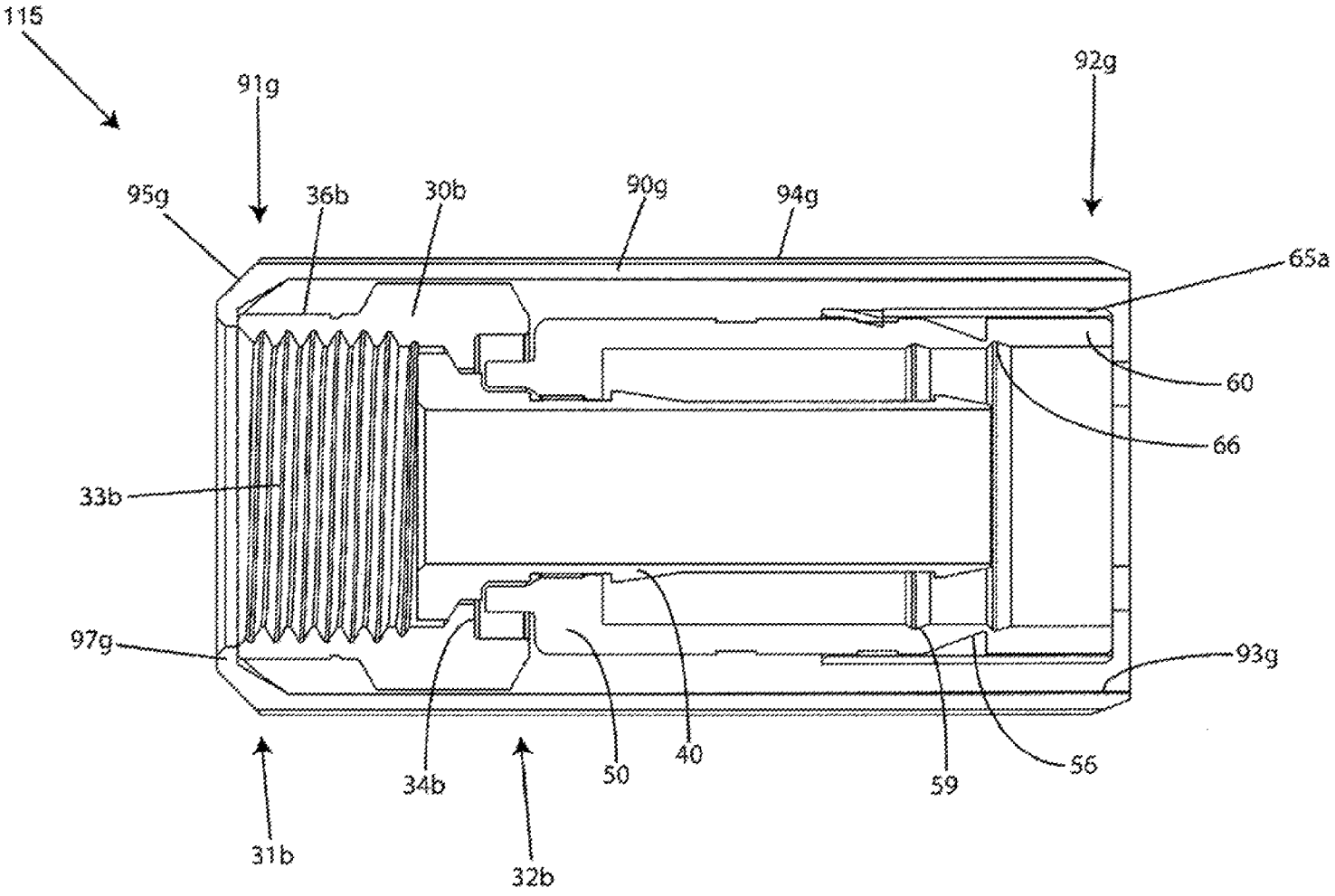
FIG. 16 depicts a cross-section view of a sixteenth embodiment of a coaxial cable connector including an embodiment of an outer sleeve, an embodiment of a compression portion, and an embodiment of a radial restriction member.

Referring now to FIG. 16, embodiments of connector 115 may include a coupling member 30*b*, a post 40, a connector body 50, an outer sleeve 90*g*, a compression portion 60, and a radial restriction member 65*a*.

Embodiments of connector 115 may include an outer sleeve 90*g*. Sleeve 90*g* may be engageable with the coupling member 30*b*. Sleeve 90*g* may share the same or substantially the same function as sleeve 90*b* and sleeve 90*f* described infra. Accordingly, the sleeve 90*g* may include a first end 91*g*, a second end 92*g*, an inner surface 93*g*, and an outer surface 94*g*, and may be a generally annular member having a generally axial opening therethrough. Sleeve 90*g* may surround the coupling member 30*b*, the post 40, the connector body 50, or a portion thereof, the compression portion 60, and a radial restriction member 65, or a portion thereof, when in an assembled and/or compressed position. Moreover, the sleeve 90*g* may extend towards the first end 31*b* of coupling member 30*b*. However, sleeve 90*g* may include an inwardly extending lip 97*g* proximate or otherwise near the first end 91*g* of the sleeve 90*g*, which can help guide the coupling member 30*b* onto a corresponding interface port. The lip 97*g* may share the same structural and functional aspects of the engagement member 97*b*. For instance, the lip 97*g* may radially inwardly extend a distance sufficient to prevent axial movement of the sleeve 90*g* in a direction towards the second end 32*b* of the coupling member 30*b* when operably assembled and/or in a compressed position. An embodiment of an assembled configuration of connector 115 with respect to the sleeve 90*g* may involve sliding the sleeve 90*g* over the coupling member 30*b* in an axial direction starting from the first end 31*b* and continuing toward the second end 32*b* of the coupling member 30*b* until sufficient mechanical interference and/or engagement occurs between the lip 97*g* of the sleeve 90*g* and frontal edge or mating surface of the coupling member 30*b*. The simultaneous rotation/twisting of the sleeve 90*g* and the coupling member 30*b* may be effectuated in the same or similar manner as described between the sleeve 90*b* and the coupling member 30*b*.

Figure 17:
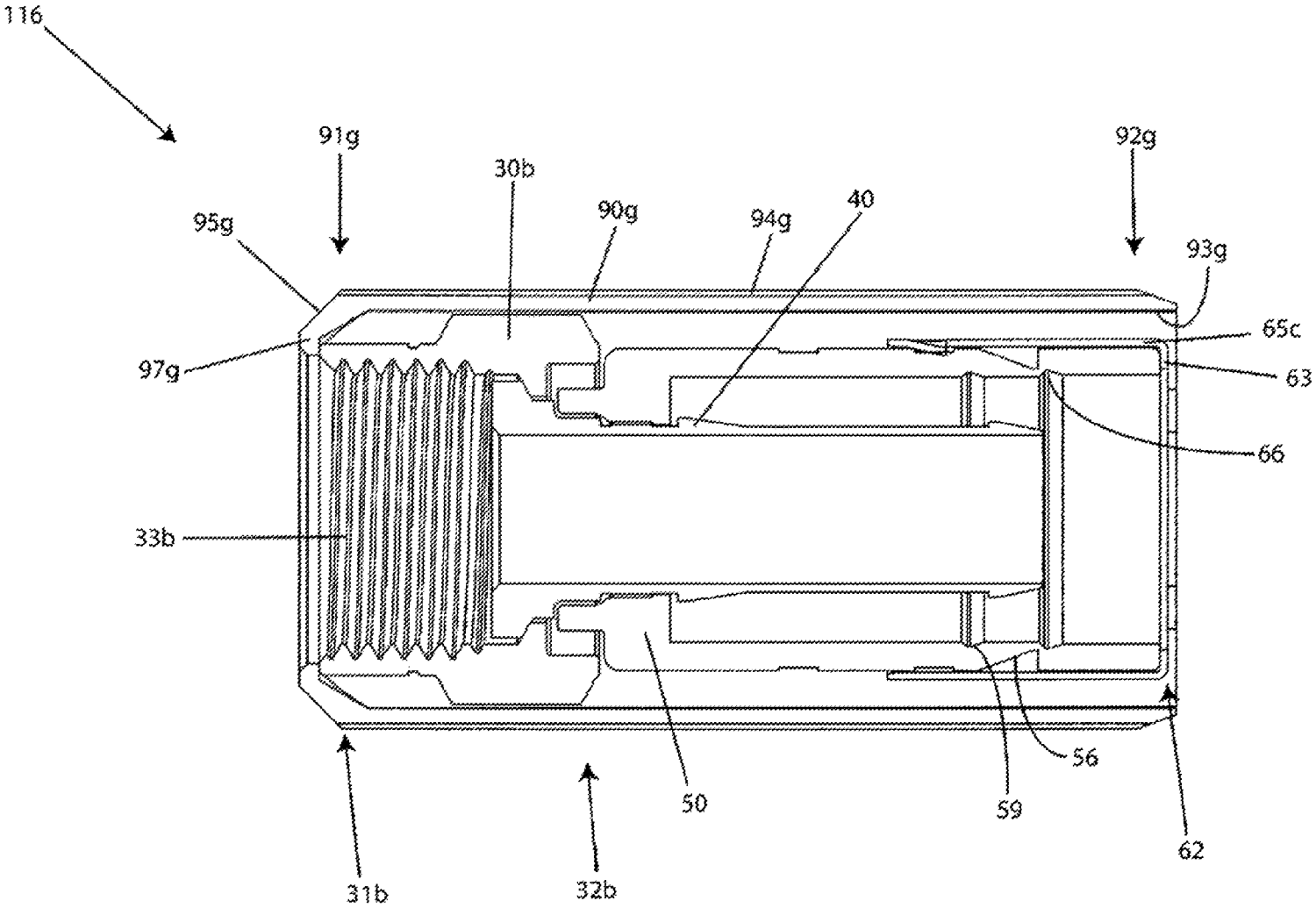
FIG. 17 depicts a cross-section view of a seventeenth embodiment of a coaxial cable connector including an embodiment of an outer sleeve, an embodiment of a compression portion, and an embodiment of a radial restriction member.

FIG. 17 depicts an embodiment of connector 116. Embodiments of connector 116 may include a coupling member 30*b*, a post 40, a connector body 50, an outer sleeve 90*g*, a compression portion 60, and a radial restriction member 65*c*.

Figure 18:
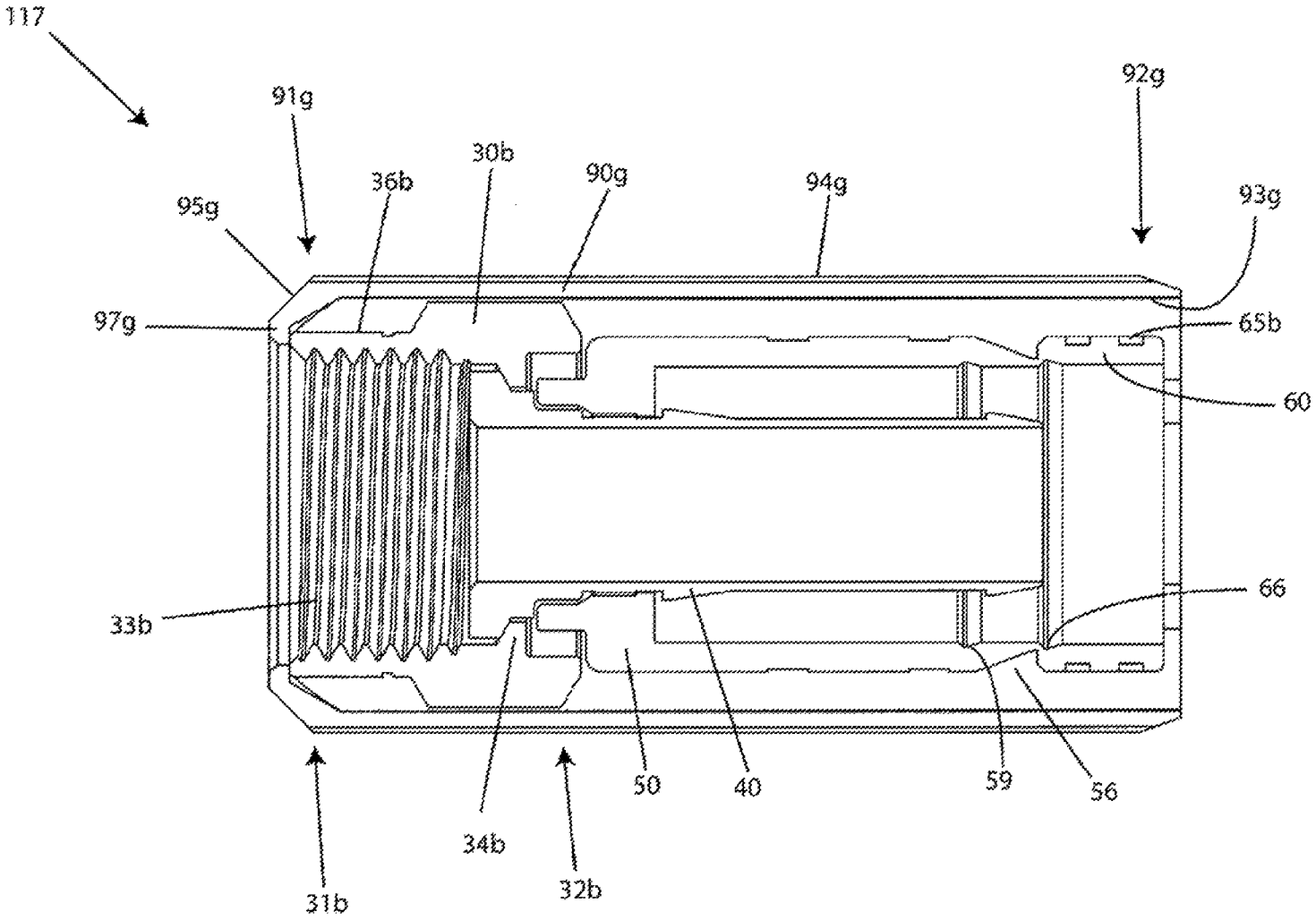
FIG. 18 depicts a cross-section view of an eighteenth embodiment of a coaxial cable connector including an embodiment of an outer sleeve, an embodiment of a compression portion, and an embodiment of a radial restriction member.

FIG. 18 depicts an embodiment of connector 117. Embodiments of connector 117 may include a coupling member 30*b*, a post 40, a connector body 50, an outer sleeve 90*g*, a compression portion 60, and a radial restriction member 65*b*.

Figure 19:
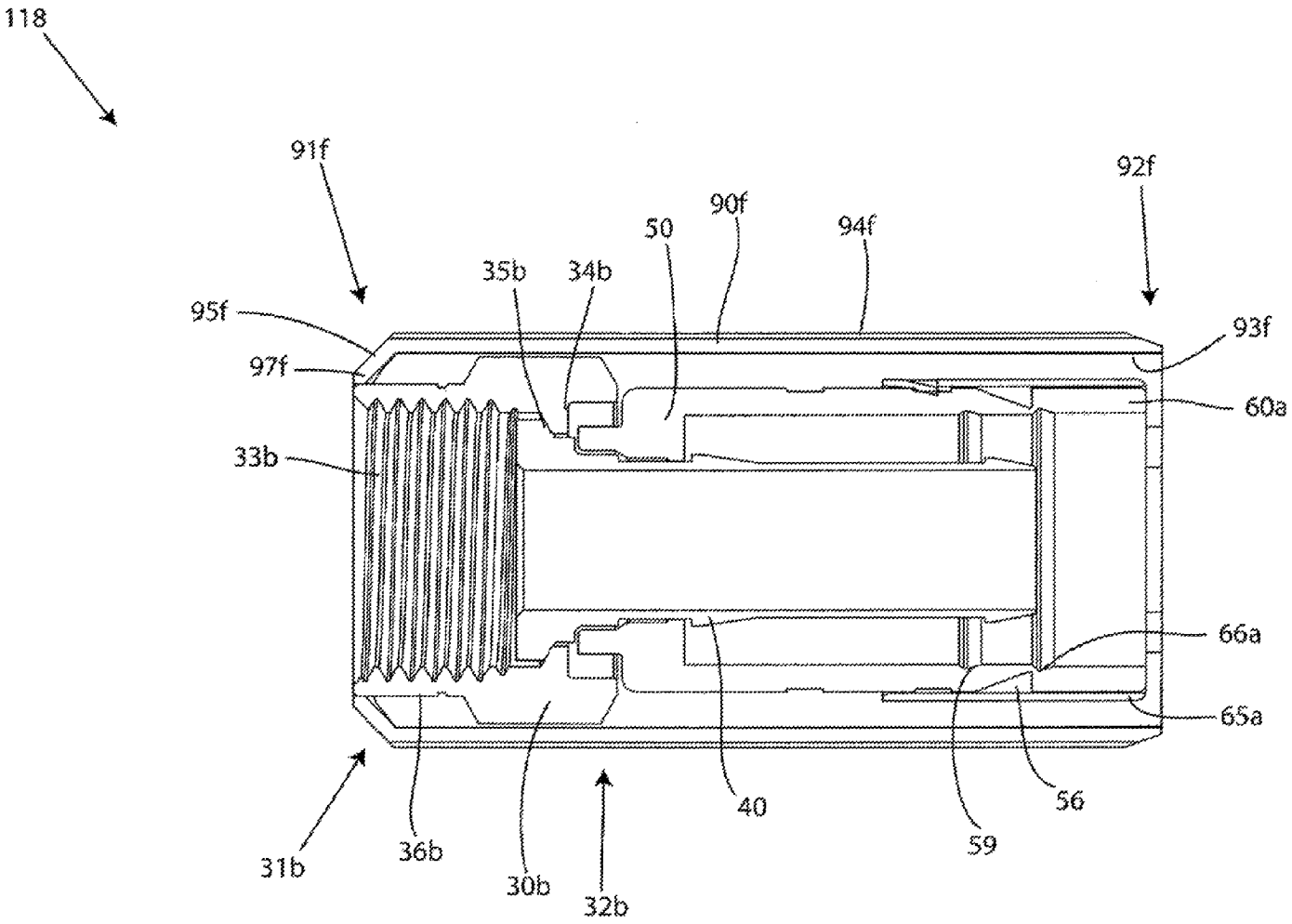
FIG. 19 depicts a cross-section view of a nineteenth embodiment of a coaxial cable connector including an embodiment of an outer sleeve, an embodiment of a compression portion, and an embodiment of a radial restriction member.

With reference now to FIG. 19, embodiments of connector 118 may include a coupling member 30*b*, a post 40, a connector body 50, an outer sleeve 90*f*, a compression portion 60, and a radial restriction member 65*a*.

Embodiments of connector 118 may include an outer sleeve 90*f*. Sleeve 90*f* may share the same or substantially the same structural and functional aspects of sleeve 90*b*. Accordingly, sleeve 90*f* may include an engagement member 97*f* that is configured to mate or engage with a retaining structure 37*b* of the coupling member 30*b*. For example, the sleeve 90*f* may include a first end 91*f*, a second end 92*f*, an inner surface 93*f*, and an outer surface 94*f*, and may be a generally annular member having a generally axial opening therethrough. Additionally, sleeve 90*f* may surround the coupling member 30*b*, the post 40, the connector body 50, or a portion thereof, the compression portion 60, and a radial restriction member 65, or a portion thereof when in an assembled and/or compressed position. However, the sleeve 90*f* may extend towards the first end 31*b* of coupling member 30*b*. In one embodiment, the first end 91*f* of the sleeve 90*f* may be flush or substantially flush with an edge of the coupling member 30*b* proximate or otherwise near the first end 31*b* of the coupling member 30*b*. Moreover, the engagement member 97*f* may be located proximate or otherwise near the edge of the first end 91*f* of the sleeve 90*f*. The engagement member 97*f* may be configured to mate or engage a retaining structure 37*b* of the coupling member 30*b* that is correspondingly located proximate or otherwise near the first end 31*b* of the coupling member 30*b*.

Figure 20:
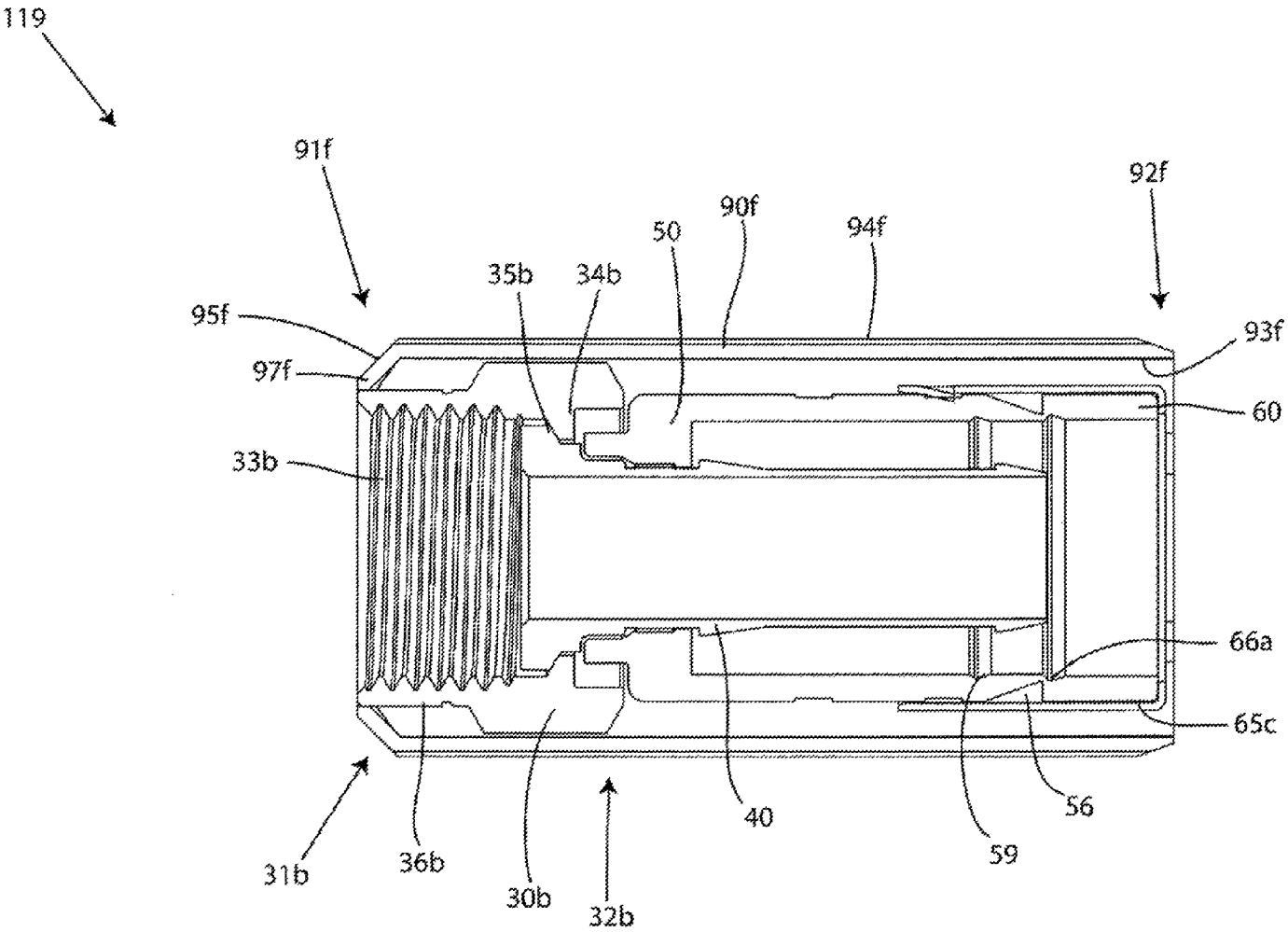
FIG. 20 depicts a cross-section view of a twentieth embodiment of a coaxial cable connector including an embodiment of an outer sleeve, an embodiment of a compression portion, and an embodiment of a radial restriction member.

FIG. 20 depicts an embodiment of connector 119. Embodiments of connector 119 may include a coupling member 30*b*, a post 40, a connector body 50, an outer sleeve 90*f*, a compression portion 60, and a radial restriction member 65*c*.

Figure 21:
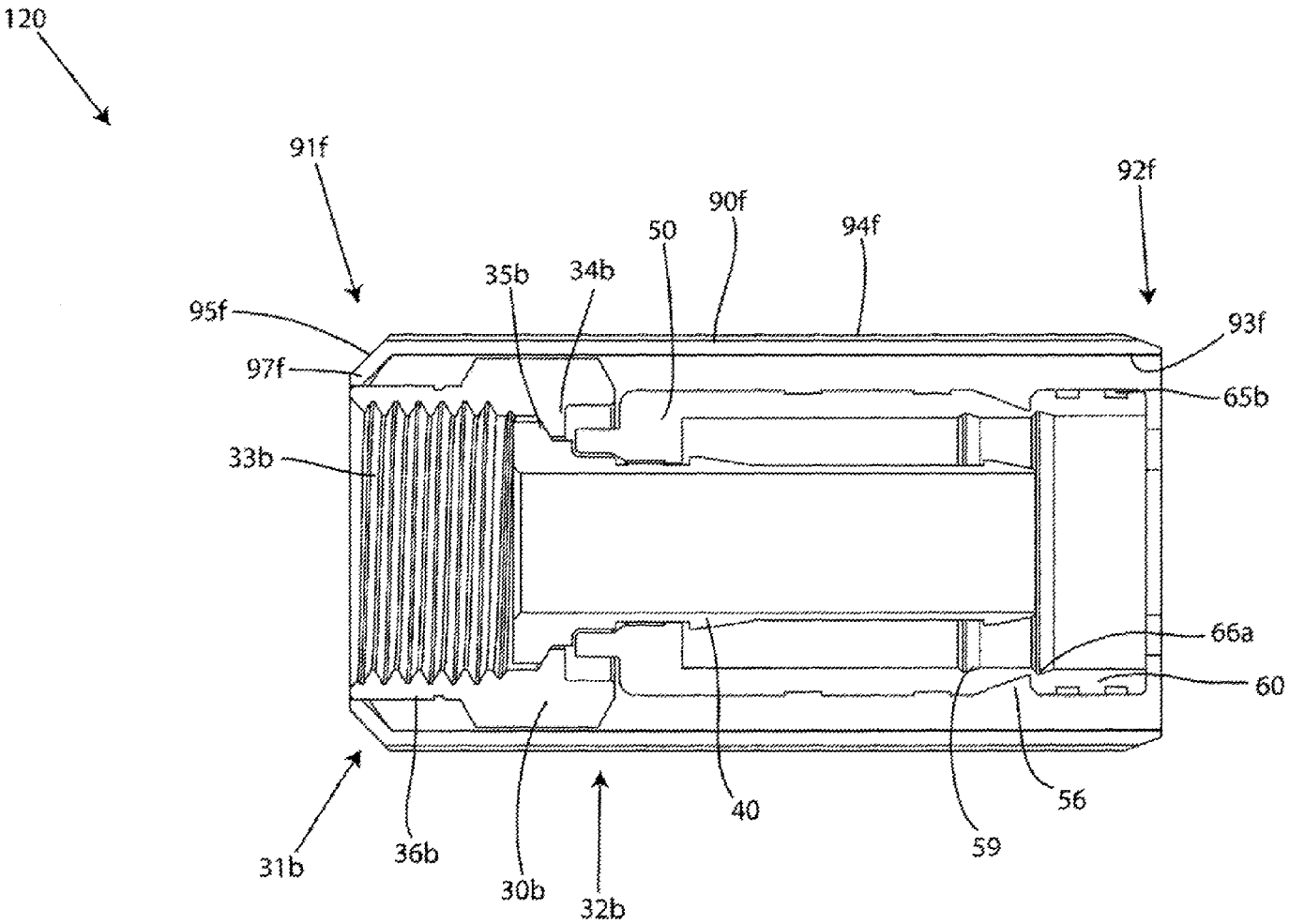
FIG. 21 depicts a cross-section view of a twenty-first embodiment of a coaxial cable connector including an embodiment of an outer sleeve, an embodiment of a compression portion, and an embodiment of a radial restriction member.

FIG. 21 depicts an embodiment of connector 120. Embodiments of connector 120 may include a coupling member 30*b*, a post 40, a connector body 50, an outer sleeve 90*f*, a compression portion 60, and a radial restriction member 65*b*.

Figure 22:
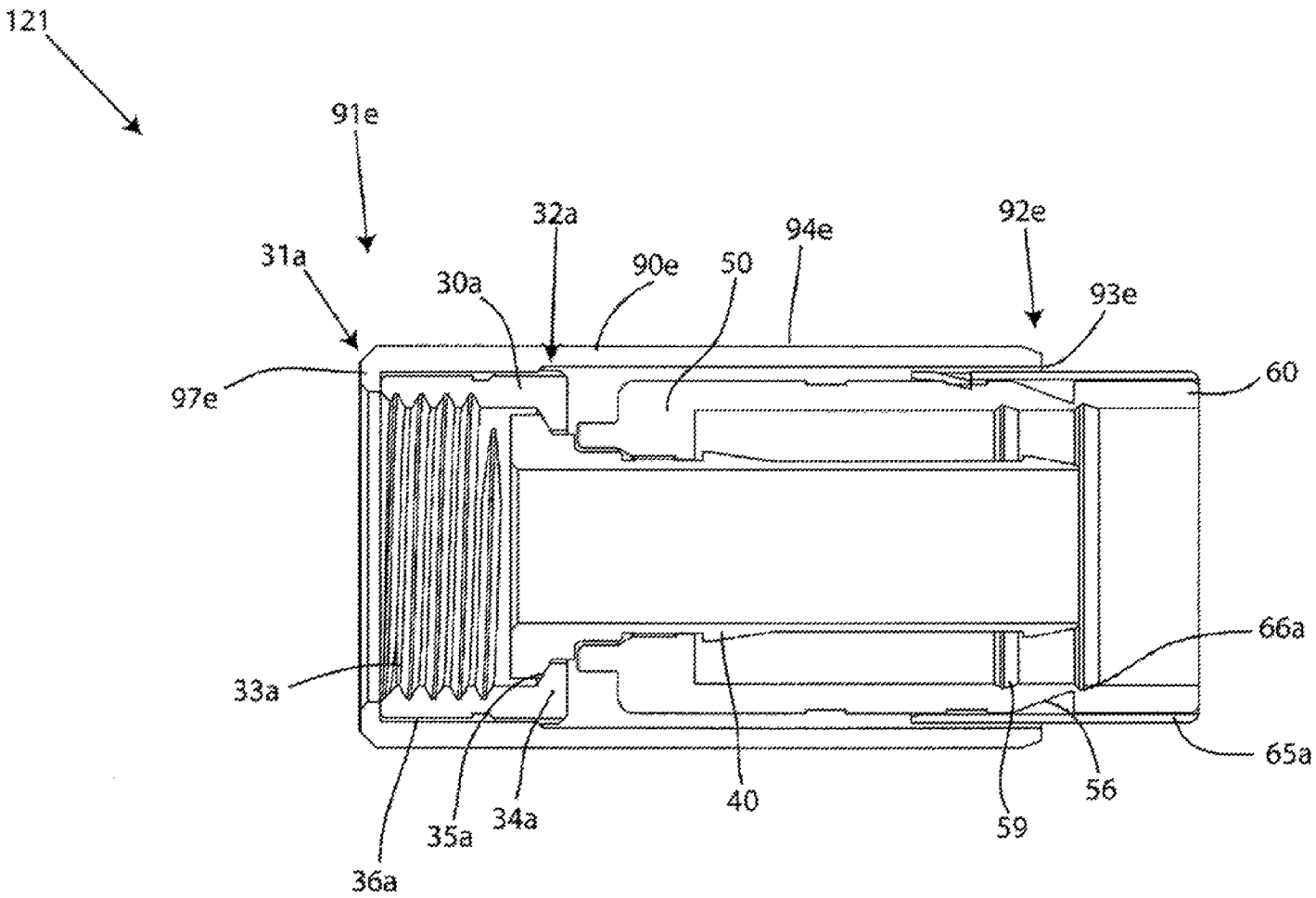
FIG. 22 depicts a cross-section view of a twenty-second embodiment of a coaxial cable connector including an embodiment of an outer sleeve, an embodiment of an outer sleeve, an embodiment of a compression portion, and an embodiment of a radial restriction member.

Referring now to FIG. 22, embodiments of connector 121 may include a coupling member 30*a*, a post 40, a connector body 50, an outer sleeve 90*e*, a compression portion 60, and a radial restriction member 65*a*.

Embodiments of connector 121 may include an outer sleeve 90*e*. Sleeve 90*e* may share the same or substantially the same function as sleeve 90*a* and sleeve 90*d*. Accordingly, the sleeve 90*e* may include a first end 91*e*, a second end 92*e*, an inner surface 93*e*, and an outer surface 94*e*, and may be a generally annular member having a generally axial opening therethrough. Sleeve 90*e* may surround the coupling member 30*a*, the post 40, the connector body 50, or a portion thereof, the compression portion 60, and a radial restriction member 65, or a portion thereof when in an assembled and/or compressed position. Moreover, the sleeve 90*e* may extend towards the first end 31*a* of coupling member 30*a*. However, sleeve 90*e* may include an inwardly extending lip 97*e* proximate or otherwise near the first end 91*e* of the sleeve 90*e*, which can help guide the coupling member 30*a* onto a corresponding interface port. The lip 97*e* may share the same functional aspects of the engagement member 97*a*, 97*d* of sleeve 90*a*, 90*d*, respectively. For instance, the lip 97*e* may radially inwardly extend a distance sufficient to prevent axial movement of the sleeve 90*e* in a direction towards the second end 32*a* of the coupling member 30*a* when operably assembled and/or in a compressed position. An embodiment of an assembled configuration of connector 121 with respect to the sleeve 90*e* may involve sliding the sleeve 90*e* over the coupling member 30*a* in an axial direction starting from the first end 31*a* and continuing toward the second end 32*a* of the coupling member 30*a* until sufficient mechanical interference and/or engagement occurs between the lip 97*e* of the sleeve 90*e* and frontal edge or mating surface of the coupling member 30*a*. The simultaneous rotation/twisting of the sleeve 90*e* and the coupling member 30*a* may be effectuated in the same or similar manner as described between the sleeve 90*a* and the coupling member 30*a*.

Figure 23:
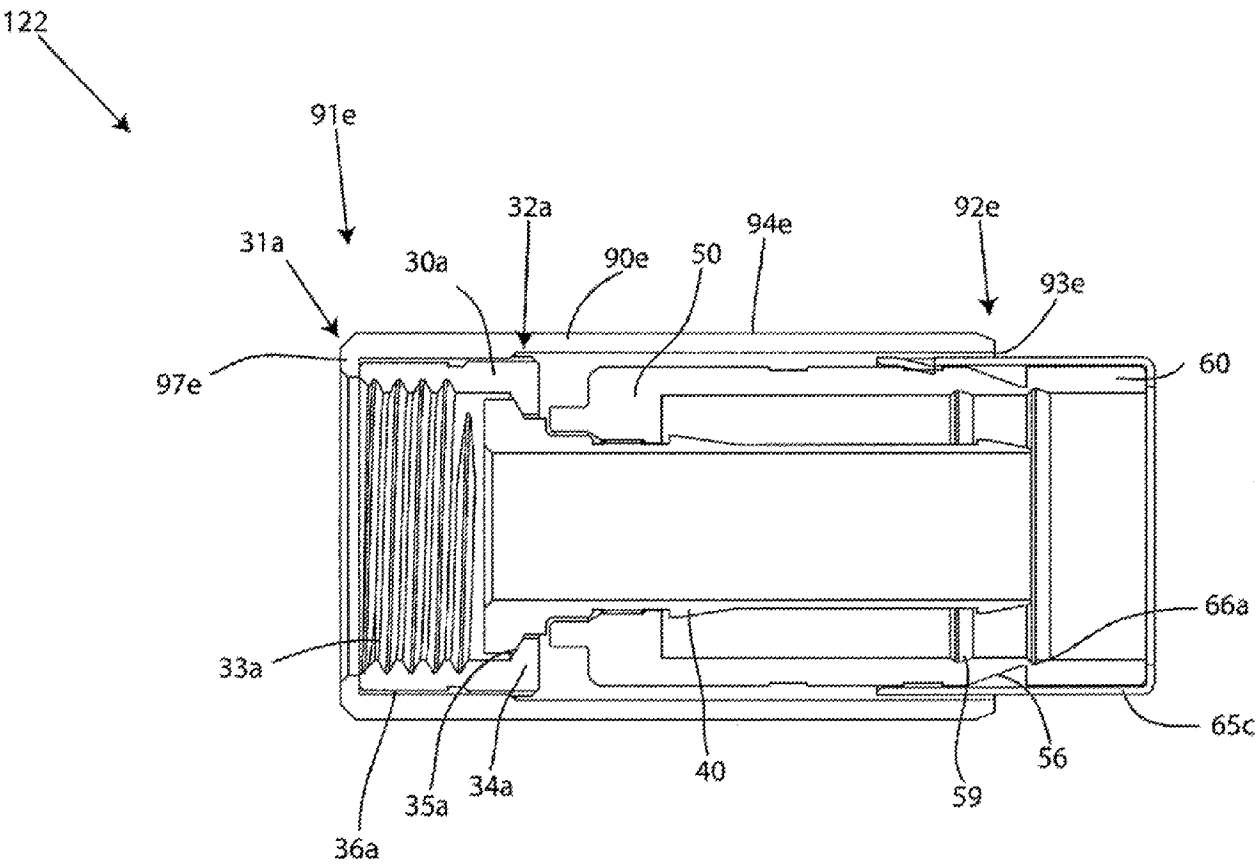
FIG. 23 depicts a cross-section view of a twenty-third embodiment of a coaxial cable connector including an embodiment of an outer sleeve, an embodiment of an outer sleeve, and an embodiment of a compression portion, and an embodiment of a radial restriction member.

FIG. 23 depicts an embodiment of connector 122. Embodiments of connector 122 may include a coupling member 30*b*, a post 40, a connector body 50, an outer sleeve 90*e*, a compression portion 60, and a radial restriction member 65*c*.

Figure 24:
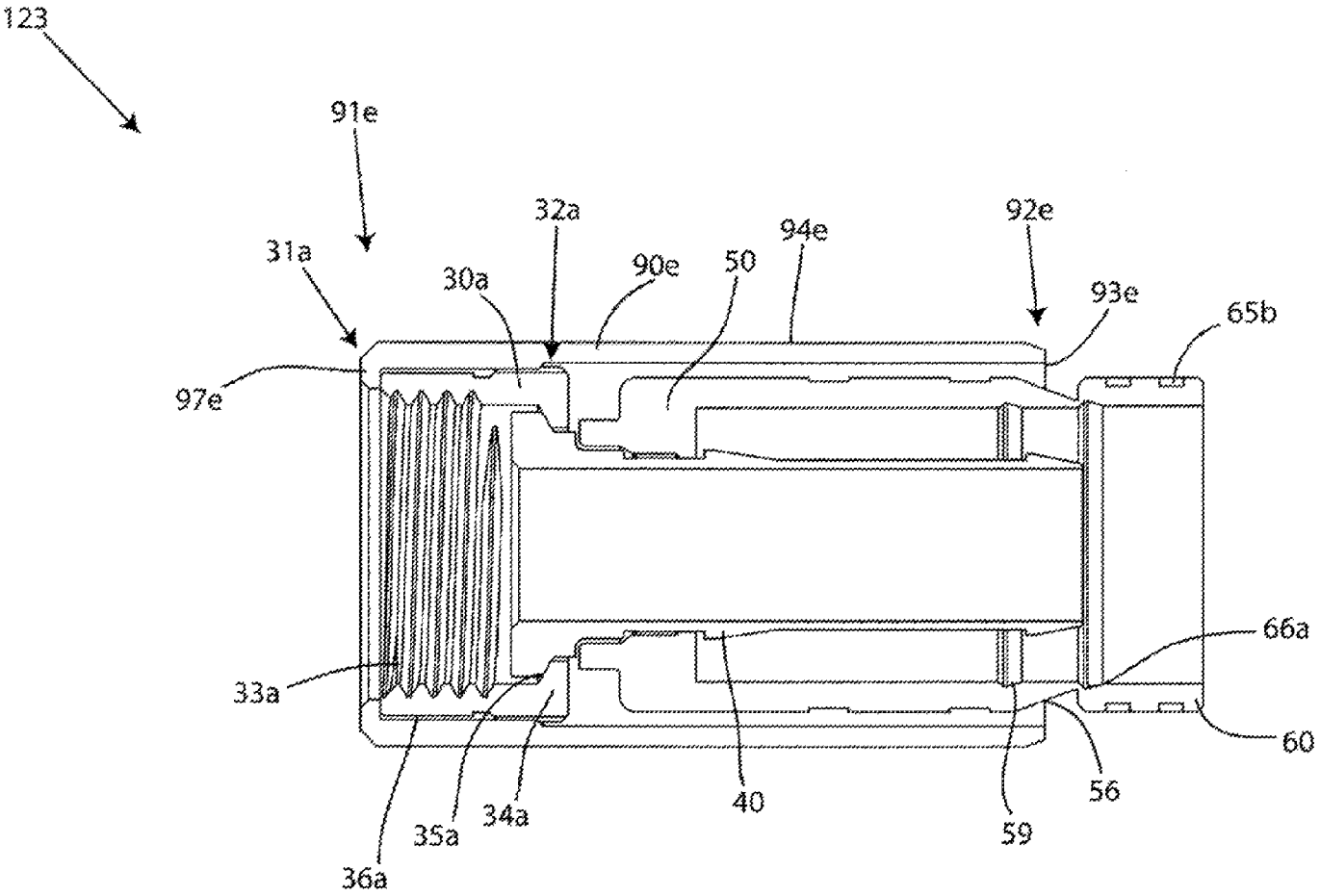
FIG. 24 depicts a cross-section view of a twenty-fourth embodiment of a coaxial cable connector including an embodiment of an outer sleeve, an embodiment of an outer sleeve, an embodiment of a compression portion, and an embodiment of a radial restriction member.

FIG. 24 depicts an embodiment of connector 123. Embodiments of connector 123 may include a coupling member 30*b*, a post 40, a connector body 50, an outer sleeve 90*e*, a compression portion 60, and a radial restriction member 65*b*

Figure 25:
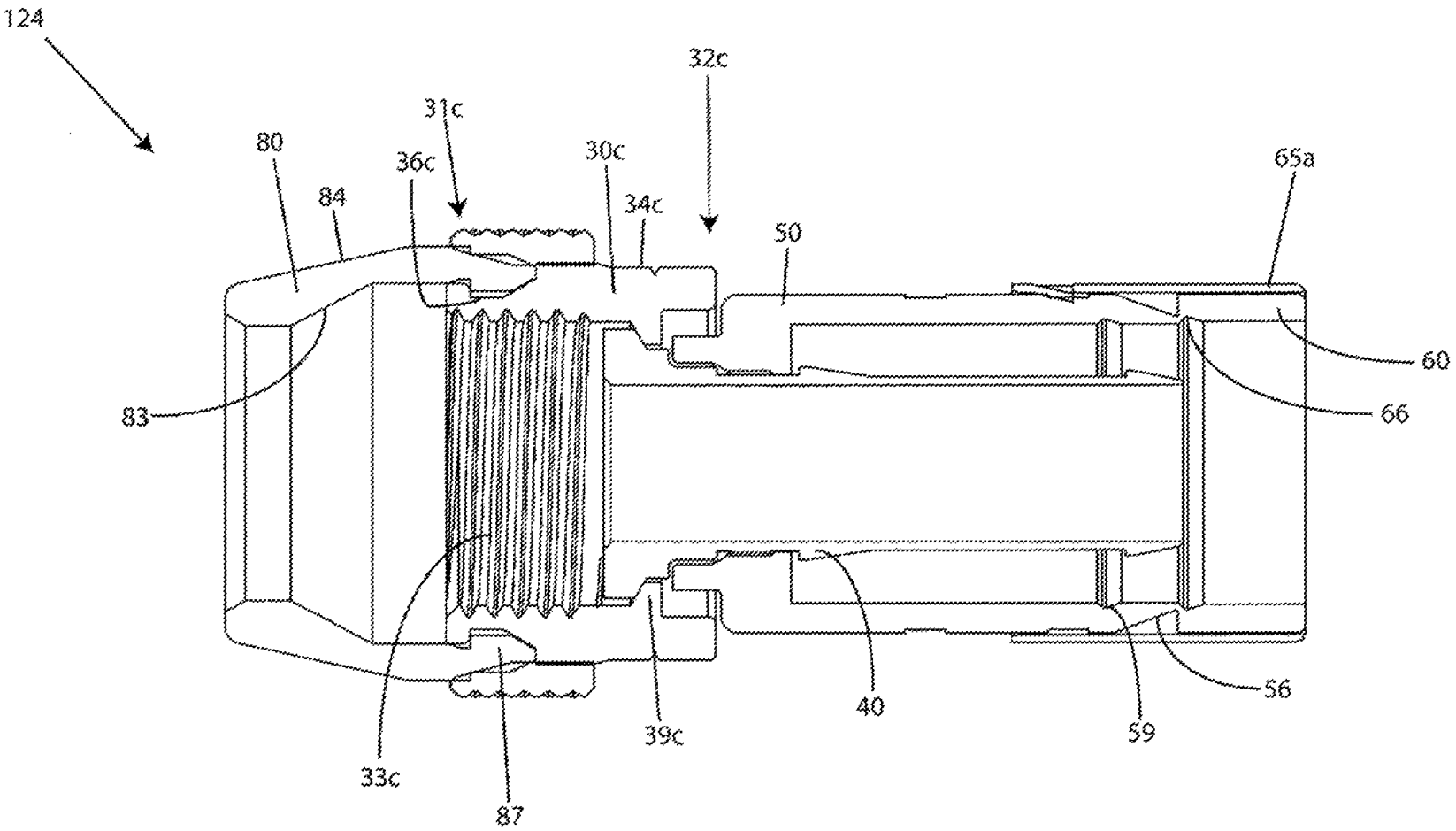
FIG. 25 depicts a cross-section view of a twenty-fifth embodiment of a coaxial cable connector including an embodiment of a sealing member, an embodiment of a compression portion, and an embodiment of a radial restriction member.
Figure 26:
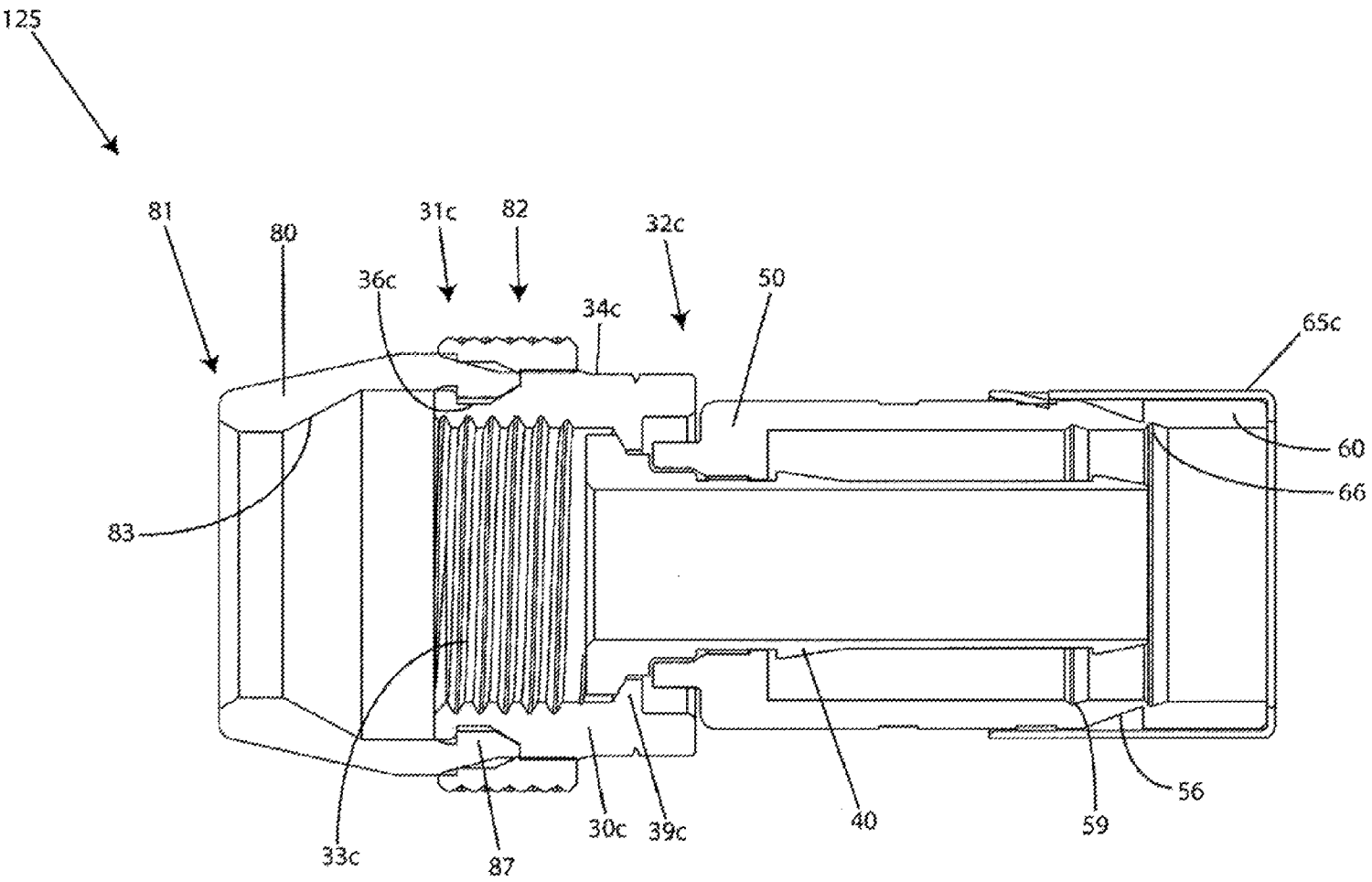
FIG. 26 depicts a cross-section view of a twenty-sixth embodiment of a coaxial cable connector including an embodiment of a sealing member, an embodiment of a compression portion, and an embodiment of a radial restriction member.
Figure 27:
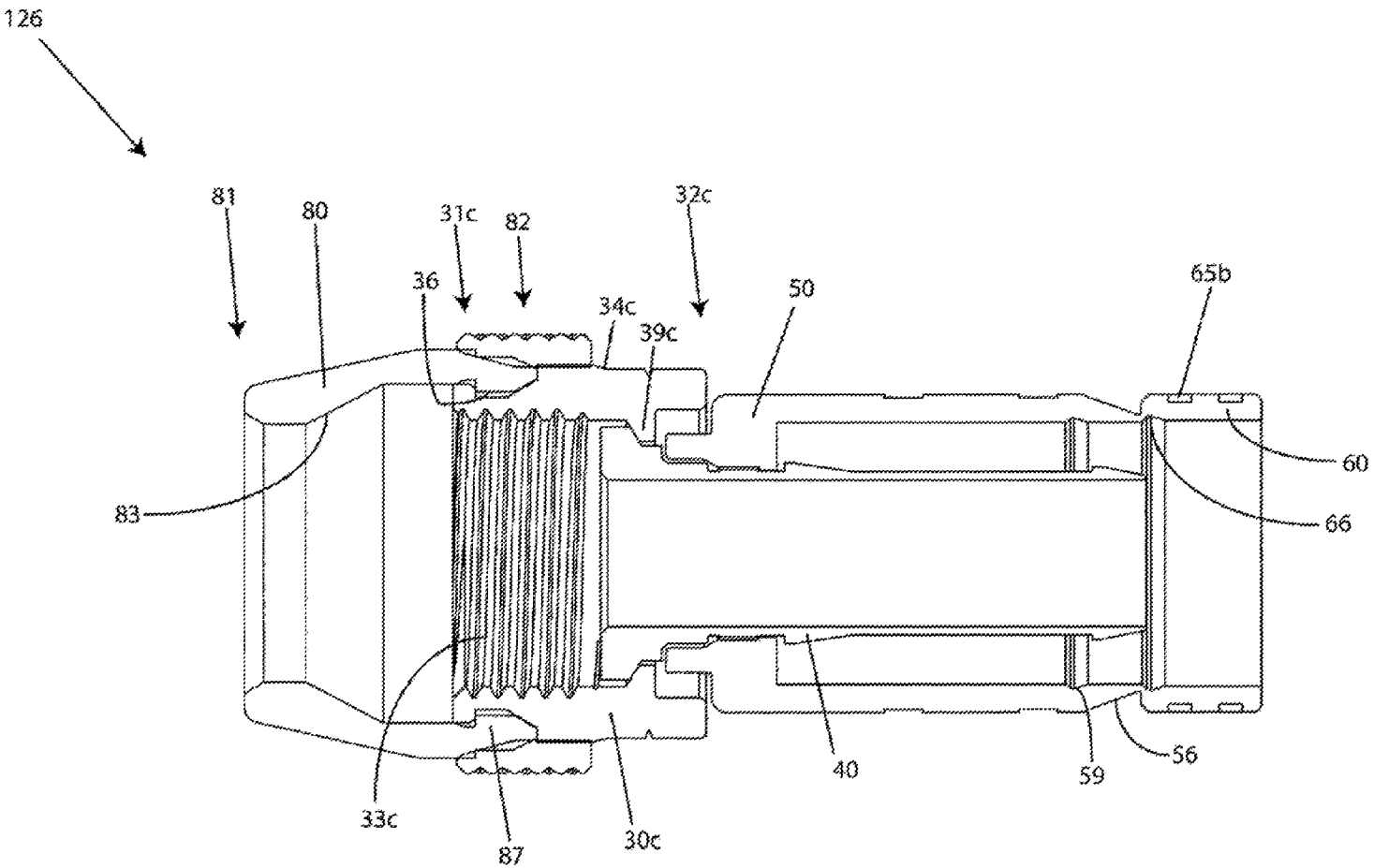
FIG. 27 depicts a cross-section view of a twenty-seventh embodiment of a coaxial cable connector including an embodiment of a sealing member, an embodiment of a compression portion, and an embodiment of a radial restriction member.

Continuing to refer to the drawings, FIGS. 25-27 depict an embodiment of connector 124-128 that may include a coupling member 30*c*, a post 40, a seal member 80, a connector body 50, a connector body seal element 5, a compression portion 60, and a radial restriction member 65. Embodiments of a radial restriction member 65 may be radial restriction member 65*a*, radial restriction member 65*b*, or radial restriction member 65*c*.

Referring to FIG. 25, embodiments of connector 124 may include a coupling member 30*c*, a post 40, a connector body 50, a sealing member 80, a connector body seal element 5, a compression portion 60, and a radial restriction member 65*a*.

FIG. 26 depicts an embodiment of connector 125. Embodiments of connector 125 may include a coupling member 30*c*, a post 40, a connector body 50, a sealing member 80, a compression portion 60, and a radial restriction member 65*c*.

FIG. 27 depicts an embodiment of connector 126. Embodiments of connector 127 may include a coupling member 30*c*, a post 40, a connector body 50, a sealing member 80, a compression portion 60, and a radial restriction member 65*b*.

Figure 29:
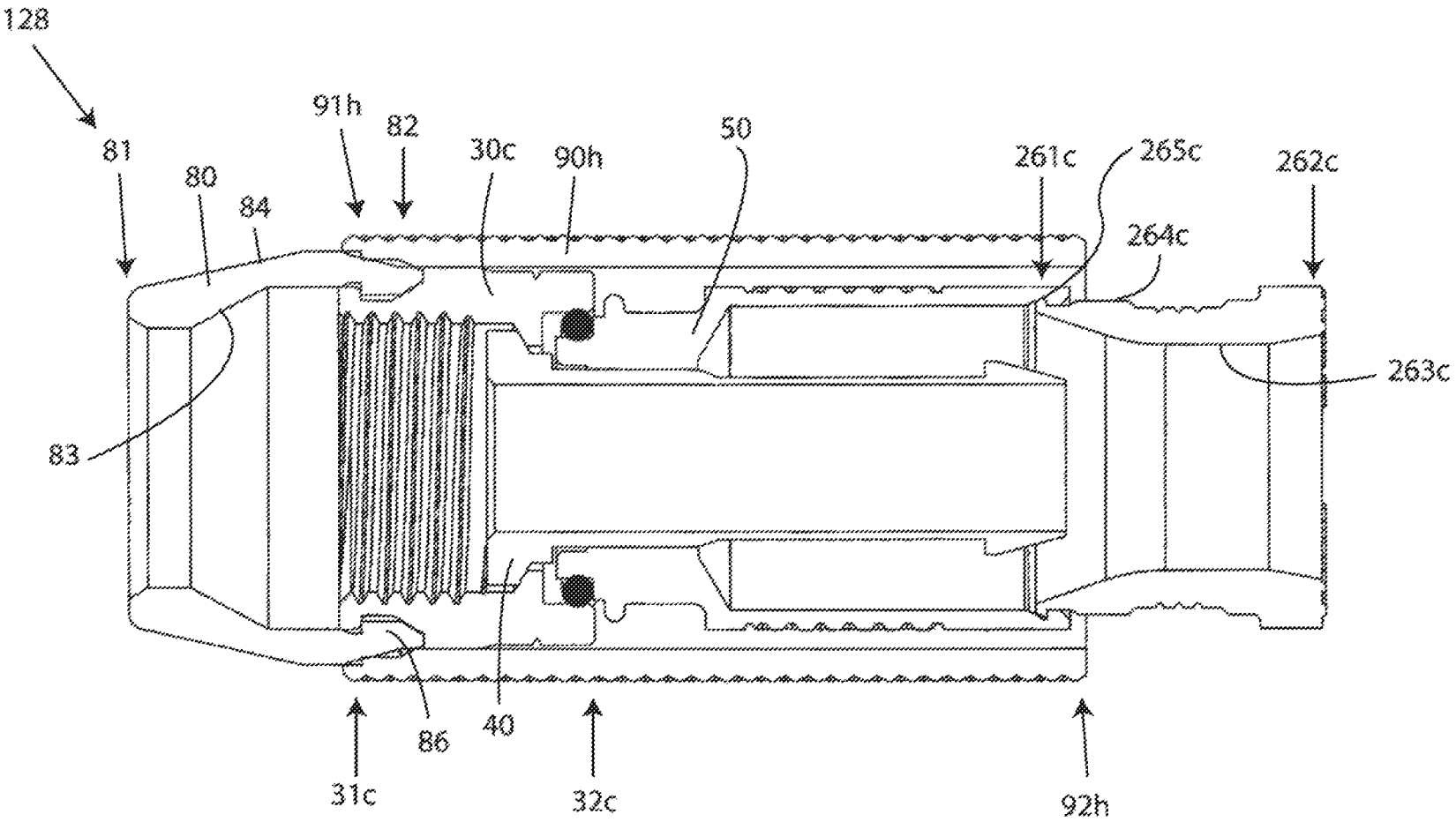
FIG. 29 depicts a cross-section view of a twenty-ninth embodiment of a coaxial cable connector including an embodiment of a sealing member, an embodiment of an outer sleeve, and an embodiment of a compression portion configured to move axially within an embodiment of a connector body.

With reference to FIGS. 28 and 29, embodiments of connector 127-128 may include a coupling member 30*c*, a post 40, a seal member 80, a connector body 50, a sleeve 90*h*, a connector body seal element 5, and a compression portion 260. Embodiments of a compression portion 260 may be compression portion 260*b* or compression portion 260*c*.

FIG. 28 depicts an embodiment of connector 127. Embodiments of connector 127 may include a coupling member 30*c*, a post 40, a connector body 50, a connector body seal member 5, a sleeve 90*h*, and a compression portion 260*b*.

Embodiments of connector 127 may include a compression portion 260*b*. Compression portion 260*b* may be a fastener member that is inserted over the connector body 50 to deformably compress the connector body 50 onto the cable 10. The compression portion 260*b* may have a first end 261 and opposing second end 262. In addition, the compression portion 260 may include an internal annular protrusion 263 located proximate the first end 261 of the compression portion 260*b* and configured to mate and achieve purchase with the annular detent 53 on the outer surface 55 of connector body 50. Moreover, the compression portion 260*b* may comprise a central passageway defined between the first end 261 and second end 262 and extending axially through the compression portion 260*b*. The central passageway may comprise a ramped surface 266 which may be positioned between a first opening or inner bore having a first diameter positioned proximate with the first end 261 of the compression portion 260*b* and a second opening or inner bore having a second diameter positioned proximate with the second end 262 of the compression portion 260*b*. The ramped surface 266 may act to deformably compress the outer surface 55 of a connector body 50 when the compression portion 260*b* is operated to secure a coaxial cable 10. For example, the narrowing geometry will compress squeeze against the cable, when the compression portion is compressed into a tight and secured position on the connector body. Additionally, the compression portion 260*b* may comprise an exterior surface feature 269 positioned proximate with or close to the second end 262 of the compression portion 260*b*. The surface feature 269 may facilitate gripping of the compression portion 260*b* during operation of the connector. Although the surface feature 269 is shown as an annular detent, it may have various shapes and sizes such as a ridge, notch, protrusion, knurling, or other friction or gripping type arrangements. It should be recognized, by those skilled in the requisite art, that the compression portion 260*b* may be formed of rigid materials such as metals, hard plastics, polymers, composites and the like, and/or combinations thereof. Furthermore, the compression portion 260*b* may be manufactured via casting, extruding, cutting, turning, drilling, knurling, injection molding, spraying, blow molding, component overmolding, combinations thereof, or other fabrication methods that may provide efficient production of the component.

FIG. 29 depicts an embodiment of connector 128. Embodiments of connector 128 may include a coupling member 30*c*, a post 40, a connector body 50, a sealing member 80, a connector body seal member 5, a sleeve 90*h*, and a compression portion 260*c*.

Embodiments of connector 128 may include a compression portion 260*c*. Compression portion 260*c* may be an insertable compression sleeve or tubular locking compression member that resides internally with respect to the connector body 50 in the compressed position. The compression portion 260*c* may include a first end 261*c*, a second end 262*c*, an inner surface 263, and an outer surface 264*c*. The compression portion 260*c* may be pushed into the connector body 50 to squeeze against and secure the cable 10. For instance, the compression portion 260*c* may protrude axially into an annular chamber through the rear opening, and may be slidably coupled or otherwise movably affixed to the connector body 50 to compress into the connector body 50 and retain the cable 10. The compression portion 260*c* may be displaceable or movable axially or in the general direction of the axis of the connector between a first open position (accommodating insertion of the tubular inner post 40 into a prepared cable 10 end to contact the grounding shield 14), and a second clamped position compressibly fixing the cable 10 within the chamber of the connector because the compression portion 260*c* is squeezed into retraining contact with the cable 10 within the connector body 50. Furthermore, the compression portion 260*c* may include a lip 265*c* proximate the first end 261*c*, wherein the lip 265*c* of the compression portion 260*c* mates with the internal groove of the connector body 50.

Further embodiments of a coaxial cable connector may include a coupling member 30, a post 40, a connector body 50, a sealing member 80, a connector body seal member 5, a sleeve 90, a compression portion 60/260, and a radial restriction member 65*a*/65*b*/65*c*. Embodiments of sleeve 90 may include sleeve 90*a*/90*b*/90*d*/90*e*/90*f*/90*g*/90*h*, or may simply share the same structural and functional aspects, yet be configured to operably attach to a coupling member having molded plastic threads, or a coupling member that is completely molded. Embodiments of a coupling member 30, which may share the same or substantially the same structural and functional aspects of 30*a*/30*b*/30*c*, may include plastic threads designed to seal against the external threads 23 of port 20 to keep moisture and other physical contaminants out. For example, the threads may be cut slightly different resulting in a differently shaped or dimensioned thread from the threads 23 of the port 20 to achieve a seal with the port 20. Furthermore, the threads could be slightly over-sized causing the metallic threads 23 of the port 20 to slice, pierce, grind, etc., into and against the plastic threads of the plastic coupling member 30 as the plastic coupling member 30 is being threaded onto the port 20. The threads can be molded or machined, and the coupling member 30 can be all plastic (molded or machined) or the coupling member 30 can have a plastic insert that has molded or cut threads. Additionally, the plastic threads may be shaped like pipe-threads causing the non-pipe-thread-shaped threads of the port 20 to seal against the plastic threads of the coupling member 30 when the coupling member 30 is advanced onto the port 20. The threads may also include a small protrusion feature running along the threads that forms a seal with the threads of the port 20 as the coupling member 30 is advanced onto the port 20. Embodiments of a plastic coupling member (or partially plastic coupling member having plastic threads), in addition to creating a physical seal, may inherently create a secure connection to the port 20 because a tight friction-fit may likely be formed with the port 20 as the threads of the coupling member 30 are advanced (with some amount of force that may be necessary to overcome the friction) onto the threads of the port 20.

Those skilled in the art should appreciate that various combinations and embodiments disclosed and described in detail herein may include a body seal element, such as connector body seal element 5, to provide an environmental seal for the coaxial cable connector.

With reference to FIGS. 1-29, a method of fastening a coaxial cable, such as coaxial cable 10, to a communication port, such as port 20. The method may comprise a step of providing a coaxial cable connector 100-128 including: a connector body 50, a post 40 operably attached to the connector body 50, the post 40 having a flange 44, a coupling member 30*a*/30*b*/30*c* axially rotatable with respect to the post 40 and the connector body 50, the coupling member 30*a*/30*b*/30*c* including a lip 34*a*/34*b*/36*c*, an outer sleeve 90*a*/90*b*/90*c*/90*d*/90*e*/90*f*/90*g*/90*h* engageable with the coupling member 30*a*/30*b*/30*c*, and a compression portion 60 structurally integral with the connector body 50. Another method step may include axially compressing the compression portion 60 to form an environmental seal around the coaxial cable 10, wherein when axially compressed, the compression portion 60 breaks away from the connector body 50 and securely connects to the coaxial cable 10. Still another method step may include fastening the coupling member 30*a*/30*b*/30*c* to an interface port by operating the outer sleeve 90*a*/90*b*/90*c*/90*d*/90*e*/90*f*/90*g*/90*h*.

Figure 30:
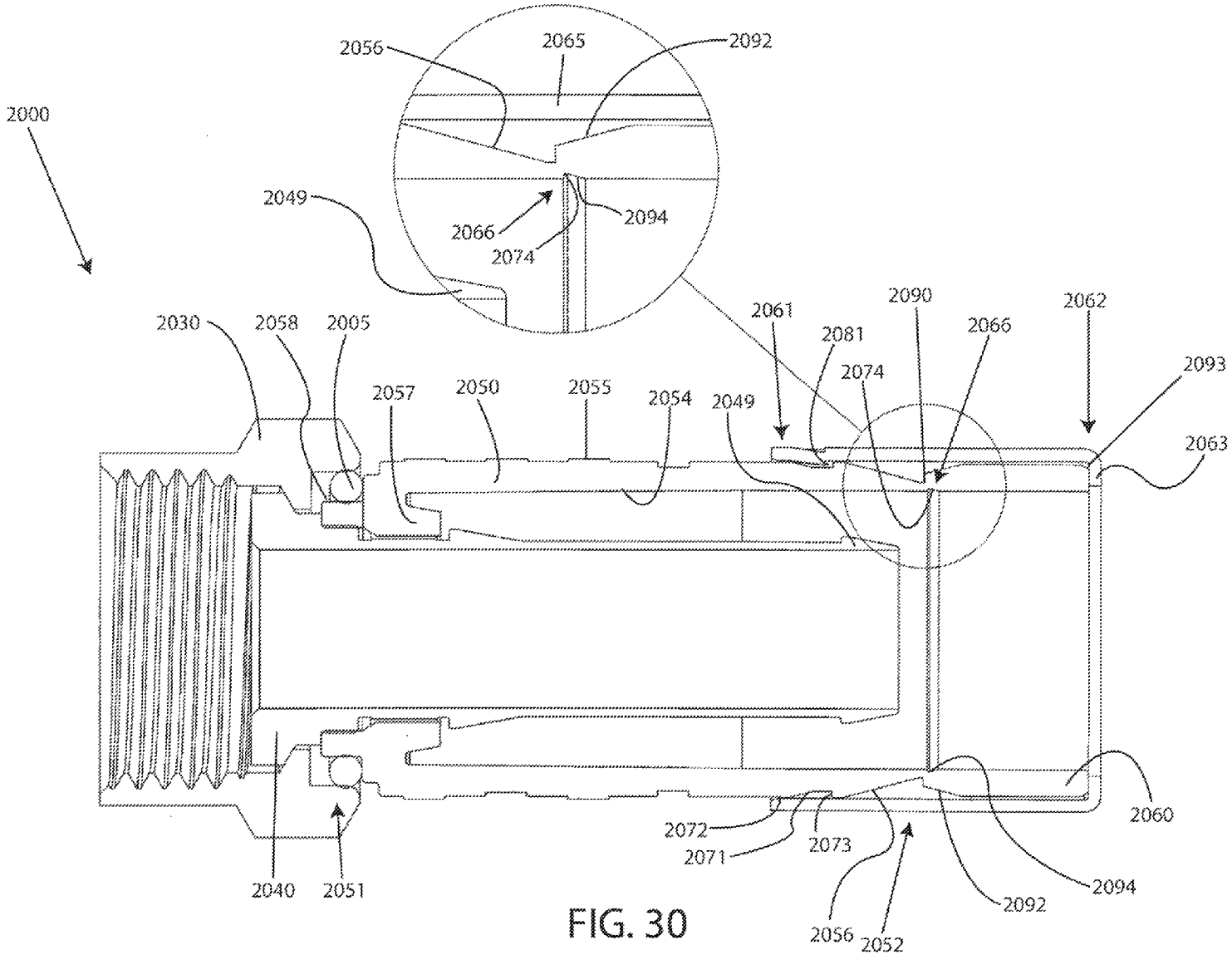
FIG. 30 depicts a cross-section view of a thirtieth embodiment of a coaxial cable connector including an embodiment of a compression portion having an internal annular groove.
Figure 31:
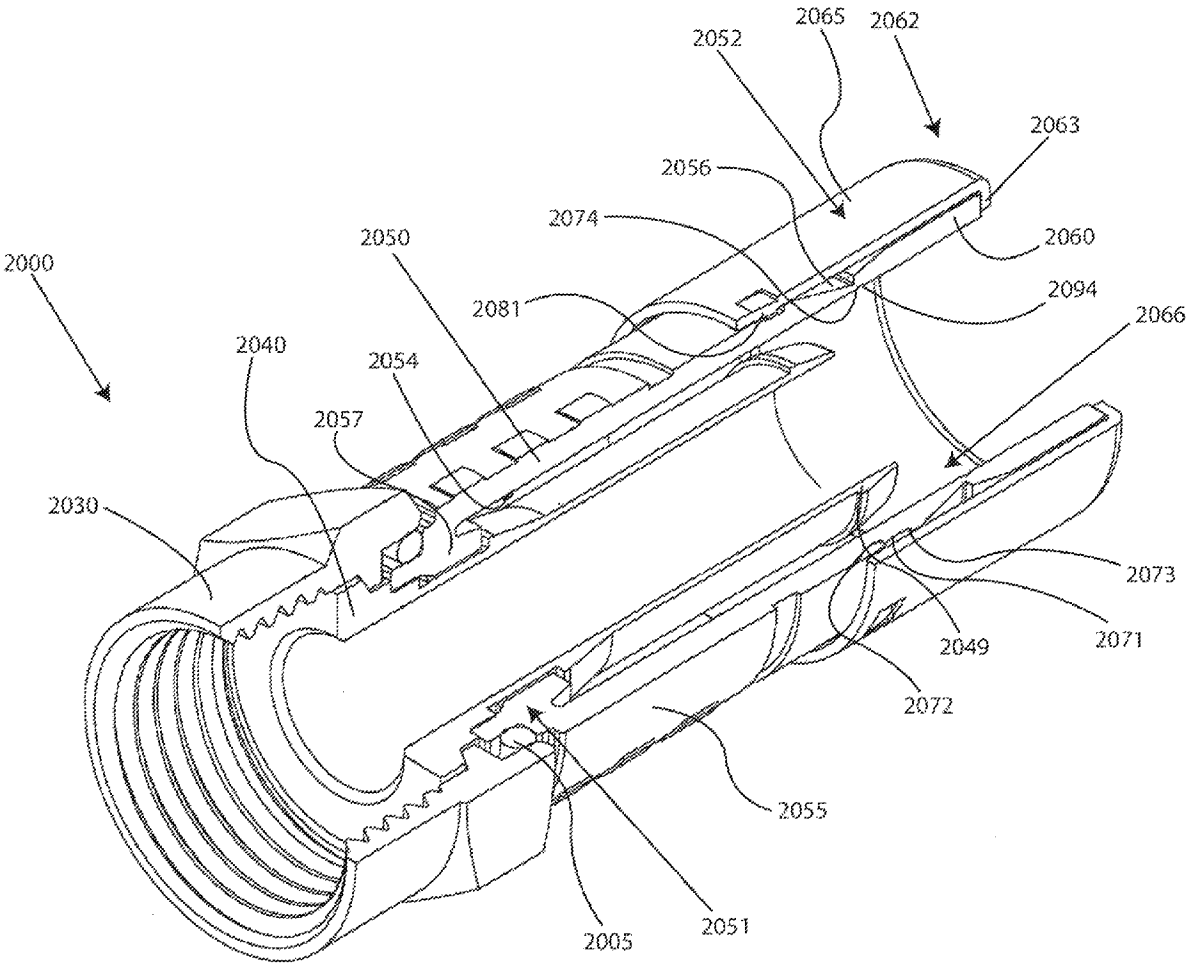
FIG. 31 depicts a perspective cut-away view of the thirtieth embodiment of the coaxial cable connector including an embodiment of a compression portion having an internal annular groove.

Referring now to FIGS. 30 and 31, embodiments of a coaxial cable connector 2000 is shown and described. Embodiments of connector 2000 may share some of the same structural and functional aspects and components as described in association with connectors 100-123. For instance, connector 2000 may comprise a coupling member 2030, a post 2040, a connector body 2050, a compression portion 2060, a radial restriction member 2065, and a connector body seal member 2005 such as, for example, a body O-ring configured to fit around a portion of the connector body 2050. Embodiments of coupling member 2030 may be either coupling member 2030*a* or coupling member 2030*b*, and may share the same or substantially the same structure and function of the coupling member 30, described supra. Embodiments of post 2040 may share the same structure and functional of post 40, described supra. In some embodiments of connector 2000, a gas-tight seal may be effectuated between the post 2040 and the coupling member 2030, and the coupling member and/or post may be comprised of Nickel plated brass for added environmental protection for the connector 2000. Moreover, some embodiments of connector 2000 may a bandwidth of 0 MHz-3 GHz, a nominal impedance of 75 Ohms, a minimum −30 dB to 3 GHz return loss, an insertion loss less than 0.10 dB to 3 GHz, an operating voltage of 90V (at 60 Hz continuous AC), an operating temperature between −40° F. to 140° F. (−40° C. to 60° C.), and a cable retention of 40 lbs minimum. Those skilled in the art should appreciate that the specifications described herein refer to approximate values of one exemplary embodiment of connector 2000. Connector 2000 may come in a preassembled configuration, ready to be attached to a prepared end of a coaxial cable 10, typically through operation of a compression tool.

Embodiments of connector 2000 may include a connector body 2050. The connector body 2050 may comprise a first end 2051 and opposing second end 2052. Moreover, the connector body 2050 may include a post mounting portion 2057 proximate or otherwise near the first end 2051 of the body 2050, the post mounting portion 2057 configured to securely locate the body 2050 relative to a portion of the outer surface of post 2040, so that the connector body 2050 is axially secured with respect to the post 2040, in a manner that prevents the two components from moving with respect to each other in a direction parallel to the axis of the connector 2000. The internal surface of the post mounting portion 2057 may include an engagement feature, such as an annular detent or ridge having a different diameter than the rest of the post mounting portion 207. However other features such as grooves, ridges, protrusions, slots, holes, keyways, bumps, nubs, dimples, crests, rims, or other like structural features may be included. In addition, the connector body 2050 may include an outer annular recess 2058 located proximate or near the first end 2051 of the connector body 2050. Furthermore, the connector body 2050 may include a semi-rigid, yet compliant outer surface 2055, wherein the second end 2052 of the connector body 2050 may be configured to form an annular seal when the second end 2052 is deformably compressed against a received coaxial cable 10 by operation of a compression portion 2060. The connector body 2050 may include an outer ramped surface 2056 to gradually reduce thickness of the connector body 2050 proximate the second end 2052 and define a weakened annular portion with a cooperating internal annular groove 2066 of the compression portion 2060. Further embodiments of connector body 2050 may include an internal annular notch 2059 or groove located an axial distance towards the coupling member 2030 from the internal annular groove 2066 of the compression portion 2060 to structurally facilitate the deformation of the connector body 2050, as described in further detail infra.

Moreover, the connector body 2050 may include an external annular detent 2071 located proximate or close to the second end 2052 of the connector body 2050. The external annular detent 2071 may be configured to receive, mate with, engage with, and/or cooperate with an internal lip 2081 of a radial restriction member 2065. Embodiments of the external annular detent 2071 may include a ramped portion 2072 and a lip portion 2073. The ramped portion 2072 of the external detent 2071 may facilitate smooth or otherwise gradient axial movement of the radial restriction member 2065 towards the coupling member 30 as the radial restriction member 2065 and the compression 2060 are being axially compressed. The lip portion 2073 may form a wall or similar edge that is perpendicular or substantially perpendicular to the outer surface 2055 of the connector body 2050. The location and structure of the lip portion 2073 of the external annular detent 2071 may prevent or interfere with axial movement of the radial restriction member 2065 in a direction away from the coupling member 30, which could result in the radial restriction member 2065 sliding off of the connector 2000. In other words, the radial restriction member 2065 may operably engage the connector body 2050 when the internal lip 2081 of the radial restriction member 2065 snaps into place or cooperates with the external annular detent 2071 of the connector body 2050. Further still, the connector body 2050 may include internal surface features, such as annular serrations formed near or proximate the internal surface of the second end 2052 of the connector body 2050 and configured to enhance frictional restraint and gripping of an inserted and received coaxial cable 10, through tooth-like interaction with the cable. The connector body 2050 may be formed of materials such as plastics, polymers, bendable metals or composite materials that facilitate a semi-rigid, yet compliant outer surface 2055. Further, the connector body 2050 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

Figure 32:
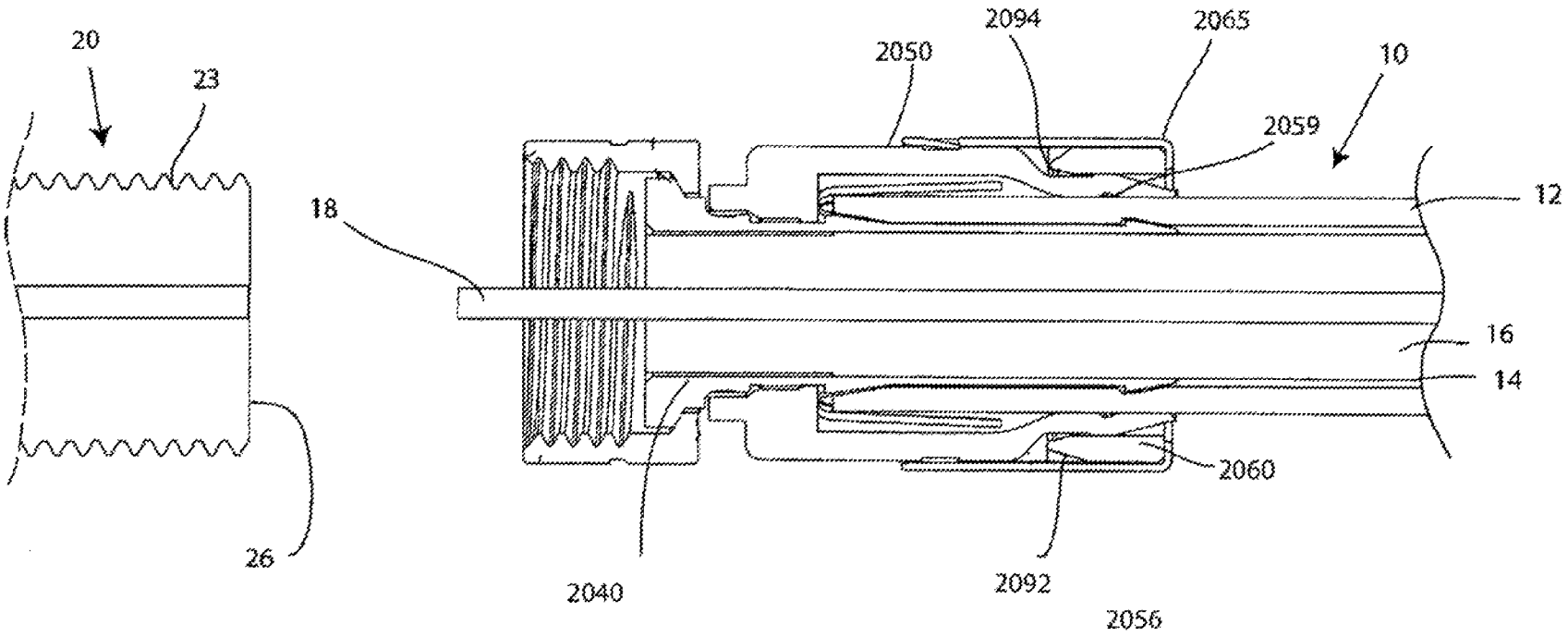
FIG. 32 depicts a cross-section view of an embodiment of the thirtieth embodiment of the coaxial cable connector in a fully compressed position.

Embodiments of connector 2000 may include a compression portion 2060. Compression portion 2060 may be operably attached to the connector body 2050 through a frangible connection 2090. For instance, the compression portion 2060 may be structurally integral with the connector body 2050, wherein the compression portion 2060 separates or shears from the connector body 2050 upon an axial force which in turn radially compresses the second end 2052 of the connector body 2050 onto the coaxial cable 10, as shown in FIG. 32. The structural connection (i.e. frangible connection 2090) between the connector body 2050 and the compression portion 2060 may be thin, frangible, weakened, or otherwise breakable when compressive, axial force is applied (e.g. by an axial compression tool). For example, the compression portion 2060 may have a frangible or breakable connection with the connector body 2050. Moreover, the structural connection or configuration between the connector body 2050 and the compression portion 2060 may be defined by an internal annular notch 2066 or groove of the compression portion 2060 and an outer ramped surface 2056 of the connector body 2050. Embodiments of the internal annular groove 2066 may include a ramped inner surface 2074 formed from part of the connector body 2050, and a ramped inner surface 2094 formed from part of the compression portion 2060. In other words, the internal annular groove 2066 may comprise two opposingly ramped inner surfaces 2094, 2074 converging toward the frangible connection 2090 to reduce the overall thickness and/or girth of the frangible connection 2090 and help control the breaking pattern of the compression portion 2060 from the connector body 2050. Ramped inner surface 2094 forming the annular groove 2066 may be part of the compression portion 2060, and may have the same or similar angle (with respect to a uniform portion of the inner surface 2054) as the outer ramped surface 2056, such that when the frangible connection 2090 is severed, the ramped inner surface 2094 of the annular groove 2066 associated with the compression portion 2060 can cooperate with the outer ramped surface 2056 of the connector body 2050 during compression of the connector 2000. The internal annular groove 2066 may act as a stress concentrator for consistent cracking form and location during compression. Accordingly, embodiments of connector 2000 may include a stress concentrator along an inner surface 2054 of the connector body 2050 to facilitate controlled deformation and/or cracking of the frangible connection 2090. One embodiment of a stress concentrator may be the internal annular groove 2066. Other embodiments of a stress concentrator may include a different internal geometry than as described above, and achieve the same result. For instance, an embodiment of a stress concentrator may be any internal geometry at one or more locations along the compression portion 2060, the connector body 2050, or a combination of the compression portion 2060 and the connector body 2050 that either or both facilitates a consistent and/or even cracking of a frangible connection therebetween and facilitates the axial movement of the various connector components during compression.

Embodiments of the compression portion 2060 may include a first outer ramped surface 2092 proximate the frangible connection 2090. The first outer ramped surface 2092 of the compression portion 2060 may help to gradually reduce the thickness of the compression portion proximate the frangible connection 2090; furthermore, the first outer ramped surface 2092 may also provide a small amount of space for the compression portion 2060 to more efficiently and smoothly ride up along the outer ramped surface 2056 of the connector body 2050 during compression of the compression portion 2060. Further still, embodiments of the compression portion 2060 may include a second outer ramped surface 2093 at an opposing end of the compression portion 2060 from the first outer ramped portion 2092. The second outer ramped portion 2093 may extend less axial distance than the first outer ramped surface 2092, and may provide some clearance or leeway for the radial restriction member 2065 when being compressed. The annular notch 2059 of the connector body 2050 located an axial distance from the internal annular notch 2066 may further facilitate the deformation of the second end 2052 of the connector body 2050.

Additionally, the frangible connection 2090 may be located at an axial distance along the connector 2000 just prior to, proximate, or otherwise near the single barb 2049 on the second end of the post 2040 to allow for compression of the second end 2052 of the connector body 2050 onto the cable 10 at a location where the grounding shield 14 and jacket 12 bulge out from engagement with the annular barb 2049. If the grounding shield 14 and jacket 12 of the cable 10 are radially displaced outward based on engagement with the single, annular barb 2049 of the post 2040, then the second end 2052 of the connector body 2050 can exert more force against the shield 14 and jacket 12 to enhance the seal created around the cable 10 proximate the rear end of the connector 2000. Embodiments of the compression portion 2060 may be formed of the same material as connector body 2050 because they may be structurally integral with each other. For example, the compression portion 2060 may be comprised of materials such as plastics, polymers, bendable metals or composite materials that facilitate a rigid body. Further, the compression portion 2060 may be formed of conductive or non-conductive materials or a combination thereof. Manufacture of the compression member 2060 may include casting, extruding, cutting, turning, drilling, knurling, injection molding, spraying, blow molding, component overmolding, combinations thereof, or other fabrication methods that may provide efficient production of the component.

Furthermore, embodiments of connector 2000 may include a radial restriction member 2065. The radial restriction member 2065 may be a sleeve or similar annular tubular member disposed proximate the rearward second end 2052 of the connector body 2050. For instance, the radial restriction member 2065 may surround the compression portion 2060 and a portion of the connector body 2050 proximate the rearward second end 2052. Embodiments of the radial restriction member 2065 may include an engagement surface for operable engagement with a compression tool. For instance, embodiments of the radial restriction member 2065 may include an internal annular lip 2063 or inwardly extending flange proximate a rearward end 2062 of the radial restriction member 2065. The lip 2063 may radially inwardly extend a distance to cover about half of the thickness of the compression portion 2060. The radial restriction member 2065 may surround or partially surround the compression portion 2060 and a portion of the connector body 2050 proximate the rearward second end 2052, wherein the internal annular lip 2063 of the radial restriction member 2065 may be configured to contact the compression portion 2060 prior to or upon axial compression of the connector. Additionally, the internal lip 2063 proximate the rearward end 2062 of the radial restriction member 2065 may provide an engagement surface for operable engagement with a compression tool, or other device/means that provides the necessary compression to compress seal connector 2000. The radial restriction member 2065 may be a generally annular, hollow cylindrically-shaped sleeve-like member comprised of stainless steel or other substantially rigid materials which may structurally assist the crack and seal process of compression portion 2060. For instance, when the compression portion 2060 is axially compressed in a direction towards the coupling member 2030, the radial restriction member 2065 may axially displace along with the compression portion 2060 and may prevent the compression portion 2060 from splintering or otherwise displacing in a direction other than substantially axial towards the coupling member 2030. Furthermore, the axial length of the radial restriction member 2065 may vary, but when in the uncompressed position, a forward end 2061 of the radial restriction member 2065 may terminate a distance just beyond (towards coupling member 2030) the external annular detent 2071, sufficient to allow the radial restriction member 2065 to securably attach to the connector body 2050. Embodiments of the radial restriction member 2065 may be a radial restriction member sharing the same or substantially the same structure and function of the radial restriction member 65*a*, and 65*b* described supra.

Embodiments of the compression portion 2060 may create an environmental seal around the coaxial cable 10 when in the fully compressed position (shown in FIG. 32). Specifically, when the compression portion 2060 (and the radial restriction member 2065) is axially slid or compressed towards the coupling member 2030, the frangible connection 2090 between the compression portion 2060 and the connector body 2050 is severed, sheared, ruptured, etc., and the compression portion 2060 comes into contact with the outer ramped surface 2056 of the connector body 2050. The severing of the frangible connection 2090 between the connector body 2050 and the compression portion 2060 essentially turns the internal notch 2066 into a cooperative ramped surface with the outer ramped surface 2056 of the connector body 2050. Due to the cooperative ramped surfaces, the axial compression (displacement) of the compression portion 2060 evenly compresses the second end 2052 of the connector body 2050 onto the outer jacket 12 of the coaxial cable 10 and deforms the outer ramped surface 2056, as shown in FIG. 32. Accordingly, the compression portion 2060 and potentially the radial restriction member 2065 may be referred to as a crack and seal compression means with a radial restriction member 2065. Those skilled in the requisite art should appreciate that the seal may be created by the compression portion 2060 without the radial restriction member 2065. However, the radial restriction member 2065 significantly enhances the structural integrity and functional operability of the compression portion, for example, when it is compressed and sealed against an attached coaxial cable 10.

With reference now to FIGS. 30-32, an embodiment of a method of fastening a coaxial cable to a coaxial cable may include the steps of providing a coaxial cable connector 2000 including: a connector body 2050 having an outer ramped surface 2056, a post 2040 engageable with the connector body 2050, a coupling member 2030 axially rotatable with respect to the post 2040, and a compression portion 2060 structurally integral with the connector body 2050, the compression portion 2060 having a ramped inner surface 2094, and axially compressing the compression portion 2060 to securably attach the connector 2000 to the coaxial cable 10 and form an environmental seal around the coaxial cable 10, wherein the inner ramped surface 2094 is configured to cooperate with the outer ramped surface 2056 during the axial compression of the compression portion 2060 onto a portion of the connector body 2050.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A coaxial cable connector having a post and a coupling element configured to engage the post comprising;

a crack-and-seal body member including a first portion having an inner ramped portion, a second portion having an outer ramped portion, and a separation portion between the first portion and the second portion, and wherein the first portion is configured to move between a first position, where the inner ramped portion is not engaged with the outer ramped portion and the first portion is connected to the second portion, and a second position, where the first portion is sufficiently engaged with the second portion so as to separate the first portion from the second portion along the separation portion and allow the first portion to form a seal around a cable.

2. The connector of claim 1, wherein the first portion comprises a compression portion.

3. The connector of claim 1, wherein the separation portion comprises a groove.

4. The connector of claim 1, wherein the separation portion comprises a stress concentration portion.

5. A method for providing a coaxial cable connector having a coupling element configured to engage a post comprising;

arranging a break-and-sealable body member so as to engage a post, the body member including a first portion having an inner ramped portion, a second portion having an outer ramped portion, and a separation portion between the first portion and the second portion, and configuring the first portion so as to move between a first position, where the inner ramped portion is not engaged with the outer ramped portion and the first portion is connected to the second portion, and a second position, where the inner ramped portion is sufficiently engaged with the outer ramped portion so as to separate the first portion from the second portion along the separation portion and allow the first portion to form a seal around a cable.

6. The method of claim 5, wherein the first portion comprises a compression portion.

7. The method of claim 5, wherein the separation portion comprises a groove.

8. The connector of claim 5, wherein the separation portion comprises a stress concentration portion.

9. The connector of claim 5, wherein the separation portion comprises an internal annular groove.

10. The connector of claim 9, wherein the internal annular groove comprises two opposingly ramped inner surfaces.

11. The connector of claim 5, wherein the separation portion comprises a frangible connection.

12. The connector of claim 11, wherein the frangible connection is defined by the outer ramped portion of the body member and an internal annular groove.

13. A method for providing a coaxial cable connector having a coupling element configured to engage a post comprising;

arranging a crack-and-seal body member so as to engage a post, the body member including a first portion having an inner ramped portion, a second portion having an outer ramped portion, and a separation portion between the first portion and the second portion, and moving the first portion between a first position, where the inner ramped portion is not engaged with the outer ramped portion and the first portion is connected to the second portion, and a second position, where the inner ramped portion is sufficiently engaged with the outer ramped portion so as to separate the first portion from the second portion along the separation portion and allow the first portion to form a seal around a cable.

14. A method of fastening a coaxial cable connector to a coaxial cable, the method comprising:

providing a body means having a first portion separably attached to a second portion, an outer ramped portion, a separation portion, and an inner ramped portion;

providing a post means engageable with the body means;

providing a coupling means axially rotatable with respect to the post; and axially compressing the first portion of the body means so to separate the first portion from the second portion of the body means, securably attach the coaxial cable connector to the coaxial cable, and form a seal relative to the coaxial cable;

wherein the inner ramped portion of the body means is configured to cooperate with the outer ramped portion of the body means during the axial compression.

* * * * *